US009797590B2

(12) United States Patent
Zhang et al.

(10) Patent No.: US 9,797,590 B2
(45) Date of Patent: Oct. 24, 2017

(54) METHOD FOR CONSTRUCTING UNIVERSAL LED BULB AND FLANGE SNAP RING TYPE LED BULB AND LED LAMP

(71) Applicant: GUIZHOU GUANGPUSEN PHOTOELECTRIC. CO., LTD, Guizhou (CN)

(72) Inventors: Jiqiang Zhang, Guizhou (CN); Zheyuan Zhang, Guizhou (CN)

(73) Assignee: GUIZHOU GZGPS CO., LTD., Guiyang, Guizhou (CN)

( * ) Notice: Subject to any disclaimer, the term of this patent is extended or adjusted under 35 U.S.C. 154(b) by 455 days.

(21) Appl. No.: 14/416,768

(22) PCT Filed: Jul. 23, 2013

(86) PCT No.: PCT/CN2013/000879

§ 371 (c)(1),
(2) Date: Jan. 23, 2015

(87) PCT Pub. No.: WO2014/015655

PCT Pub. Date: Jan. 30, 2014

(65) Prior Publication Data

US 2015/0176831 A1 Jun. 25, 2015

(30) Foreign Application Priority Data

Jul. 23, 2012 (CN) ..... 2012 1 0253512
Jul. 23, 2012 (CN) ..... 2012 1 0253639
(Continued)

(51) Int. Cl.
*F21V 29/74* (2015.01)
*F21V 23/06* (2006.01)
(Continued)

(52) U.S. Cl.
CPC ..... *F21V 29/74* (2015.01); *F21S 8/026* (2013.01); *F21S 8/085* (2013.01); *F21V 23/001* (2013.01);
(Continued)

(58) Field of Classification Search
CPC ..... F21V 29/74; F21V 29/50; F21V 29/56; F21V 29/70; F21V 23/001; F21V 23/06;
(Continued)

(56) References Cited

FOREIGN PATENT DOCUMENTS

CN 201582681 U 9/2010
CN 102213370 A 10/2011
(Continued)

OTHER PUBLICATIONS

Search Report issued in International Application No. PCT/CN2013/000879, dated Oct. 31, 2013 (Oct. 31, 2013).

*Primary Examiner* — Mary Ellen Bowman
(74) *Attorney, Agent, or Firm* — Nath, Goldberg & Meyer; Joshua B. Goldberg

(57) ABSTRACT

The present invention provides a method for constructing a universal LED bulb, a flange snap ring type LED bulb and a lamp. A heat conductive bracket (3) is used as the structure supporting main body to establish an optical engine core member. A thin-shelled lens snap ring (8) is used to support the optical engine core member in an auxiliary manner. An installation flange hole is provided to the lens snap ring (8), correspondingly to an installation flange hole of the heat conductive bracket (3), to surround and protect the heat conductive bracket (3). The optical engine core member is composed of the heat conductive bracket (3), an optical engine module (4), an inner snap ring (81) and a light distribution optical lens (7). An inner cover (6) is provided outside the optical engine module (4). An electric connector (11) is provided to the heat conductive bracket (3).

25 Claims, 50 Drawing Sheets

(30) Foreign Application Priority Data

| | | |
|---|---|---|
| Jul. 23, 2012 | (CN) | 2012 1 0253683 |
| Jul. 23, 2012 | (CN) | 2012 1 0253704 |
| Jul. 23, 2012 | (CN) | 2012 1 0253727 |
| Jul. 23, 2012 | (CN) | 2012 1 0253766 |
| Jul. 23, 2012 | (CN) | 2012 1 0253801 |
| Jul. 23, 2012 | (CN) | 2012 1 0253805 |
| Jul. 23, 2012 | (CN) | 2012 1 0253818 |

(51) Int. Cl.

| | |
|---|---|
| ***F21V 29/00*** | (2015.01) |
| ***F21S 8/02*** | (2006.01) |
| ***F21V 29/70*** | (2015.01) |
| ***F21V 29/50*** | (2015.01) |
| ***F21V 29/56*** | (2015.01) |
| ***F21S 8/08*** | (2006.01) |
| ***F21V 23/00*** | (2015.01) |
| ***F21V 31/00*** | (2006.01) |
| *F21Y 115/10* | (2016.01) |

(52) U.S. Cl.
CPC ..... *F21V 23/06* (2013.01); *F21V 29/004* (2013.01); *F21V 29/50* (2015.01); *F21V 29/56* (2015.01); *F21V 29/70* (2015.01); *F21V 31/005* (2013.01); *F21Y 2115/10* (2016.08)

(58) Field of Classification Search
CPC ..... F21V 23/004; F21V 31/005; F21S 8/026; F21S 8/085
See application file for complete search history.

(56) References Cited

FOREIGN PATENT DOCUMENTS

| | | | |
|---|---|---|---|
| CN | 202100978 | U | 1/2012 |
| CN | 202125839 | U | 1/2012 |
| CN | 102777824 | A | 11/2012 |
| CN | 102777827 | A | 11/2012 |
| CN | 102798004 | A | 11/2012 |
| CN | 102798007 | A | 11/2012 |
| CN | 102818176 | A | 12/2012 |
| CN | 102818178 | A | 12/2012 |
| CN | 102818182 | A | 12/2012 |
| CN | 102818183 | A | 12/2012 |
| CN | 102927463 | A | 2/2013 |
| JP | 2011114094 | A | 6/2011 |

Incorporated by Reference (Rule 20.6 of the Regulations)

Incorporated by Reference (Rule 20.6 of the Regulations)

METHOD FOR CONSTRUCTING UNIVERSAL LED BULB AND FLANGE SNAP RING TYPE LED BULB AND LED LAMP

This is a National Phase Application filed under 35 U.S.C. 371 as a national stage of PCT/CN2013/000879, filed Jul. 23, 2013, an application claiming the benefit to Chinese application No. 201210253639.1, filed on Jul. 23, 2012; Chinese application No. 201210253704.0, filed on Jul. 23, 2012; Chinese application No. 201210253683.2, filed on Jul. 23, 2012; Chinese application No. 201210253805.8, filed on Jul. 23, 2012; Chinese application No. 201210253727.1, filed on Jul. 23, 2012; Chinese application No. 201210253512.X, filed on Jul. 23, 2012; Chinese application No. 201210253818.5, filed on Jul. 23, 2012; Chinese application No. 201210253766.1, filed on Jul. 23, 2012; Chinese application No. 201210253801.X, filed on Jul. 23, 2012; the content of each of which is hereby incorporated by reference in its entirety.

FIELD OF THE INVENTION

The present invention relates to a method for constructing a universal LED bulb, a flange snap ring type LED bulb and an LED lamp, which involve the field of LED lighting technology.

BACKGROUND OF THE INVENTION

As a new generation of lighting technology, LED semiconductor lighting has five energy-saving advantages incomparable by the existing other lighting technologies, such as high photoelectric conversion efficiency, easy control of light source direction, easy control of lighting time and manner, high light source color rendering property, and a high power factor under reasonable design, thus being warmly welcomed by worldwide investors and vigorously supported by the governments of all countries. The luminous efficiency of most current LED lamps may exceed 70 LM/W, thus having better energy saving advantages than the traditional energy saving lamps. The luminous efficiency of green LEDs may be as high as 683 LM/W theoretically; the theoretical efficiency of white LEDs is also up to 182.45 LM/W, so the improvement space of LED lighting efficiency is huge.

In the current design of high power LED lighting products, especially high power LED lamps, due to heat dissipation, when a high power LED lamp is assembled, an LED light module, a driving power supply and a lamp are integrally designed, namely such components as the LED light module, the driving power supply and the lamp must be produced collectively, thus forming a situation of "LED having lamp while lacking bulb". This brings a series of fatal problems to the LED lighting products, such as high manufacturing cost, inconvenience for use, maintenance difficulty, and the like. First of all, national and even global uniform standardized production could not be achieved on manufacture, leading to numerous product specifications, few batches and high prices; second, the products of producers are varied, not universal, let alone interchangeable; third, the LED light module, the driving power supply, the lamp and the like need to be integrally detached for maintenance in the case of product failure, thus the maintenance is very inconvenient, and such defects as expanded failure, delayed maintenance and high maintenance cost and the like are very liable to form. These defects greatly restrict the popularization and use of LED lighting and are inherent problems in the popularization of the LED lighting products.

SUMMARY OF THE INVENTION

The object of the present invention is to provide a method for constructing a universal LED bulb, a flange snap ring type LED bulb and an LED lamp. It is simple and stable in structure, convenient to install, capable of being provided with a radiator to independently operate and may also be installed on the radiator of the lamp, thus being used flexibly. By adopting the present invention, the LED bulb is independently produced and used with such products as lamp and lighting control and the like on production, thereby greatly reducing the production procedures of the LED lighting products, improving mass production and facilitating the industrialization of LED energy-saving lighting products.

The technical solutions of the present invention are as follows: a method for constructing a universal LED bulb, comprising: establishing an optical engine core member of the LED bulb using a heat conductive bracket as the structure supporting main body of the bulb, and supportting the optical engine core member of the LED bulb using a thin-shelled lens snap ring in an auxiliary manner, wherein an installation flange hole is provided to the lens snap ring, the thin-shelled lens snap ring corresponds to a flange through hole of the heat conductive bracket to surround and protect the heat conductive bracket for installing the bulb; the optical engine core member of the LED bulb is composed of the heat conductive bracket, an optical engine module, an inner snap ring and a light distribution optical lens, wherein an inner cover is provided outside the optical engine module, and an electric connector is provided to the heat conductive bracket; the optical engine module is made up of an optical engine die plate, an LED chipset and a relevant wiring by bonding and packaging, or is further integrated with a power supply drive chip. The optical engine die plate is a normalized heat conductive substrate.

In the above-mentioned method for constructing the universal LED bulb, the diameter of the lens snap ring is a bulb outer diameter D, the bulb outer diameter D and an upper limit of power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve the interchangeability and universality of the LED bulbs; on the relationship curve $W=1.1812e^{0.0361D}$ 20 mm is used as the lower limit of the bulb outer diameter D, 130 mm is used as the upper limit, each 10 mm is set as a segment, the relationship curve is divided into 12 segments to form a limited number of bulb outer diameter specifications, and interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the bulb outer diameter D; the diameter D2 of a radiator interface opening of the LED bulb on a lamp is a value obtained by subtracting two times of a diameter of a fixing screw cap and then subtracting two times of the margin corresponding to the diameter D1 from the bulb outer diameter D. The installation interface of the LED bulb includes a surface in contact with the LED bulb and a hole connected to the LED bulb, on the lamp.

In the foregoing method for constructing the universal LED bulb, the heat conductive bracket is combined and adhered with the optical engine module to form an integral piece, the inner snap ring surrounds the optical engine module, or an inner ring cover is further provided between the inner snap ring and the inner cover; the upper part of the inner snap ring is connected to the heat conductive bracket, the lower part of the inner snap ring is adhered with the light distribution optical lens, for enclosing the optical engine module in a sealed waterproof space among the heat conductive bracket, the inner snap ring and the light distribution optical lens, or the inner snap ring is further used as the installation base of an LED bulb radiator; the thicknesses of the light distribution optical lens, the inner snap ring and the heat conductive bracket are adjusted to enable the heat conductive bracket to closely lean against the radiator when the lens snap ring is installed, and the light distribution optical lens is tightly bonded to the lens snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology. Due to this structure, the structure between the LED light source chip and the radiator is simpler, heat generated by the chip will be quickly transferred to the optical engine die plate for dispersion, thus being conducive to cool the LED chip and prolong the service life of the LED light source.

In the foregoing method for constructing the universal LED bulb, for a small-specification LED bulb, the optical engine module, the inner snap ring and the light distribution optical lens are sequentially overlapped and adhered on the heat conductive bracket, the inner cover is provided outside the optical engine module, or the inner ring cover is further provided between the inner snap ring and the inner cover, and components packaged on the optical engine die plate in the optical engine module are packaged in the sealed waterproof space among the optical engine die plate, the inner snap ring and the light distribution optical lens; or, the inner cover and the inner snap ring are of an integral structure (namely, an inner cover with a function of the inner ring), the components packaged on the optical engine die plate are packaged in the waterproof space between the optical engine die plate and the integral structure formed by the inner cover and the inner snap ring; or the inner snap ring is further used as the installation base of the LED bulb radiator; the thicknesses of the light distribution optical lens, the inner snap ring and the heat conductive bracket are adjusted to enable the heat conductive bracket to closely lean against the radiator when the lens snap ring is installed, and the light distribution optical lens is tightly bonded to the lens snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing method for constructing the universal LED bulb, a radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive converting bracket, the nonmetal radiator and the heat conductive converting bracket are obtained by extrusion forming an ultrafine nonmetal heat conductive material (such as alumina, silicon carbide or the like with a mesh number of fineness smaller than 300) at a low temperature to form a screen mesh shape and sintering the same at a high temperature, the contact surfaces thereof are adhered into an integral piece by coating a heat conductive adhesive, the heat conductive converting bracket is overhead, the nonmetal radiator takes the shape of a screen mesh, and the nonmetal radiator is kept overhead by the heat conductive converting bracket, for enabling the air to enter the screen mesh of the nonmetal radiator from the heat conductive converting bracket. A rubber sheath or screw fixing glue is filled in the fixing screw hole of the nonmetal radiator for connecting a fixing screw, and a radiator outer cover, which may be punch-formed by a metal material or die-cast by plastics to beautify the appearance of the bulb, is provided outside the nonmetal radiator; or the radiator is a metal radiator, the heat conductive pad is provided between the metal radiator and the heat conductive bracket, the metal radiator is of a hollow structure, a foam metal is filled in the hollow part, superconducting liquid is filled in the hollow structure, upper and lower stoppers are pressed by interference fit or screwed by a threaded seal gum in the hollow structure to form a sealed space, and the sealed space is vacuumized; a radiator fixing screw is penetrated through a fixing through hole on the inner snap ring, in order to be connected to the radiator fixing screw hole of the nonmetal radiator or the metal radiator.

In the foregoing method for constructing the universal LED bulb, fluorescent powder is spray coated on the LED chip on the optical engine module, and transparent silica gel is covered thereon; or the number of the LED chips is configured according to the proportion of blue and red lights necessary for plants, and only the transparent silica gel is covered on the welded LED chip for package; or, the LED chip on the optical engine module is merely packaged by the transparent silica gel, and then, an inner cover coated with fluorescent powder on the inner side is provided outside the packaged optical engine module; or no silica gel is covered on the LED chip on the optical engine module, a concave inner cover filled with transparent insulating heat conductive liquid is provided outside the optical engine module, the fluorescent powder is provided in the transparent insulating heat conductive liquid, and the concave inner cover is an elastic inner cover of a thin concave structure.

The fluorescent powder is spray coated on the LED chip on the optical engine module, and the transparent silica gel is covered thereon; or the number of the LED chips on the optical engine module is configured according to the proportion of blue and red lights necessary for plants, and only the transparent silica gel is covered on the welded LED chip; or, the LED chip on the optical engine module may also be packaged by the traditional package solution, namely, the fluorescent powder is spray coated on the LED chip and the transparent silica gel is covered thereon, while no inner cover is used; when the present invention is applied to agricultural production lighting, the number of the LED chips on the optical engine module is configured according to the proportion of blue and red lights necessary for plants, and only the transparent silica gel is covered on the welded LED chip.

In the foregoing method for constructing the universal LED bulb, the LED chip on the optical engine module is packaged by transparent silica gel, then the inner cover coated with fluorescent powder on the inner side is provided outside the packaged optical engine module, this structure ensures the fluorescent powder has better uniformity of compared with that being directly sprayed on the chip, the fluorescent powder is away from the LED heating chip, the LED chip may operate at a relatively higher temperature, thereby perfecting the LED operation condition, effectively reducing the luminous decay of the LED bulb and ensuring a better LED light emission effect, and the dosage of the fluorescent powder is not increased to a larger extent; or no silica gel is covered on the LED chip on the optical engine module, the concave inner cover filled with transparent insulating heat conductive liquid is provided outside the optical engine module, the fluorescent powder is provided in the transparent insulating heat conductive liquid, and the concave inner cover is an elastic inner cover of a thin concave structure, in this structure, when the LED is electrified to generate heat, the transparent insulating heat conductive liquid is heated to flow to take away the heat of the LED chip, in order to exchange the heat with the radiator on a larger area, thus avoiding local high heat of the LED chip and the surrounding fluorescent powder in the traditional solution and effectively reducing the generation of LED luminous decay, and when the transparent insulating heat conductive liquid is heated to expand, the concave inner cover protrudes outwards to increase the volume for receiving the expanded liquid, in order to prevent expanding of the liquid from resulting in ineffective seal of the inner cover.

In the foregoing method for constructing the universal LED bulb, a connector plug fixing hole is provided on the heat conductive bracket, a connector plug with a contact pin is inserted into the connector plug fixing hole and is fixed with the part inserted into the bulb as a fixed end, the tail end of the contact pin is welded with the optical engine die plate in the universal LED bulb, to form a simple electric interface on the outer surface of the universal LED bulb, during installation, as long as the connector plug is in butt joint with a connector socket with a cable, and the universal LED bulb is fixed, the electric connection of the universal LED bulb is achieved; the eccentric position of the hole of the connector plug on the heat conductive bracket and the size of the fixed end of the connector plug are defined, such that the optical engine die plate in the LED bulb may meet the demands of arranging the LED chip and the driving power supply chip and registering them; the connector plug with the contact pin is of a four-pin structure, wherein two pins are used for power supply access, and the other two pins are used for control access; the fixed end is in a nut fixing manner or a fusion ring fixing manner; when the fixed end is in the nut fixing manner, a waterproof rubber ring is added between the connector plug and the heat conductive bracket to prevent water; in order to prevent rotation, an antiskid groove is provided to the connector plug, and a corresponding projection is provided at the through hole of the heat conductive bracket; a three-hole flange is provided to the connector socket and is fixed to the lamp radiator through a fixing screw, and an adjusting rubber pad is provided between the connector socket and the radiator to adjust the thickness, in order to ensure the tightness of a waterproof surface; or external threads are provided to the connector plug to match with the internal threads of the fixing nut on the connector socket provided with the waterproof rubber ring to prevent water; a slot is provided to the connector socket, and the waterproof rubber ring is provided in the slot to prevent water.

A flange snap ring type LED bulb constructed by the foregoing method, including a thin-shelled lens snap ring, wherein at least a heat conductive bracket with a flange hole, an optical engine module, an inner snap ring and a light distribution optical lens are provided in the lens snap ring sequentially; a connector plug is fixed to the heat conductive bracket, and an inner cover is further provided outside the optical engine module; an installation flange hole is provided to the heat conductive bracket, the thin-shelled lens snap ring corresponds to the installation flange hole of the heat conductive bracket to surround and protect the heat conductive bracket, the optical engine module is made up of an optical engine die plate, an LED chipset and a relevant wiring by bonding and packaging, or is further integrated with a power supply drive chip.

In the foregoing flange snap ring type LED bulb, the inner snap ring surrounds the optical engine module, or an inner ring cover is further provided between the inner snap ring and the inner cover, the upper part of the inner snap ring is connected to the heat conductive bracket, the lower part of the inner snap ring is adhered with the light distribution optical lens, a sealed waterproof space for packaging the optical engine module is formed by the three components, or the inner snap ring is further used as the installation base of an LED bulb radiator; when the lens snap ring is installed, it may be ensured the upper surface of the heat conductive bracket closely leans against the radiator; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing flange snap ring type LED bulb, for a small-specification LED bulb, the heat conductive bracket, the optical engine module, the inner snap ring and the light distribution optical lens are sequentially overlapped and adhered, or the inner ring cover is further provided between the inner snap ring and the inner cover, and the optical engine die plate of the optical engine module, the inner snap ring and the light distribution optical lens form a sealed waterproof space used for packaging components packaged on the optical engine die plate; or, the inner snap ring and the inner cover are processed to an inner cover with a function of the inner ring and having an integral structure; or the inner snap ring is further used as the installation base of the LED bulb radiator; when the lens snap ring is installed, it may be ensured the upper surface of the heat conductive bracket closely leans against the radiator; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing flange snap ring type LED bulb, a radiator is provided to the heat conductive bracket; the radiator is a nonmetal radiator assembly, the nonmetal radiator assembly includes a nonmetal radiator and an overhead heat conductive converting bracket at the lower side thereof, a rubber sheath or screw fixing glue is filled in the radiator fixing screw hole of the nonmetal radiator for connecting a fixing screw, and a radiator outer cover is provided outside the nonmetal radiator; or the radiator is a metal radiator, a heat conductive pad is provided between the metal radiator and the heat conductive bracket, the metal radiator includes a cooling fin, a superconducting fluid cavity is provided at the middle of the cooling fin, a foam metal is filled in the superconducting fluid cavity and superconducting fluid is filled therein, an upper stopper and a lower stopper are provided at the two ends of the superconducting fluid cavity, and a vacuum suction pipe is provided to the upper stopper or the lower stopper; a cable hole used for penetration of a cable and a radiator fixing screw hole are further provided to the radiator.

Only transparent silica gel for package is provided outside the LED chip on the optical engine module, an inner cover is provided outside the optical engine module with the transparent silica gel, and fluorescent powder coating is provided to the inner layer of the inner cover; or, no silica gel is packaged on the LED chip on the optical engine module, a concave inner cover filled with transparent insulating heat conductive liquid is provided outside the optical engine module, the LED chip on the optical engine module is soaked in the transparent insulating heat conductive liquid, fluorescent powder is provided in the transparent insulating heat conductive liquid, and the concave inner cover is an elastic inner cover of a thin concave structure.

In the foregoing flange snap ring type LED bulb, an electric connector is provided to the heat conductive bracket, the electric connector includes a connector plug, a contact pin is provided to the connector plug, and a contact pin welding spot at the tail segment of the contact pin is welded with the optical engine module; after penetrating through a fixing hole of the connector plug on the universal LED bulb, the connector plug is provided with a fixed end for fixing; the connector plug is cooperatively connected to a connector socket with a jack, and the connector socket is connected to a cable; the contact pin of the electric connector is of a four-pin structure, wherein two pins are used for power supply access, and the other two pins are used for control access.

In the foregoing flange snap ring type LED bulb, the fixed end is a fusion ring; or the fixed end is a fixing nut, a waterproof rubber ring slot is further provided to the connector plug, and a waterproof rubber ring is provided in the waterproof rubber ring slot; in order to prevent rotation, an antiskid groove is provided to the connector plug, and a corresponding projection is provided at the through hole of the heat conductive bracket; a three-hole flange is provided to the connector socket, and the connector socket is fixed with the radiator or a heat conductive converting plate on the lamp through the three-hole flange and a fixing screw of the connector socket, and a fixed adjusting rubber pad is provided between the flange and the radiator or the heat conductive converting plate on the lamp to ensure the tightness of a waterproof surface; or the connector plug is provided with external threads to match with the internal threads of the fixing nut on the connector socket provided with the waterproof rubber ring so as to be fixed to the connector plug; a slot is provided to the connector socket, and the waterproof rubber ring is provided in the slot.

On another aspect, the present invention further provides a variety of lamps using the foregoing LED bulb. The lamp provided by the present invention is simple in structure, low in manufacturing cost, quick, cheap and convenient to install, use and maintain and is unlikely to expand failure, achieves independent production and use of the bulb, lamp and the lighting control product of the LED bulb, greatly reduces the production procedures, achieves mass production and facilitates the application and the industrial scale of the LED energy-saving lighting products.

An LED street lamp using a multifunctional lamp housing as an installation interface bracket structure, including the multifunctional lamp housing punch formed by sheet metal by a stamping process, wherein the multifunctional lamp housing is fixed to a lamp post through a lamp post fixing element; one or more installation interface holes used for installing extrusion type radiators are provided to the multifunctional lamp housing; an installation interface used for installing an LED bulb is provided to each extrusion type radiator, the LED bulb is provided to the installation interface, and the LED bulb and the installation interface are provided in a one-to-one correspondence manner.

In the foregoing LED street lamp using the multifunctional lamp housing as the installation interface bracket structure, a wire harness connector is provided to the multifunctional lamp housing, and the wire harness connector is used for connecting a plurality of LED bulbs to a power supply and a control circuit; an edgefold for reinforcing the structural strength is further provided at the edge of the multifunctional lamp housing.

In the foregoing LED street lamp using the multifunctional lamp housing as the installation interface bracket structure, the lamp post fixing element includes a lamp post fixing bracket, a lamp post fixing bracket bolt and a reinforcing plate, wherein the lamp post fixing bracket and the reinforcing plate are provided at the upper and lower sides of the multifunctional lamp housing respectively; the multifunctional lamp housing is fixed to the lamp post through the lamp post fixing bracket and the reinforcing plate.

In the foregoing LED street lamp using the multifunctional lamp housing as the installation interface bracket structure, the extrusion type radiator includes a substrate, and a fin is provided at one side of the substrate; an installation interface used for installing the LED bulb is provided at the other side of the substrate; the installation interface includes a surface in contact with the LED bulb and a hole connected to the LED bulb on the extrusion type radiator.

In the foregoing LED street lamp using the multifunctional lamp housing as the installation interface bracket structure, 6 flange fixing holes on the installation interface of the extrusion type radiator are uniformly distributed at a diameter D1, and the diameter D1 is a value obtained by subtracting a diameter of a fixing screw cap and then subtracting a margin of 0.8-4 mm from the outer diameter D of the LED bulb.

An LED street lamp using a double-faced radiator structure, including a double-faced radiator extrusion formed by a metal, wherein an installation interface is provided to the double-faced radiator, and an LED bulb is provided to the installation interface; a lamp housing extrusion formed by a metal or die cast by plastics is provided outside the double-faced radiator; the LED street lamp using the double-faced radiator structure further includes a wire harness connector, and the wire harness connector is used for connecting a plurality of LED bulbs to a power supply and a control circuit.

In the foregoing LED street lamp using the double-faced radiator structure, the double-faced radiator includes a substrate, fins are provided at the two sides of the substrate, and a cable hole is provided to the substrate; the installation interface used for installing the LED bulb is provided at one side of the substrate, and circular or elliptic conical spaces are formed by cutting the fins around the installation interface of the substrate according to the illumination angle of the light emitted by the bulb to the extent of not shading the light emitted by the LED bulb; a conducting wire bracket is provided at the other side of the substrate, and the conducting wire bracket is used for connecting a conducting wire led out from the LED bulb to a power supply; the installation interface includes a surface in contact with the LED bulb and a hole connected to the LED bulb, on the double-faced radiator.

In the foregoing LED street lamp using the double-faced radiator structure, one side of the substrate of the double-faced radiator is connected to an L-shaped connecting plate, and the L-shaped connecting plate is connected to the lamp post; the wire harness connector is provided to the double-faced radiator.

In the foregoing LED street lamp using the double-faced radiator structure, a bracket installation hole is provided to the substrate or the center of the double-faced radiator, and the double-faced radiator is fixed to the lamp post by a street lamp installation fixing bolt by means of the bracket installation hole and a lamp post fixing ring; the wire harness connector is provided in the lamp post connected to the double-faced radiator.

In the foregoing LED street lamp using the double-faced radiator structure, 6 flange fixing holes on the installation interface are uniformly distributed at a diameter D1, and the diameter D1 is a value obtained by subtracting a diameter of a fixing screw cap and then subtracting a margin of 0.8-4 mm from the outer diameter D of the LED bulb.

An LED street lamp using a lamp housing as an installation interface bracket structure includes the lamp housing punch formed by sheet metal via a stamping process, an installation interface is provided to the lamp housing, an LED bulb is provided to the installation interface, the lamp housing is fixed to a lamp post by a lamp post fixing element, and a decorative cover is provided to the lamp housing.

The foregoing LED street lamp using the lamp housing as the installation interface bracket structure further includes a wire harness connector, wherein the wire harness connector is provided to the decorative cover, and the wire harness connector is used for connecting a plurality of LED bulbs to a power supply and a control circuit.

In the foregoing LED street lamp using the lamp housing as the installation interface bracket structure, the lamp housing is elliptic, edgefolds for reinforcing the structural strength are provided at the inner and outer edges of the lamp housing, and the installation interface includes a surface in contact with the LED bulb and a hole connected to the LED bulb, on the lamp housing.

In the foregoing LED street lamp using the lamp housing as the installation interface bracket structure, the lamp post fixing element includes a lamp post fixing bracket, a lamp post fixing bracket bolt and a reinforcing plate, wherein the lamp post fixing bracket and the reinforcing plate are provided at the upper and lower sides of the lamp housing, and the lamp housing is fixed to the lamp post through the lamp post fixing bracket and the reinforcing plate.

In the foregoing LED street lamp using the lamp housing as the installation interface bracket structure, a radiator interface opening and 6 flange fixing holes are provided to the installation interface of the lamp housing, the flange fixing holes are used for fixing the LED bulb, and the radiator interface opening is used for enabling the LED bulb to penetrate through the installation interface; the flange fixing holes are uniformly distributed at a diameter DE and the diameter D1 is a value obtained by subtracting a diameter of a fixing screw cap and then subtracting a margin of 0.8-4 mm from the outer diameter D of the LED bulb; the diameter D2 of the radiator interface opening on the installation interface is a value obtained by subtracting two times of a diameter of a fixing screw cap and then subtracting two times of the margin corresponding to the diameter D1 from the outer diameter D of the bulb.

An LED street lamp using a lamp housing with a radiator as an installation interface bracket structure, including the lamp housing with the radiator and formed by a metal in a die casting process, wherein one or more installation interfaces are provided to the lamp housing with the radiator, an LED bulb is provided to the installation interface, the lamp housing with the radiator is connected to a lamp post through a lamp post fixing bracket, a wire harness connector is provided at the upper part of the lamp post fixing bracket, and the wire harness connector is used for connecting a plurality of LED bulbs to a power supply and a control circuit.

In the foregoing LED street lamp using the lamp housing with the radiator as the installation interface bracket structure, a substrate is provided at the central part of the lamp housing with the radiator, fins are provided at one side of the substrate, overflow gaps exist between the fins, and the overflow gaps enable the air to fully contact the fins to reinforce the radiating effect; the installation interface used for installing the LED bulb is provided at the other side of the substrate; the installation interface includes a surface in contact with the LED bulb and a hole connected to the LED bulb, on the lamp housing with the radiator.

The foregoing LED street lamp using the lamp housing with the radiator as the installation interface bracket structure further includes an outer cover, a waterproof rubber ring and a waterproof sealing gland; the outer cover is provided at the lower part of the lamp housing with the radiator, the outer cover is provided outside the installation interface, and the waterproof sealing gland is pressed at the outside of the outer cover surrounded by the waterproof rubber ring, in order to improve the water resistance of the outer cover.

In the foregoing LED street lamp using the lamp housing with the radiator as the installation interface bracket structure, 6 flange fixing holes on the installation interface of the lamp housing with the radiator are uniformly distributed at a diameter D1, and the diameter D1 is a value obtained by subtracting a diameter of a fixing screw cap and then subtracting a margin of 0.8-4 mm from the outer diameter D of the LED bulb.

An installation interface bracket combined member is included, wherein an LED bulb provided with a radiator is provided to the installation interface bracket combined member; a lamp housing punch formed by a metal or die cast by plastics is provided outside the installation interface bracket combined member; the installation interface bracket combined member includes a pipe bracket formed by segmenting a standard pipe, a lamp fixing flange and a lamp housing and bulb fixing bracket which are connected, an installation interface used for installing the LED bulb is provided to the lamp housing and bulb fixing bracket, and the pipe bracket is connected to the lamp fixing flange and the lamp housing and bulb fixing bracket; the lamp fixing flange is a flat panel flange or an arched flange; the lamp housing is connected to the installation interface bracket combined member through the lamp housing and bulb fixing bracket.

In the foregoing LED lighting lamp using the installation interface bracket combined member, the installation interface includes a surface in contact with the LED bulb and a hole connected to the LED bulb, on the lamp housing and bulb fixing bracket; the lamp housing and bulb fixing bracket is punch formed by a metal, the pipe bracket is connected to the center of the lamp housing and bulb fixing bracket, the lamp housing and bulb fixing bracket is engraved to be hollow around its portion connected to the pipe bracket, so that passage of a cable and formation of a chimney effect in the lamp housing are facilitated so as to ensure the ventilating and radiating effects, and a screw hole used for installing the lamp housing is provided at the edge of the lamp housing and bulb fixing bracket.

In the foregoing LED lighting lamp using the installation interface bracket combined member, 6 flange fixing holes uniformly distributed at a diameter D1 are provided to the installation interface, and the diameter D1 is a value obtained by subtracting a diameter of a fixing screw cap and then subtracting a margin of 0.8-4 mm from the outer diameter D of the LED bulb.

An LED tunnel lamp using a lamp housing as an installation interface bracket structure, including the lamp housing formed by a metal stamping or plastics die casting process, wherein one or more installation interface used for installing an LED bulb provided with a radiator is provided to the lamp housing; the lamp housing includes an installation interface bracket plate used for installing the LED bulb, and the installation interface used for installing the LED bulb is provided to the installation interface bracket plate; a foot screw hole used for fixedly installing the entire LED tunnel lamp is provided to the lamp housing.

In the foregoing LED tunnel lamp using the lamp housing as the installation interface bracket structure, a protection plate is further provided to the lamp housing; the installation interface includes a surface in contact with the LED bulb and a hole connected to the LED bulb, on the lamp housing.

In the foregoing LED tunnel lamp using the lamp housing as the installation interface bracket structure, a radiator opening and 6 flange fixing holes are provided to the installation interface of the lamp housing, the flange fixing holes are used for fixing the LED bulb, and the radiator opening is used for enabling the LED bulb to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb; the diameter D2 of the radiator interface opening on the installation interface is a value obtained by subtracting two times of a diameter of a fixing screw cap and then subtracting two times of the margin corresponding to the diameter D1 from the outer diameter D of the bulb.

An LED screw lamp, including a screw lamp, wherein an installation interface is provided to a radiator on the screw lamp or a heat conductive converting plate connected to the top of the radiator for fixedly installing an LED bulb, and the lampshade of the screw lamp is connected to the radiator or the heat conductive converting plate in an adhesion, threaded connection or clamping manner. The installation interface includes a surface in contact with the LED bulb and a hole connected to the LED bulb, of the radiator or the heat conductive converting plate. The installation interface includes a surface in contact with the LED bulb and a hole connected to the LED bulb, of the radiator or the heat conductive converting plate.

In the foregoing LED screw lamp, the screw lamp includes a screw lamp cap, an intermediate connecting element, the radiator, the lampshade, or further includes a driving power supply provided in the screw lamp cap; an electric connector assembly is provided at the joint of the LED bulb and the screw lamp; the intermediate connecting element on the screw lamp cap is connected to the radiator through threads thereon, or through a lamp cap fixing screw or in a direct adhesion manner, or the heat conductive converting plate is further provided to the radiator.

In the foregoing LED screw lamp, the electric connector assembly includes a connector socket, a fixing screw and an adjusting rubber pad; the connector socket is cooperatively connected to a connector plug on the LED bulb, a three-hole flange is provided to the connector socket, the connector socket is fixed with the radiator or the heat conductive converting plate through the three-hole flange and the fixing screw of the connector socket, and a fixed adjusting rubber pad is further provided between the flange and the radiator or the heat conductive converting plate to ensure the tightness of a waterproof surface; a conducting wire led out from the connector socket is welded on the lamp cap.

In the foregoing LED screw lamp, the radiator is a columnar radiator, the radiator is provided with a radiator substrate thickness inwards from the maximal outer diameter of the cylinder and is provided with fins towards the center of the cylinder in a radial line, 2-3 layers of interrupted grooves are provided on the columnar radiator along a sealed circular arc with the substrate as thickness, after the radiator is heated, external air naturally flows into the center of the radiator through the interrupted grooves to form convection current, so as to achieve a cooling effect.

In the foregoing LED screw lamp, the radiator is a convection radiator, the radiator is provided with a radiator substrate thickness outwards from the cylindrical surface (using the outer diameter of a straightly fixed connector socket as the diameter) at the center and is provided with fins outwards from the substrate in a radial line, and an arc is formed on the surface of each fin upwards to gradually increase the open area; the surface of the each fin is covered with a radiator outer cover, and a plurality of through air flow channels are formed between the outer cover and the fins; after the radiator is heated, the air enters from the flow channel opening at the lower end and flows out from the flow channel opening at the higher end, of the radiator to form a chimney effect, in order to achieve air convection to dissipate heat.

An LED cylindrical lamp using a radiator as an installation interface, including a cylindrical lamp lamp, wherein the cylindrical lamp lamp includes a cylindrical lamp base, the radiator and spring fixing clips, the spring fixing clips are provided at the two sides of the cylindrical lamp base, and the radiator is provided above the cylindrical lamp base; an installation interface is provided at the center of the lower part of the radiator for fixedly installing an LED bulb.

In the foregoing LED cylindrical lamp using the radiator as the installation interface, the cylindrical lamp base is circular, and the installation interface includes a surface in contact with the LED bulb and a hole connected to the LED bulb, on the radiator.

In the foregoing LED cylindrical lamp using the radiator as the installation interface, the cylindrical lamp lamp further includes a lampshade piece and a lampshade piece supporting cover; the lampshade piece is provided beneath the base bracket, and the lampshade piece supporting cover is provided beneath the lampshade piece.

In the foregoing LED cylindrical lamp using the radiator as the installation interface, a vent hole A is provided at the edge of the installation interface of the cylindrical lamp base, and a vent hole B is provided at the vertical side of the cylindrical lamp base; after the radiator is heated, external air may enter from the vent hole B and flow out from the vent hole A to achieve a convection radiating effect.

In the foregoing LED cylindrical lamp using the radiator as the installation interface, the cylindrical lamp lamp further includes an electric connector assembly; the electric connector assembly includes a connector socket, a fixing screw of the connector socket and a fixed adjusting rubber pad; the connector socket is cooperatively connected to a connector plug on the LED bulb, a three-hole flange is provided to the connector socket, the connector socket is fixed with the radiator through the three-hole flange and the fixing screw of the connector socket, and the fixed adjusting rubber pad is further provided between the flange and the radiator to ensure the tightness of a waterproof surface.

In the foregoing LED cylindrical lamp using the radiator as the installation interface, 6 flange fixing holes on the installation interface of the radiator are uniformly distributed at a diameter DE and the diameter D1 is a value obtained by subtracting a diameter of a fixing screw cap and then subtracting a margin of 0.8-4 mm from the outer diameter D of the LED bulb.

Compared with the prior art, in the present invention, the lens snap ring is used as the supporting component of the entire lamp, the inner snap rings in the lens snap ring are used as auxiliary support to finally form the entire structure in which the entire lens snap ring is filled between the optical engine module with inner snap rings adhered to each other and the heat conductive bracket, therefore the structure is very stable. Moreover, the optical engine module in the present invention is sealed in the sealed section defined by the inner snap rings, the heat conductive bracket and the lens, therefore the waterproof performance of the bulb is greatly improved under the condition of not adding other waterproof elements. The flange snap ring type LED bulb in the present invention is used for establishing the lamp in a simple, easy, flexible and variable manner, in this way, the bulb, the lamp and the lighting control product of the LED bulb are independently produced and used, thereby greatly reducing the production procedures of LED lighting products, improving mass production and facilitating the industrialization of LED energy-saving lighting products. Moreover, in the present invention, one connector plug with a contact pin is fixed in the hole on the LED bulb in a trepanning manner, and circuit welding and mechanical fixing are performed in the bulb, thus the peripheral structure of the entire universal LED bulb is simple and smooth, and the LED bulb is provided with no cable externally, when the bulb is installed, the connector plug is aligned to the connector socket on the cable, then the LED bulb is mechanically fixed, and meanwhile, reliable electric connection of the universal LED lamp is achieved. Moreover, in the present invention, the connector plug and the connector socket may be connected to directly achieve a reliable waterproof function without adding additional cost scarcely, thus the universal LED bulb equipped with the electric connector in the present invention may be both used outdoors and indoors and may also be used in explosion proof environments, such that the application range of the LED bulb is greatly expanded.

Figure 1:
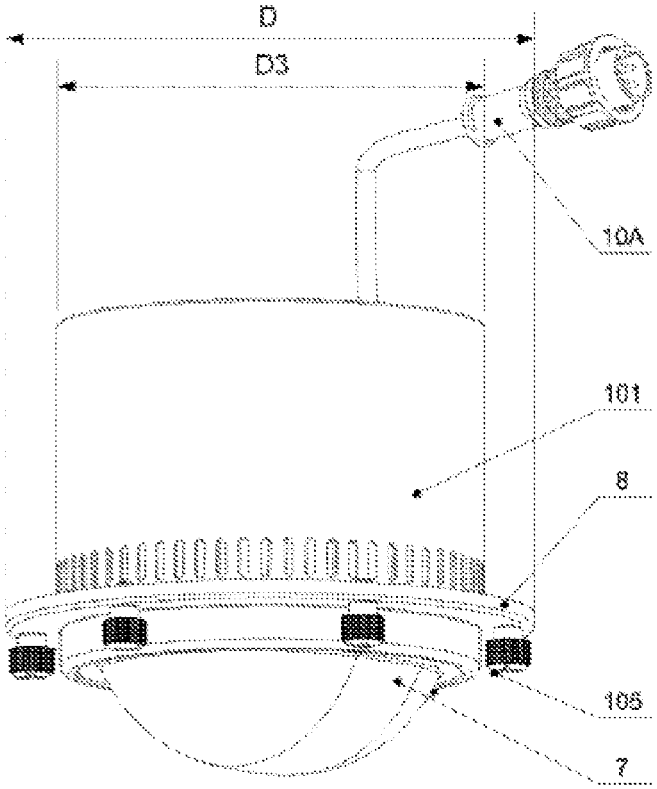
FIG. 1 is an external view of a bulb convex lens solution with a nonmetal radiator in the present invention.

Reference numerals: 1—heat conductive converting bracket, 2—heat conductive pad, 3—heat conductive bracket, 4—optical engine module, 6—inner cover, 7—light distribution optical lens, 8—lens snap ring, 9—bulb outer cover, 10—connector socket, 10A—waterproof joint with a cable, 11—connector plug, 11A—cable fixing head, 12—radiator fixing screw, 14—fixing screw of the lens snap ring, 15—fixed end, 16—waterproof rubber ring, 17—contact pin, 18—slot of the waterproof rubber ring, 19—contact pin welding point, 22—connector plug fixing hole, 23—radiator fixing through hole, 24—fixed adjusting rubber pad, 25—connector socket fixing screw, 26—antiskid groove, 27—heat conductive converting plate, 28—fixing nut, 32—vacuum suction pipe, 33—upper stopper, 34—cooling fin, 35—lower stopper, 36—cable hole, 37—foam metal, 38—radiator fixing screw hole, 39—top-mounted fixing flange, 40—external power supply box, 42—screen mesh, 61—concave inner cover, 62—inner ring cover, 81—inner snap ring, 101—radiator outer cover, 102—LED bulb in the present invention, 103—radiator, 105—bulb fixing screw, and 301—fixing hole of bulb installation flange.

DETAILED DESCRIPTION OF THE EMBODIMENTS

The present invention will be further illustrated below in conjunction with accompanying drawings and embodiments, which are not used as a basis of limiting the present invention.

Embodiments

A method for constructing a universal LED bulb comprises: establishing an optical engine core member of the LED bulb using a heat conductive bracket as the structure supporting main body of the bulb, and supportting the optical engine core member of the LED bulb using a thin-shelled lens snap ring in an auxiliary manner, wherein an installation flange hole is provided to the lens snap ring, correspondingly to a flange through hole of the heat conductive bracket, to surround and protect the heat conductive bracket for installing the bulb; the optical engine core member of the LED bulb is composed of the heat conductive bracket, an optical engine module, an inner snap ring and a light distribution optical lens, wherein an inner cover is provided outside the optical engine module, and an electric connector is provided to the heat conductive bracket; the optical engine module is made up of an optical engine die plate, an LED chipset and a relevant wiring by bonding and packaging, or is further integrated with a power supply drive chip. The diameter of the lens snap ring is a bulb outer diameter D, the bulb outer diameter D and an upper limit of power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve the interchangeability and universality of the LED bulbs; on the relationship curve $W=1.1812e^{0.0361D}$ 20 mm is used as the lower limit of the bulb outer diameter D, 130 mm is used as the upper limit, each 10 mm is set as a segment, the relationship curve is divided into 12 segments to form a limited number of bulb outer diameter specifications, and the interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the bulb outer diameter D; the diameter D2 of a radiator interface opening of the LED bulb on a lamp is a value obtained by subtracting two times of a diameter of a fixing screw cap and then subtracting two times of the margin corresponding to the diameter D1 from the bulb outer diameter D; the installation interface of the LED bulb includes a surface in contact with the LED bulb and a hole connected to the LED bulb on the lamp; the heat conductive bracket is combined and adhered with the optical engine module to form an integral piece, the inner snap ring surrounds the optical engine module, or an inner ring cover is further provided between the inner snap ring and the inner cover; the upper part of the inner snap ring is connected to the heat conductive bracket, the lower part of the inner snap ring is adhered with the light distribution optical lens, for sealing the optical engine module in a sealed waterproof space among the heat conductive bracket, the inner snap ring and the light distribution optical lens, or the inner snap ring is further used as the installation base of an LED bulb radiator; the thicknesses of the light distribution optical lens, the inner snap ring and the heat conductive bracket are adjusted to enable the heat conductive bracket to closely lean against the radiator when the lens snap ring is installed, and the light distribution optical lens is tightly bonded to the lens snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

For a small-specification LED bulb, the optical engine module, the inner snap ring and the light distribution optical lens are sequentially overlapped and adhered on the heat conductive bracket, the inner cover is provided outside the optical engine module, or the inner ring cover is further provided between the inner snap ring and the inner cover, and components packaged on the optical engine die plate in the optical engine module are packaged in the sealed waterproof space among the optical engine die plate, the inner snap ring and the light distribution optical lens; or, the inner cover and the inner snap ring are of an integral structure (namely, an inner cover with a function of the inner snap ring), the components packaged on the optical engine die plate are packaged in the waterproof space between the optical engine die plate and the integral structure formed by the inner cover and the inner snap ring; or the inner snap ring is further used as the installation base of the LED bulb radiator; the thicknesses of the light distribution optical lens, the inner snap ring and the heat conductive bracket are adjusted to enable the heat conductive bracket to closely lean against the radiator when the lens snap ring is installed, and the light distribution optical lens is tightly bonded to the lens snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded thereon by silver paste printed circuit technology.

A radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive converting bracket, the nonmetal radiator and the heat conductive converting bracket are obtained by extrusion forming an ultrafine nonmetal heat conductive material (such as alumina, silicon carbide or the like) at a low temperature and sintering the same at a high temperature, the contact surfaces thereof are adhered into an integral piece by coating a heat conductive adhesive, a rubber sheath or screw fixing glue is filled in the fixing screw hole of the nonmetal radiator for connecting a fixing screw, a radiator outer cover, which may be made of a metal material by stamping or from plastics by die casting to beautify the appearance of the bulb, is provided outside the nonmetal radiator, the heat conductive converting bracket is overhead, the nonmetal radiator takes the shape of a screen mesh, and the nonmetal radiator is kept overhead by the heat conductive converting bracket, for enabling the air to enter the screen mesh of the nonmetal radiator from the heat conductive converting bracket; or the radiator is a metal radiator, the heat conductive pad is provided between the metal radiator and the heat conductive bracket, the metal radiator is of a hollow structure, a foam metal is filled in the hollow part, superconducting liquid is filled in the hollow structure, upper and lower stoppers are pressed by interference fit or screwed by a threaded seal gum in the hollow structure to form a sealed space, and the sealed space is vacuumized; a radiator fixing screw is penetrated through a fixing through hole on the inner snap ring, in order to be connected to the radiator fixing screw hole of the nonmetal radiator or the metal radiator. Fluorescent powder is spray coated on the LED chip, and transparent silica gel is covered thereon; or the number of the LED chips is configured according to the proportion of blue and red lights necessary for plants, and only the transparent silica gel is covered on the welded LED chip for package; or, the LED chip is merely packaged by the transparent silica gel, and then, an inner cover coated with fluorescent powder on the inner side is provided outside the packaged LED chip; or no silica gel is covered on the LED chip, a concave inner cover filled with transparent insulating heat conductive liquid is provided outside the LED chip, fluorescent powder is provided in the transparent insulating heat conductive liquid, and the concave inner cover is an elastic inner cover of a thin concave structure. A through hole is provided on the heat conductive bracket, a connector plug with a contact pin is inserted into the through hole and is fixed with the part inserted into the bulb as a fixed end, the tail end of the contact pin is welded with the optical engine die plate in the universal LED bulb, to form a simple electric interface on the outer surface of the universal LED bulb, during installation, as long as the connector plug is in butt joint with a connector socket with a cable, and the universal LED bulb is fixed, the electric connection of the universal LED bulb is achieved; the eccentric position of the hole of the connector plug on the heat conductive bracket and the size of the fixed end of the connector plug are defined, such that the optical engine die plate in the LED bulb may meet the demands of arranging the LED chip and the driving power supply chip and registering them; the connector plug with the contact pin is of a four-pin structure, wherein two pins are used for power supply access, and the other two pins are used for control access; the fixed end is in a nut fixing manner or a fusion ring fixing manner; when the fixed end is in the nut fixing manner, a waterproof rubber ring is added between the connector plug and the heat conductive bracket to prevent water; in order to prevent rotation, an antiskid groove is provided to the connector plug, and a corresponding projection is provided at the through hole of the heat conductive bracket; a three-hole flange is provided to the connector socket and is fixed to a lamp radiator through a fixing screw, an adjusting rubber pad is provided between the connector socket and the radiator to adjust the thickness, in order to ensure the tightness of a waterproof surface; or external threads are provided to the connector plug to match with the internal threads of the fixing nut on the connector socket provided with the waterproof rubber ring to prevent water; a slot is provided to the connector socket, and the waterproof rubber ring is provided in the slot to prevent water.

Figure 6:
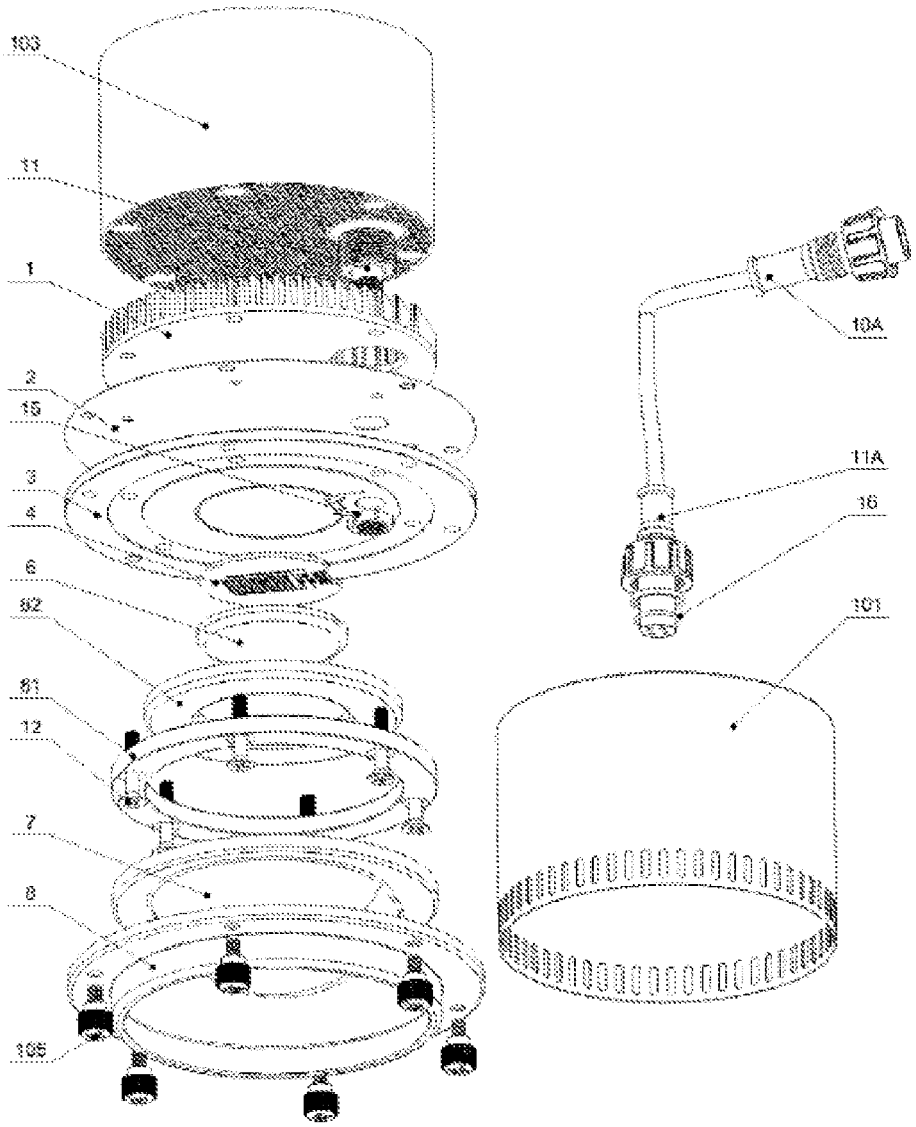
FIG. 6 is an exploded view of a structure in the present invention.
Figure 7:
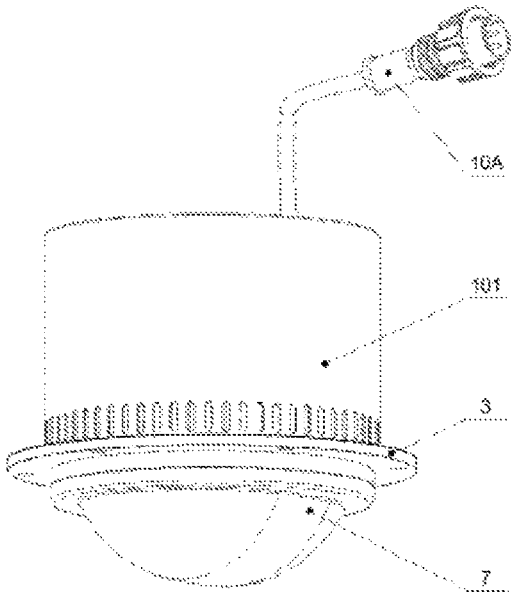
FIG. 7 is a structure diagram of an outline of core members of an LED bulb optical engine in the present invention.
Figure 9:
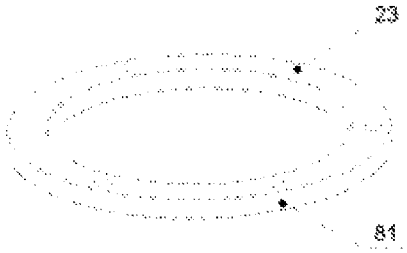
FIG. 9 is an external view of an inner snap ring in an embodiment of the present invention.
Figure 10:
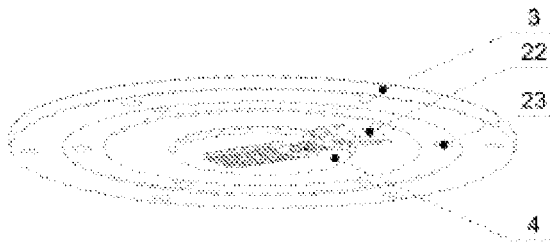
FIG. 10 is an external view of assembly of an optical engine module and a heat conductive bracket in an embodiment of the present invention.
Figure 33:
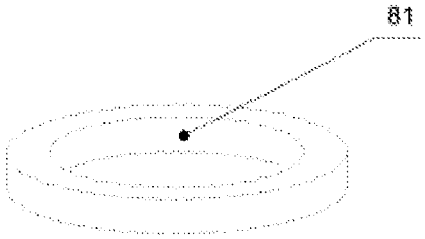
FIG. 33 is a schematic diagram of a structure of an inner snap ring provided with no radiator in the present invention.
Figure 34:
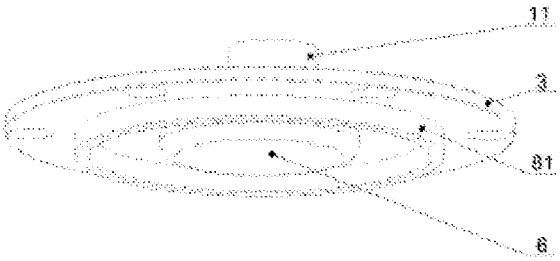
FIG. 34 is a schematic diagram of an installation structure of an inner snap ring provided with no radiator in the present invention.

A flange snap ring type LED bulb constructed according to the above-mentioned method, as shown in FIG. 6 and FIG. 7, including a thin-shelled lens snap ring 8, wherein at least a heat conductive bracket 3 with a flange hole, an optical engine module 4, an inner snap ring 81 (as shown in FIG. 9) and a light distribution optical lens 7 are provided in the lens snap ring 8 sequentially; a connector plug 11 is fixed to the heat conductive bracket 3, and an inner cover 6 is further provided outside the optical engine module 4; an installation flange hole is provided to the heat conductive bracket 3, the thin-shelled lens snap ring 8 corresponds to the installation flange hole of the heat conductive bracket and protects the heat conductive bracket, the optical engine module 4 is composed of an optical engine die plate, an LED chipset and a relevant wiring by bonding and packaging, or a power supply drive chip is further integrated therein. The inner snap ring 81 surrounds the optical engine module 4, the inner cover 6 is provided outside the optical engine module 4, or an inner ring cover 62 is further provided between the inner snap ring 81 and the inner cover 6, the upper part of the inner snap ring 81 is connected to the heat conductive bracket 3, the lower part of the inner snap ring is adhered with the light distribution optical lens 7, a sealed waterproof space for packaging the optical engine module 4 is formed by the three components, or the inner snap ring 81 is further used as the installation base of an LED bulb radiator; under the condition that no radiator is installed, a step on the inner snap ring 81 may be removed, the structure may be as shown in FIG. 33 and the installation manner is as shown in FIG. 34; when the lens snap ring 8 is installed, it may be ensured the upper surface of the heat conductive bracket 3 closely leans against the radiator 103; or, the heat conductive bracket 3 and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

Figure 35:
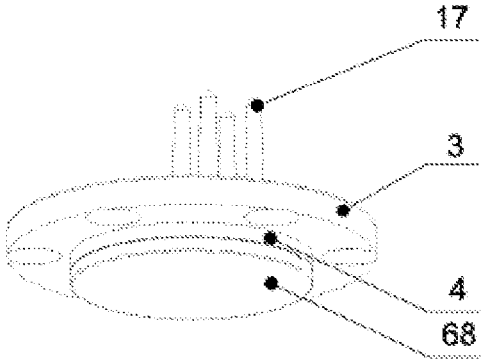
FIG. 35 is a schematic diagram of an installation structure of an inner cover with a function of the inner ring in the present invention.
Figure 36:
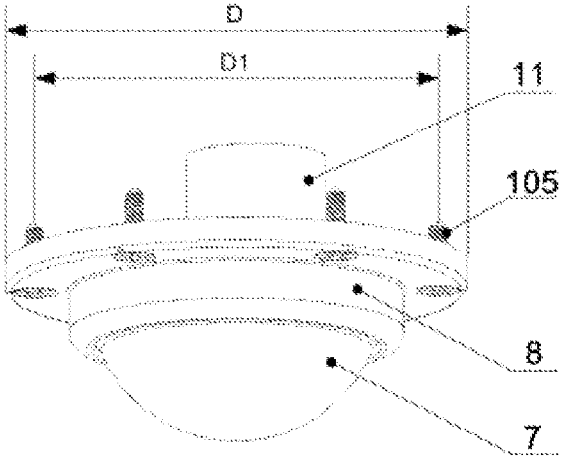
FIG. 36 is an external view of a small-specification bulb convex lens solution in the present invention.

For a small-specification LED bulb, the heat conductive bracket 3, the optical engine module 4, the inner snap ring 81 and the light distribution optical lens 7 are sequentially overlapped and adhered, or the inner ring cover 62 is further provided between the inner snap ring 81 and the inner cover 6, and the optical engine die plate of the optical engine module 4, the inner snap ring 81 and the light distribution optical lens 7 form a sealed waterproof space used for packaging components packaged on the optical engine die plate; or, the inner snap ring 81 and the inner cover 6 are processed to an inner cover 68 with a function of the inner ring and having an integral structure, as shown in FIG. 35; or the inner snap ring 81 is further used as the installation base of the LED bulb radiator; when the lens snap ring 8 is installed, it may be ensured the upper surface of the heat conductive bracket 3 closely leans against the radiator 103.

Figure 8:
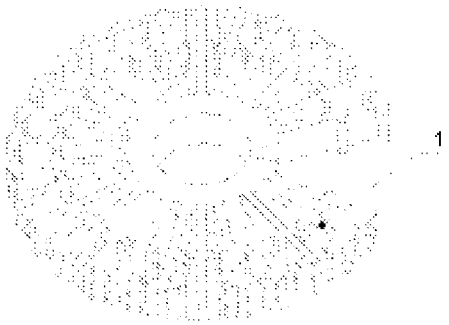
FIG. 8 is an external view of a heat conductive converting bracket in an embodiment of the present invention.
Figure 14:
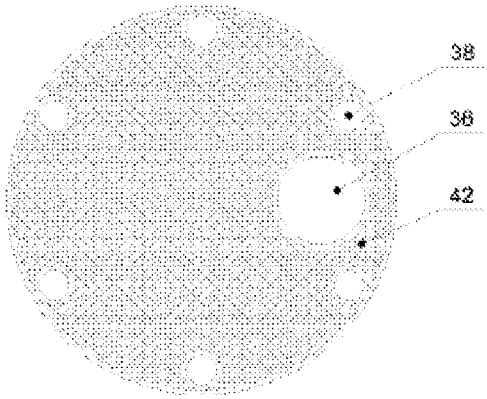
FIG. 14 is a sectional view of a nonmetal radiator in an embodiment of the present invention.
Figure 15:
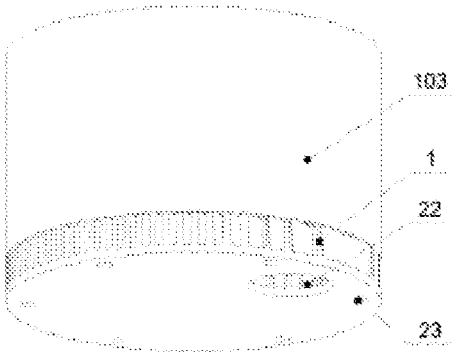
FIG. 15 is an external view of a nonmetal radiator assembly in an embodiment of the present invention.
Figure 16:
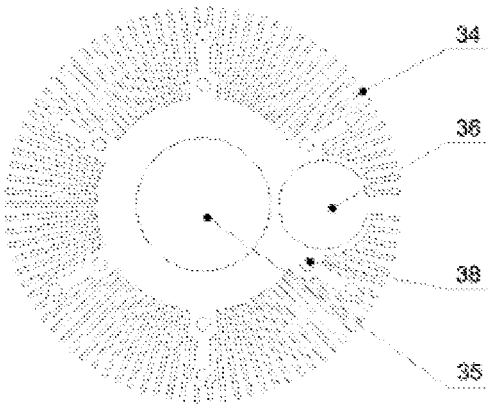
FIG. 16 is a sectional view of a metal radiator in an embodiment of the present invention.
Figure 17:
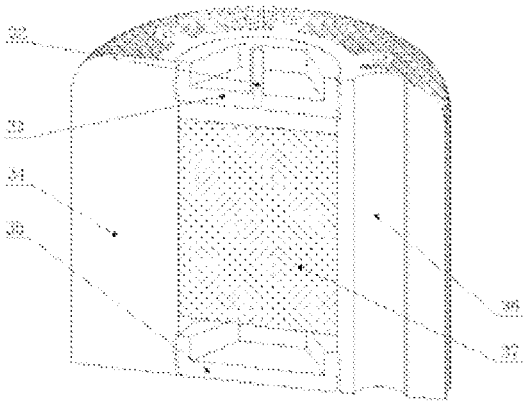
FIG. 17 is a schematic diagram of an internal structure of a metal radiator in an embodiment of the present invention.

The radiator 103 is provided to the heat conductive bracket 3, and a heat conductive pad 2 is provided between the radiator 103 and the heat conductive bracket 3; the radiator 103 is a nonmetal radiator assembly, the nonmetal radiator assembly includes a screen mesh-shaped nonmetal radiator (as shown in FIG. 15, a screen mesh 42 may be seen from the section, and other structures capable of realizing ventilation may also be adopted, as shown in FIG. 8) and an overhead heat conductive converting bracket 1 at the lower side thereof, a rubber sheath or screw fixing glue is filled in the radiator fixing screw hole 33 of the nonmetal radiator for connecting a fixing screw, a radiator outer cover 101 is provided outside the nonmetal radiator, and the section of the nonmetal radiator is as shown in FIG. 14. Or, the radiator 103 may also be a metal radiator, the heat conductive pad 2 is provided between the metal radiator and the heat conductive bracket 3, the metal radiator includes a cooling fin 34, as shown in FIG. 16 and FIG. 17, a superconducting fluid cavity is provided at the middle of the cooling fin 34, a foam metal 37 is filled in the superconducting fluid cavity and superconducting fluid is filled therein, an upper stopper 33 and a lower stopper 35 are provided at the two ends of the superconducting fluid cavity, and a vacuum suction pipe 32 is provided to the upper stopper 33 or the lower stopper 35; a cable hole 36 used for penetration of a cable and a radiator fixing screw hole 38 are further provided to the radiator 103. A radiator fixing screw 12 is internally penetrated through the inner snap ring 81 and the radiator fixing through hole 22 on the radiator 103 to fix the radiator 103 on the inner snap ring 81.

Figure 11:
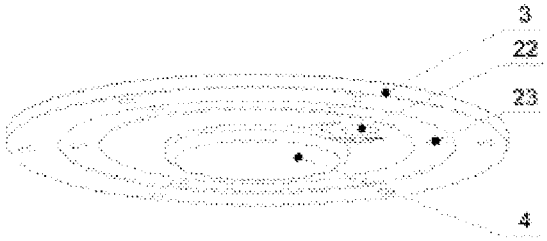
FIG. 11 is an external view of an optical engine module assembly provided with a flat inner cover in an embodiment of the present invention.
Figure 13:
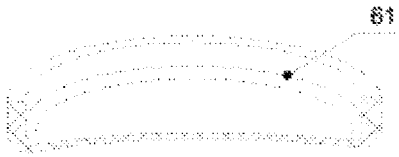
FIG. 13 is a cutaway view of a concave inner cover in an embodiment of the present invention.

Transparent silica gel for package is provided outside the LED chip on the optical engine module 4, an inner cover 6 is provided outside the optical engine module 4 with the transparent silica gel, and fluorescent powder coating is provided to the inner layer of the inner cover 6, as shown in FIG. 11; or no silica gel is packaged on the LED chip on the optical engine module 4, a concave inner cover 61 filled with transparent insulating heat conductive liquid is provided outside the optical engine module 4, the LED chip is soaked in the transparent insulating heat conductive liquid, fluorescent powder is provided in the transparent insulating heat conductive liquid, and the concave inner cover is an elastic inner cover the section of which is of a thin concave structure as shown in FIG. 11, as shown in FIG. 13. The optical engine module 4 is composed of an optical engine die plate, an LED chip and a relevant wiring by bonding and packaging, or a power supply drive chip is further integrated on the optical engine die plate.

Figure 12:
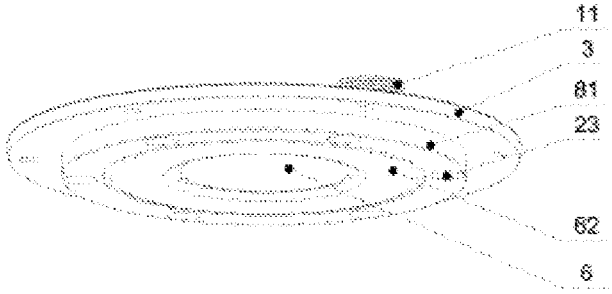
FIG. 12 is an external view of assembly of a heat conductive bracket and an electric connector with an inner snap ring and an optical engine module assembly in an embodiment of the present invention.
Figure 18:
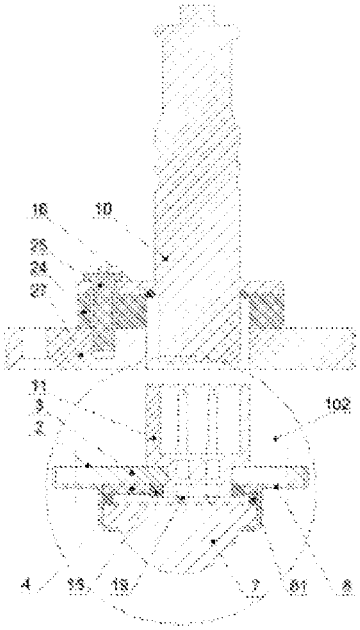
FIG. 18 is a schematic diagram of assembly of a structure of a small aperture bulb and an electric connector in an embodiment of the present invention.
Figure 19:
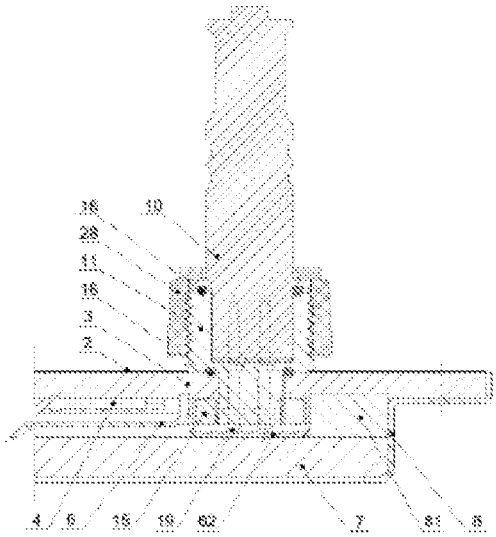
FIG. 19 is a schematic diagram of assembly of a structure of a large aperture bulb and an electric connector in an embodiment of the present invention.
Figure 20:
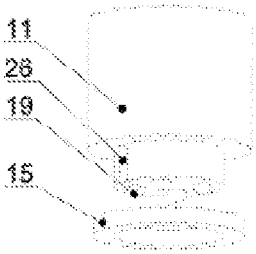
FIG. 20 is a schematic diagram of a structure of a connector plug at a fusion ring fixed end in the present invention.
Figure 21:
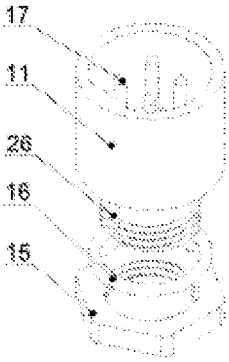
FIG. 21 is a first schematic diagram of a structure of a connector plug at a nut fixed end in the present invention.
Figure 22:
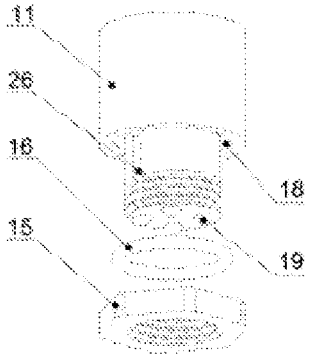
FIG. 22 is a second schematic diagram of a structure of a connector plug at a nut fixed end in the present invention.
Figure 23:
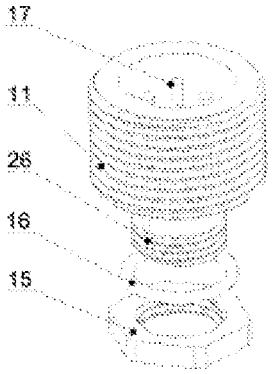
FIG. 23 is a schematic diagram of a structure of a connector plug with external threads in the present invention.
Figure 24:
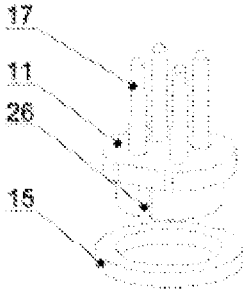
FIG. 24 is a schematic diagram of a structure of a pin type connector plug at a fusion ring fixed end in the present invention.
Figure 25:
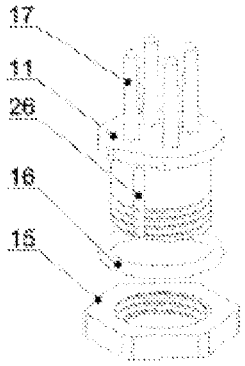
FIG. 25 is a schematic diagram of a structure of a pin type connector plug at a nut fixed end in the present invention.
Figure 26:
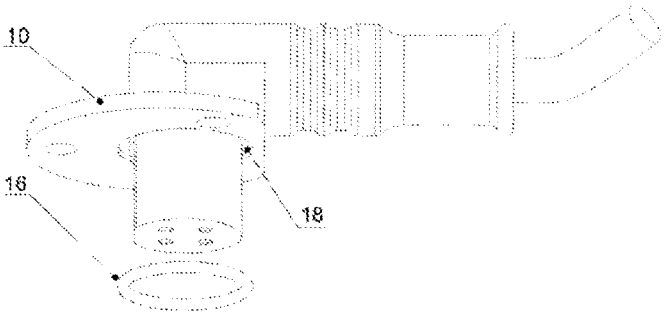
FIG. 26 is a schematic diagram of a structure of a connector socket fixedly connected in a bent shape in the present invention.
Figure 27:
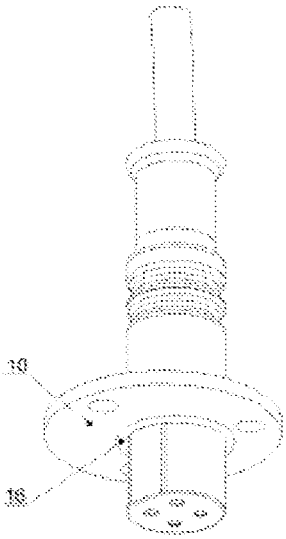
FIG. 27 is a schematic diagram of a structure of a connector socket fixedly connected in a straight shape in the present invention.
Figure 28:
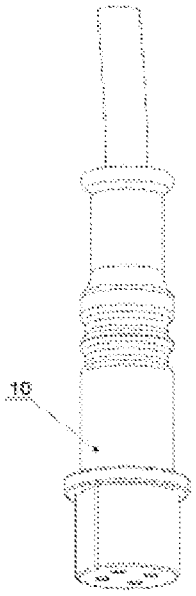
FIG. 28 is a schematic diagram of a structure of a straight-form connector socket non-fixedly connected in the present invention.

An electric connector is provided to the heat conductive bracket 3, the electric connector includes a connector plug 11, a contact pin 17 is provided to the connector plug 11, and a contact pin welding spot 19 at the tail segment of the contact pin 17 is welded with the optical engine module 4; after penetrating through a fixing hole 22 of the connector plug on the universal LED bulb, the connector plug 11 is fixed with a fixed end 15; the connector plug 11 is cooperatively connected to a connector socket 10 with a jack, and the connector socket 10 is connected to a cable; the contact pin of the electric connector is of a four-pin structure, wherein two pins are used for power supply access, and the other two pins are used for control access. The fixed end 15 is a fusion ring, as shown in FIG. 20 and FIG. 24, wherein the connector plug 11 in FIG. 24 is provided with no protecting jacket; or the fixed end 15 is a fixing nut, a waterproof rubber ring slot 18 is further provided to the connector plug 11, and a waterproof rubber ring 16 is provided in the waterproof rubber ring slot 18, as shown in FIG. 21, FIG. 22, FIG. 23 and FIG. 25, wherein the connector plug 11 in FIG. 25 is provided with no protecting jacket; in order to prevent rotation, an antiskid groove 26 is provided to the connector plug 11, and a corresponding projection is provided at the through hole of the heat conductive bracket 3; the connector socket 10 is provided to a cable fixing head 11A at the other end of the cable in a waterproof joint 10A with the cable. A three-hole flange (as shown in FIG. 26 and FIG. 27) is provided to the connector socket 10, and the connector socket is fixed with a radiator 103 or a heat conductive converting plate 27 on the lamp through the three-hole flange and a fixing screw 25 of the connector socket, and a fixed adjusting rubber pad 24 is provided between the flange and the radiator 103 or the heat conductive converting plate 27 on the lamp to ensure the tightness of a waterproof surface, as shown in FIG. 18; or the connector plug 11 is provided with external threads to match with the internal threads of the fixing nut 28 on the connector socket 10 provided with the waterproof rubber ring 16, in order to be fixed to the connector plug 11, as shown in FIG. 19; a slot is provided to the connector socket 10, and the waterproof rubber ring 16 is provided in the slot, wherein the connector socket may also be a non-fixed connector socket as shown in FIG. 28. Meanwhile, in order to shade the electric connector fixed end, the power supply element and the like, and to keep beautiful appearance of the bulb, a ring cover 62 is provided between the inner cover 6 and the inner snap ring 81, as shown in FIG. 12. A small aperture bulb (D not larger than 70 mm) may be not provided with the ring cover 62 or the inner cover 6 generally (may include the ring cover 62), and the schematic diagram of assembly of the structure thereof and the electric connector is as shown in FIG. 18; the schematic diagram of assembly of the structure of a large aperture bulb (D larger than 70 mm) and the electric connector is as shown in FIG. 19.

Figure 29:
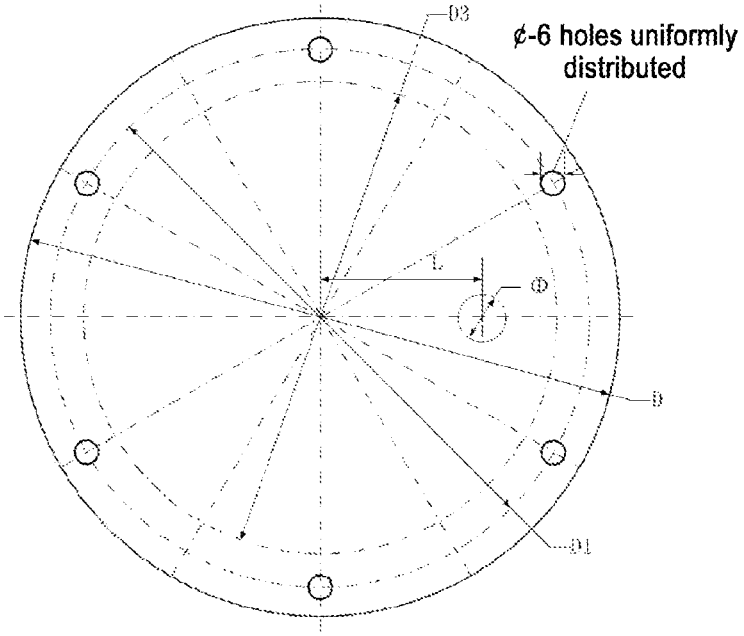
FIG. 29 is a diagram of a size and an opening of a bulb end installation interface in an embodiment of the present invention.
Figure 30:
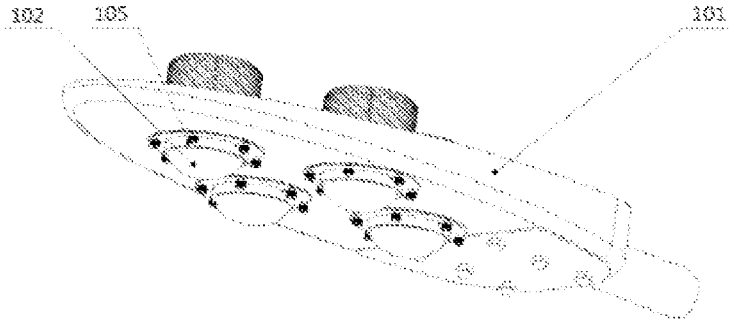
FIG. 30 is an application example of the present invention on a tunnel lamp.
Figure 31:
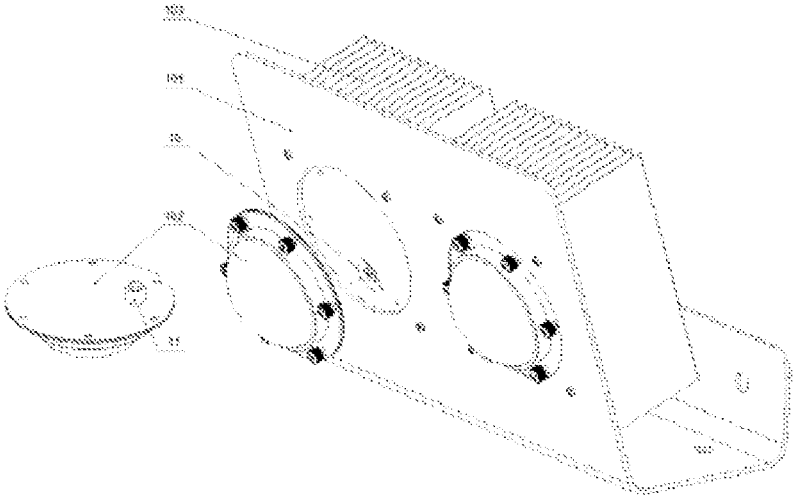
FIG. 31 is an application example of the present invention on a street lamp.
Figure 32:
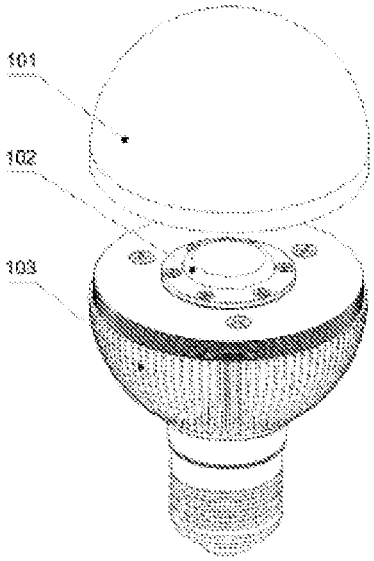
FIG. 32 is an application example of the present invention on a screw lamp.

The bulb outer diameter D and an upper limit of power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve the interchangeability and universality of the LED bulbs. On the relationship curve $W=1.1812e^{0.0361D}$, 20 mm is used as the lower limit of D, 130 mm is used as the upper limit, each 10 mm is set as a segment, the relationship curve is divided into 12 segments to form a limited number of bulb outer diameter specifications, and the interchangeability and universality of the LED bulbs are further improved by the small amount of bulb outer diameter specifications. A screw hole distribution hole D1 for fixing the bulb and the diameter D2 of an interface opening (an opening on the installation interface used for the radiator to penetrate through) of the lamp radiator are influenced by the size of the used screw, and the diameter D1 is a value obtained by subtracting a diameter of a fixing screw cap and then subtracting a margin of 0.8-4 mm from the outer diameter D of the LED bulb; the diameter D2 of the radiator interface opening is a value obtained by subtracting two times of a diameter of a fixing screw cap and then subtracting two times of the margin corresponding to the diameter D1 from the bulb outer diameter D; the value of the wire outlet hole distance L (namely, the eccentric position of the connector plug on the heat conductive bracket) of the bulb is set according to the following table. In FIG. 1, FIG. 2, FIG. 3, FIG. 4, FIG. 5 and FIG. 36, the outer diameter D of the outline size of the bulb, the diameter D1 of the flange screw distribution circle and the outer diameter D3 of the radiator are manufactured according to specified sizes, and the related sizes are set forth in FIG. 29 and the following table.

| Outer diameter D (mm) of bulb | Diameter D 1 (mm) of screw hole distribution circle | Diameter D 2 (mm) of radiator interface opening | Wire outlet hole distance L(mm) | Fixing screw specification ¢ (mm) | Suitable power (W) |
|---|---|---|---|---|---|
| 20 | 16 | 12 | 2 | M1.6 | <2.5 |
| 30 | 25 | 20 | 2 | M1.6 | <3.5 |
| 40 | 35 | 30 | 2 | M1.6 | <5 |
| 50 | 42 | 34 | 2 | M2.5 | <7 |
| 60 | 52 | 44 | 2 | M2.5 | <10 |
| 70 | 62 | 54 | 2 | M2.5 | <14.5 |
| 80 | 70 | 60 | 18 | M3.5 | <21 |
| 90 | 80 | 70 | 18 | M3.5 | <30 |
| 100 | 90 | 80 | 27 | M3.5 | <44 |
| 110 | 100 | 90 | 27 | M3.5 | <64 |
| 120 | 110 | 100 | 33 | M3.5 | <90 |

-continued

| Outer diameter D (mm) of bulb | Diameter D 1 (mm) of screw hole distribution circle | Diameter D 2 (mm) of radiator interface opening | Wire outlet hole distance L(mm) | Fixing screw specification ¢ (mm) | Suitable power (W) |
|---|---|---|---|---|---|
| 130 | 120 | 110 | 33 | M3.5 | <130 |

Note 1:
the outer diameter D3 of the bulb radiator or the outer cover is not larger than D2-1;
note 2:
the diameter Φ of the bulb wire outlet hole is determined according to the size of the bulb connector (interface) plug.

Embodiment 1

Figure 37:
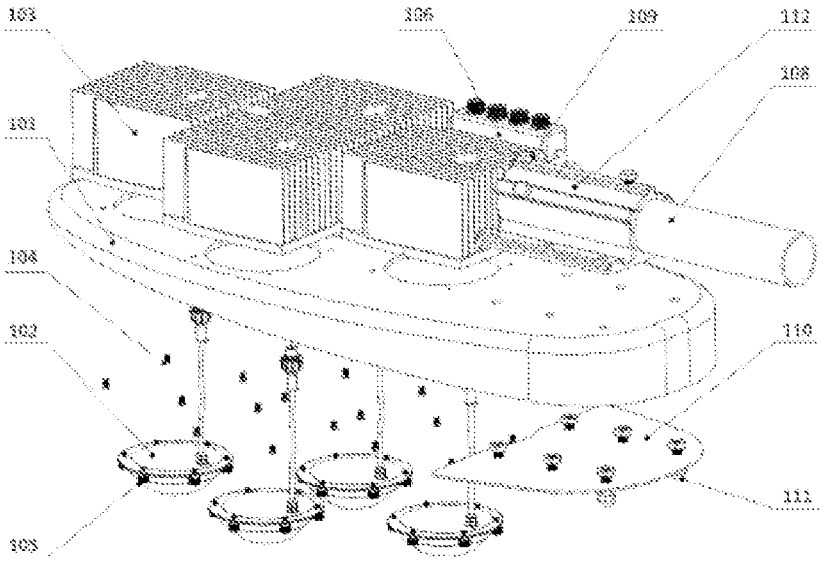
FIG. 37 is a schematic diagram of a structure of embodiment 1 of the present invention.
Figure 38:
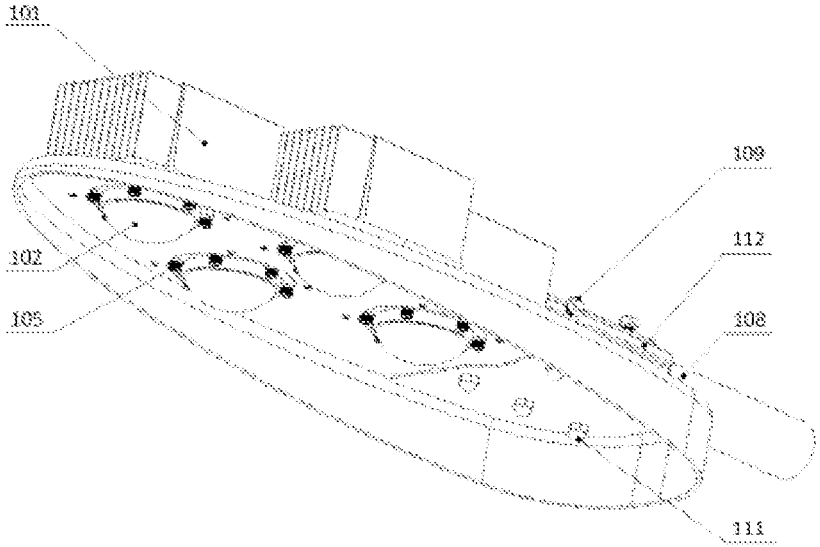
FIG. 38 is a use state diagram of embodiment 1 in the present invention.
Figure 41:
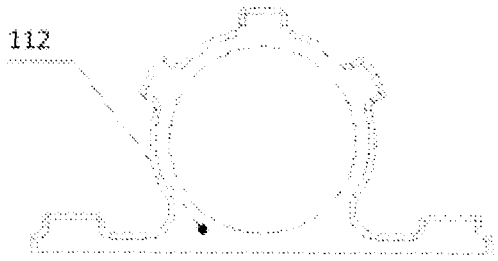
FIG. 41 is a projection drawing of a lamp post fixing bracket in embodiment 1 of the present invention.
Figure 42:
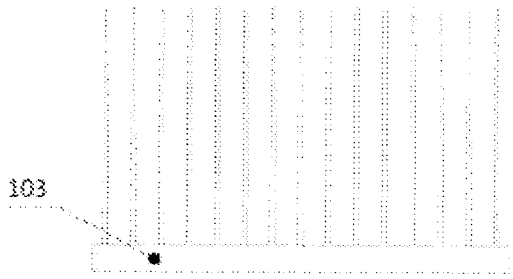
FIG. 42 is a cross-section diagram of an extrusion type radiator in embodiment 1 of the present invention.
Figure 43:
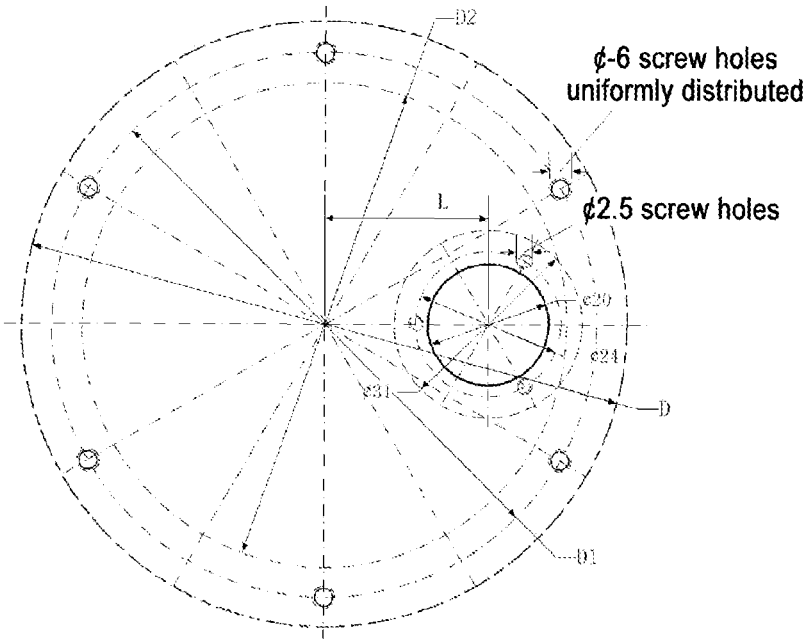
FIG. 43 is a schematic diagram of an installation interface opening of an extrusion type radiator in embodiment 1 of the present invention.
Figure 44:
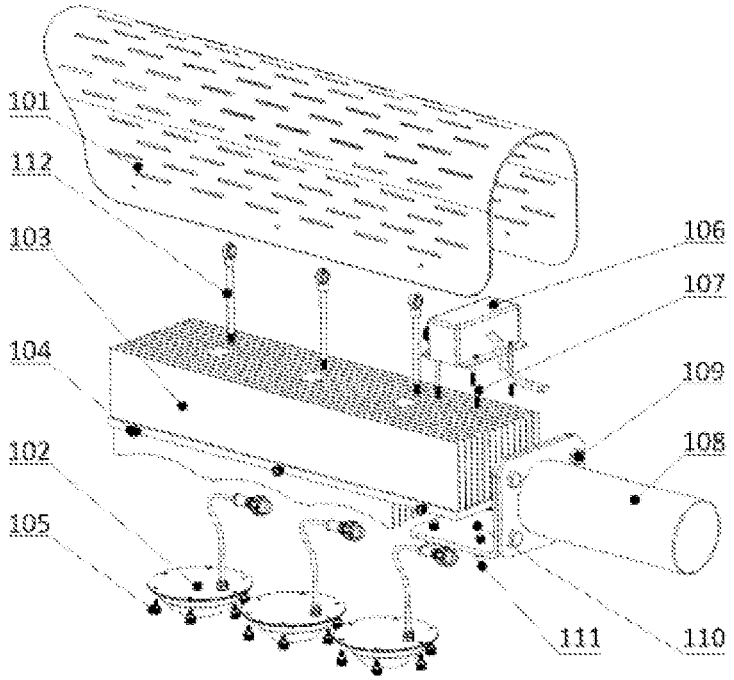
FIG. 44 is a schematic diagram of a structure of embodiment 2 in the present invention.
Figure 45:
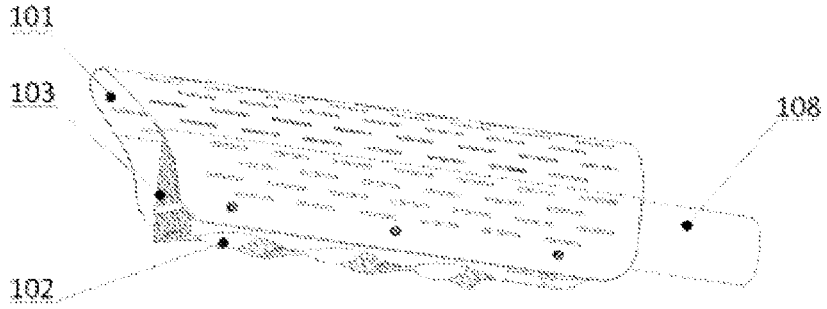
FIG. 45 is an external view of embodiment 2 of the present invention.
Figure 46:
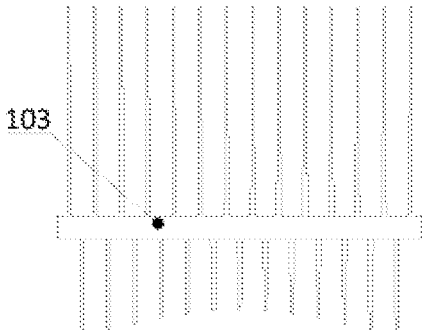
FIG. 46 is a cross-section diagram of a double-faced radiator in embodiment 2 of the present invention.
Figure 47:
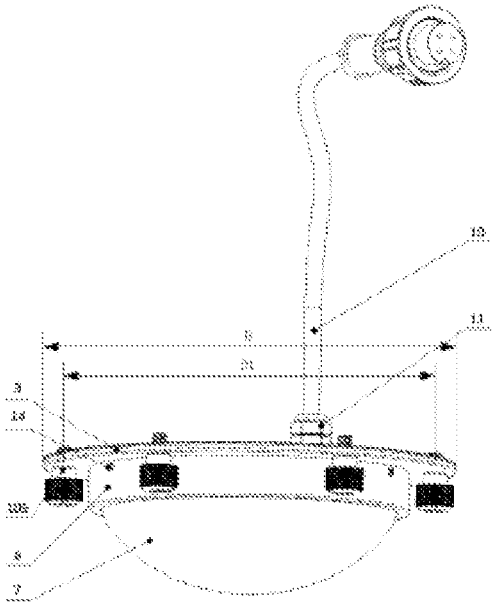
FIG. 47 is a schematic diagram of an outline of an LED bulb in embodiment 2 of the present invention.
Figure 48:
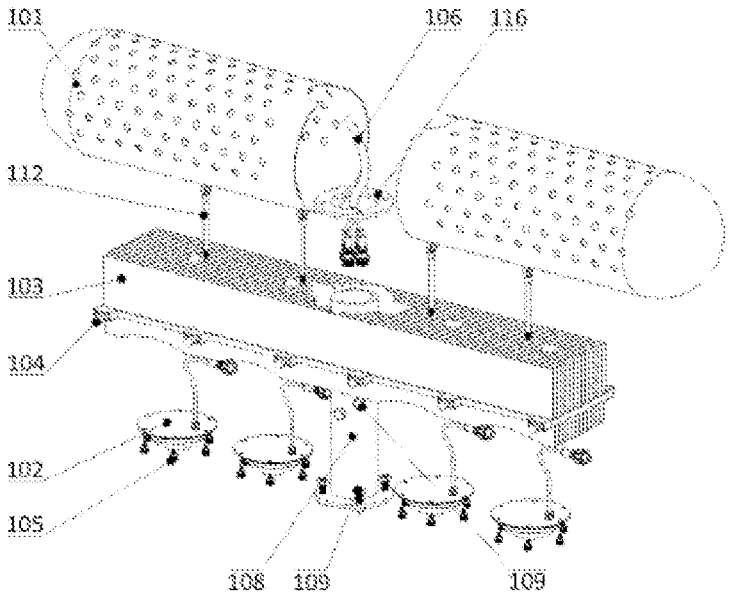
FIG. 48 is a structure diagram when a lamp post fixing ring is used in embodiment 2 of the present invention.
Figure 49:
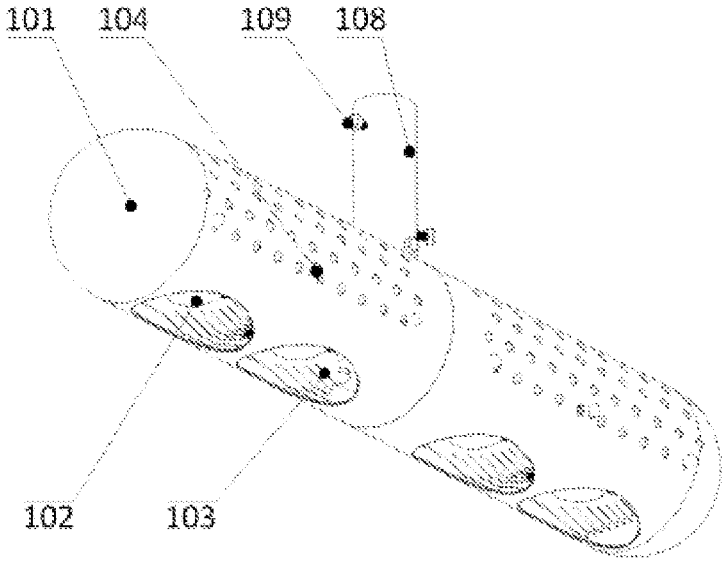
FIG. 49 is an external view when a lamp post fixing ring is used in embodiment 2 of the present invention.
Figure 50:
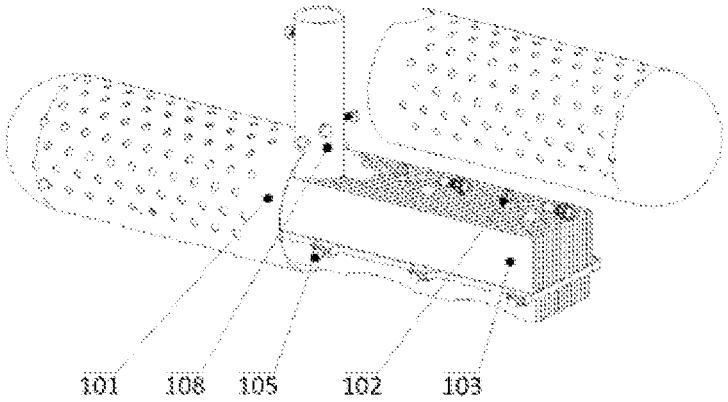
FIG. 50 is a maintenance state diagram when a lamp post fixing ring is used in embodiment 2 of the present invention.
Figure 51:
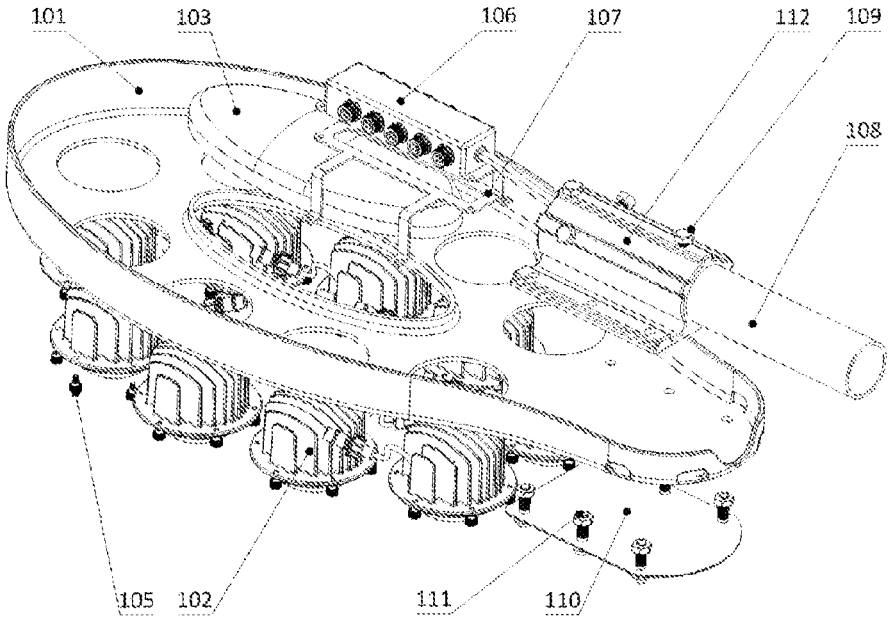
FIG. 51 is a schematic diagram of a structure of embodiment 3 in the present invention.
Figure 52:
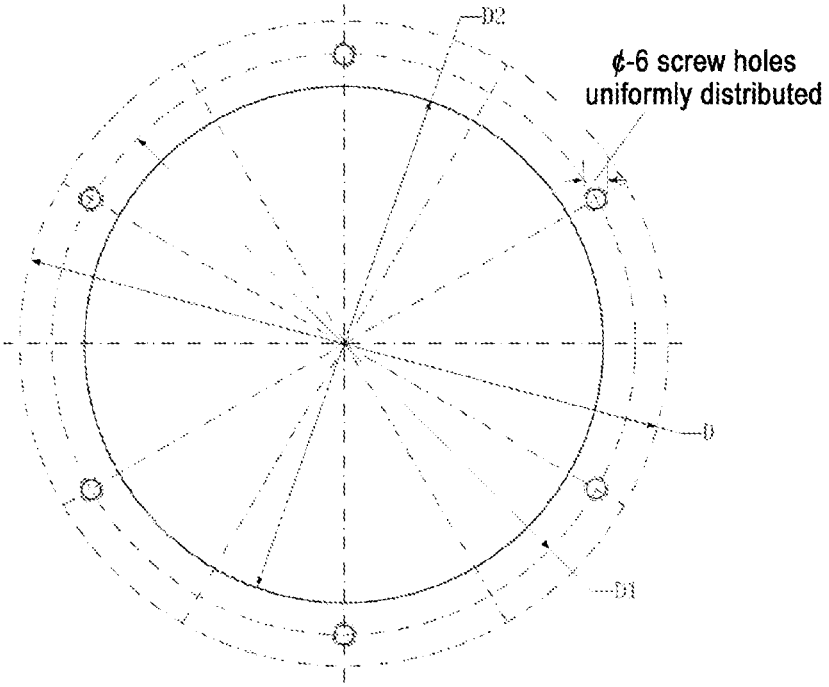
FIG. 52 is a schematic diagram of an installation interface of a lamp housing in embodiment 3 of the present invention.
Figure 53:
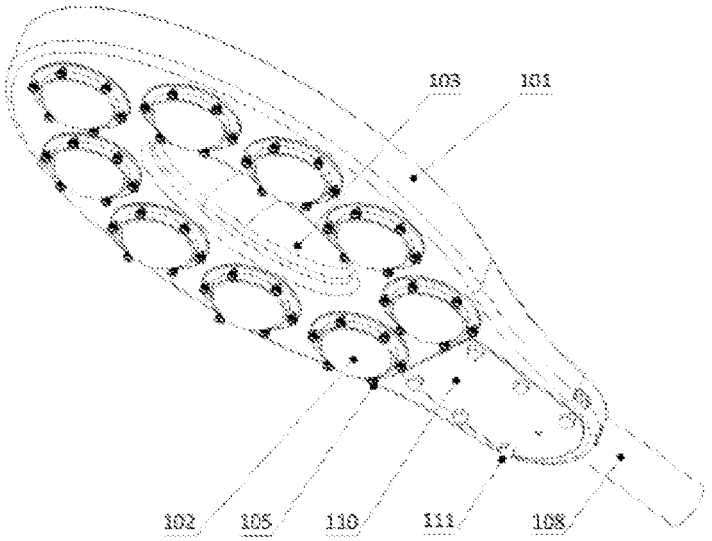
FIG. 53 is a vertical external view of embodiment 3 in the present invention.
Figure 54:
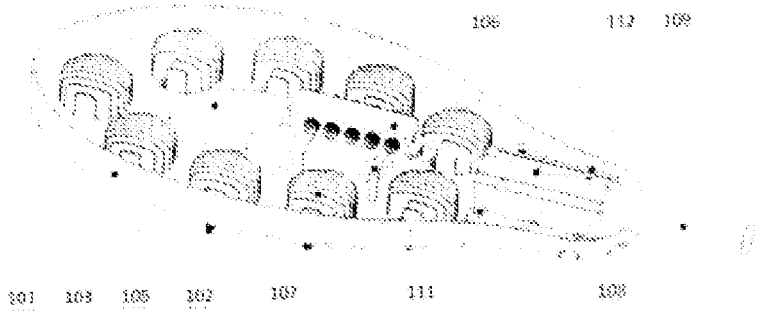
FIG. 54 is an overlooking external view of embodiment 3 in the present invention.
Figure 55:
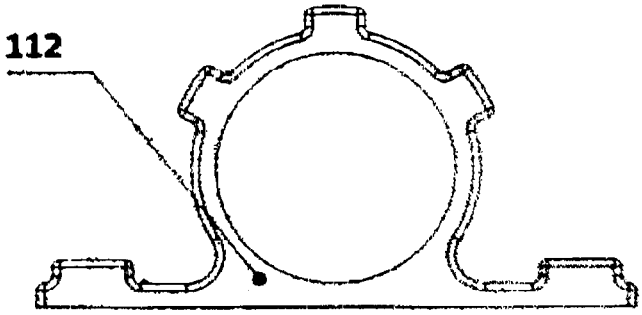
FIG. 55 is a projection drawing of a lamp post fixing bracket in embodiment 3 of the present invention.

An LED street lamp using a multifunctional lamp housing as an installation interface bracket structure, as shown in FIG. 37, FIG. 38 and FIG. 41, including the multifunctional lamp housing 101 punch formed by sheet metal via a stamping process, wherein the multifunctional lamp housing 101 is fixed to a lamp post 108 through a lamp post fixing element; one or more installation interface hole used for installing extrusion type radiators 103 is provided to the multifunctional lamp housing 101; an installation interface used for installing an LED bulb 102 is provided to each extrusion type radiator 103, the LED bulb 102 is provided to the installation interface, and the LED bulb 102 and the installation interface are provided in a one-to-one correspondence manner. A wire harness connector 106 is provided to the multifunctional lamp housing 101, and the wire harness connector 106 is used for connecting a plurality of LED bulbs 102 to a power supply and a control circuit; an edgefold for reinforcing the structural strength is further provided at the edge of the multifunctional lamp housing 101. The lamp post fixing element includes a lamp post fixing bracket 112, a lamp post fixing bracket bolt 111 and a reinforcing plate 110, wherein the lamp post fixing bracket 112 and the reinforcing plate 110 are provided at the upper and lower sides of the multifunctional lamp housing 101 respectively; the multifunctional lamp housing 101 is fixed to the lamp post 108 through the lamp post fixing bracket 112 and the reinforcing plate 110. The extrusion type radiator 103 includes a substrate, and a fin is provided at one side of the substrate; the installation interface used for installing the LED bulb 102 is provided at the other side of the substrate, as shown in FIG. 42; the installation interface includes a surface in contact with the LED bulb 102 and a hole connected to the LED bulb, on the extrusion type radiator 103. 6 flange fixing holes on the installation interface of the extrusion type radiator 103 are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is fixed to the installation interface of the extrusion type radiator 103 through the bulb fixing screw 105. The extrusion type radiator 103 is fixed to the radiator installation interface through a radiator fixing screw 104. The lamp post 108 is connected to the lamp post fixing bracket 112 through a lamp post fixing screw 109.

Figure 39:
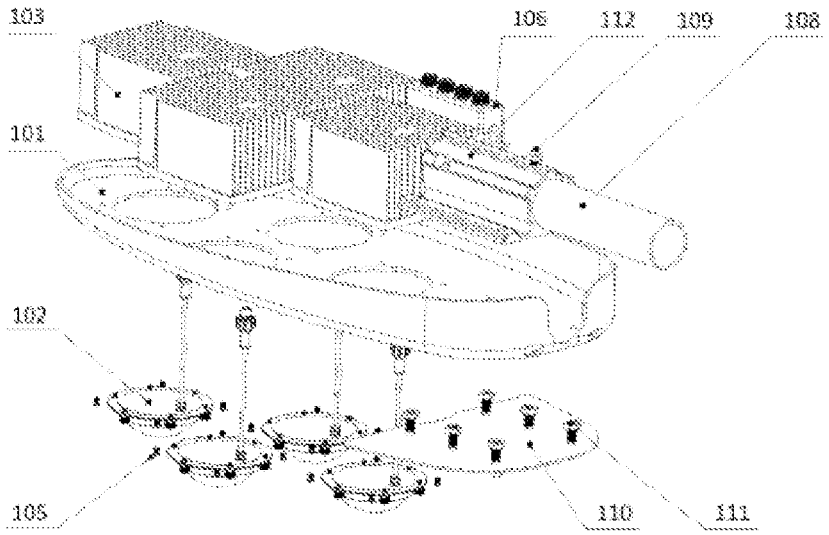
FIG. 39 is a schematic diagram of another structure of embodiment 1 in the present invention.
Figure 40:
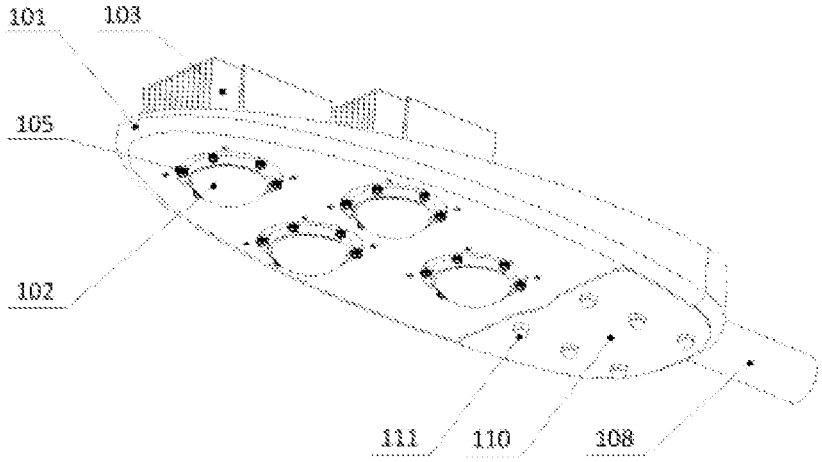
FIG. 40 is another use state diagram of embodiment 1 of the present invention.

In the embodiment, different forms of the outline of the lamp may also be used according to different use environments, as shown in FIG. 39 and FIG. 40.

In the case of an accident of the street lamp in the present invention, as shown in FIG. 37 and FIG. 38, the bulb 102 may be directly detached and installed, so that the LED bulb is very convenient to overhaul and change.

The lamp in the embodiment uses the multifunctional lamp housing as the core, the lamp housing is additionally provided with the original function of installing the installation interface bracket, the multifunctional lamp housing provides an installation interface for the lamp post when providing a supporting interface to the LED bulb, the LED bulb and other auxiliary components are overall collectively installed and fixed to the multifunctional lamp housing, thus the LED street lamp is simple, practical and beautiful.

The meanings of the reference numerals in the utility model are as follows: 101—multifunctional lamp housing, 102—LED bulb, 103—extrusion type radiator, 104—radiator fixing screw, 105—bulb fixing screw, 106—wire harness connector, 108—lamp post, 109—lamp post fixing bracket, 110—reinforcing plate, 111—lamp post fixing bracket bolt, and 112—lamp post fixing bracket.

Embodiment 2

Figure 2:
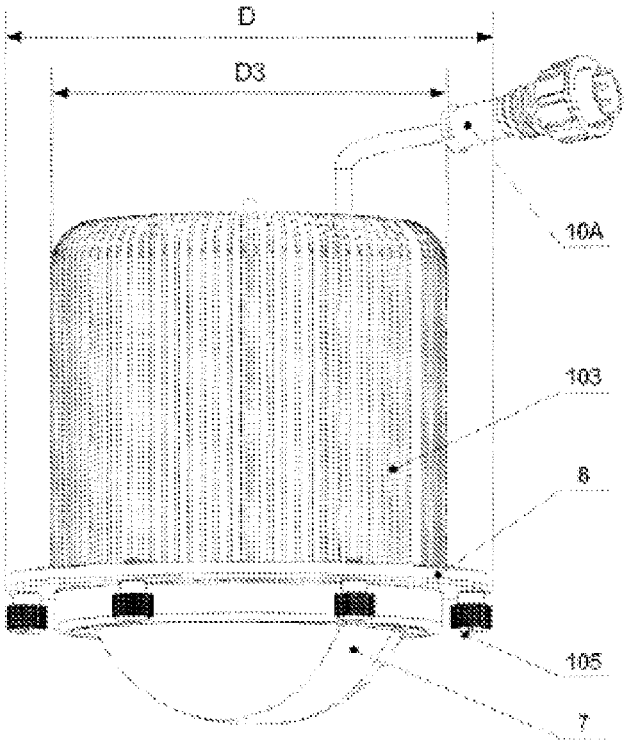
FIG. 2 is an external view of a bulb convex lens solution with a metal radiator in the present invention.
Figure 3:
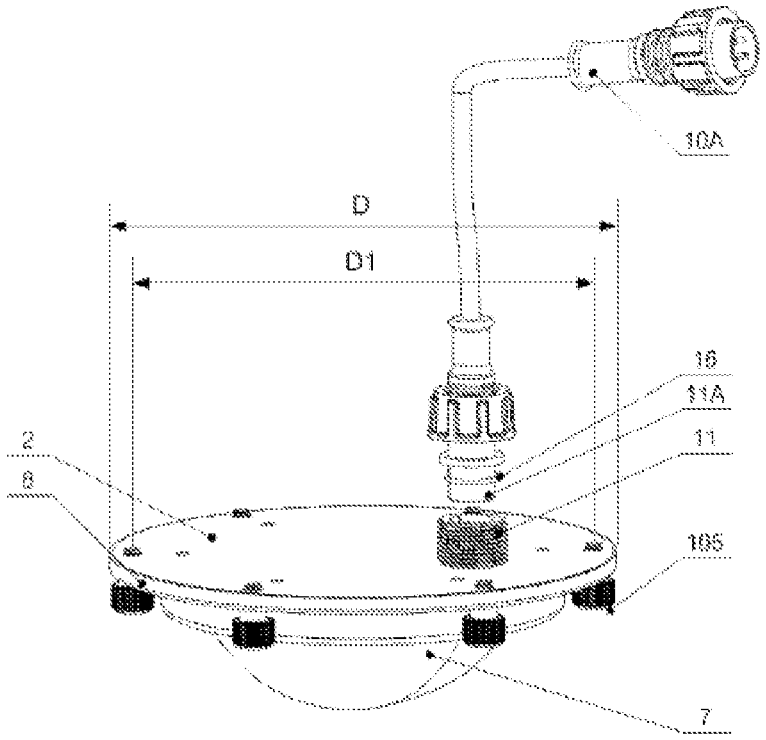
FIG. 3 is an external view of a bulb convex lens solution in the present invention.
Figure 4:
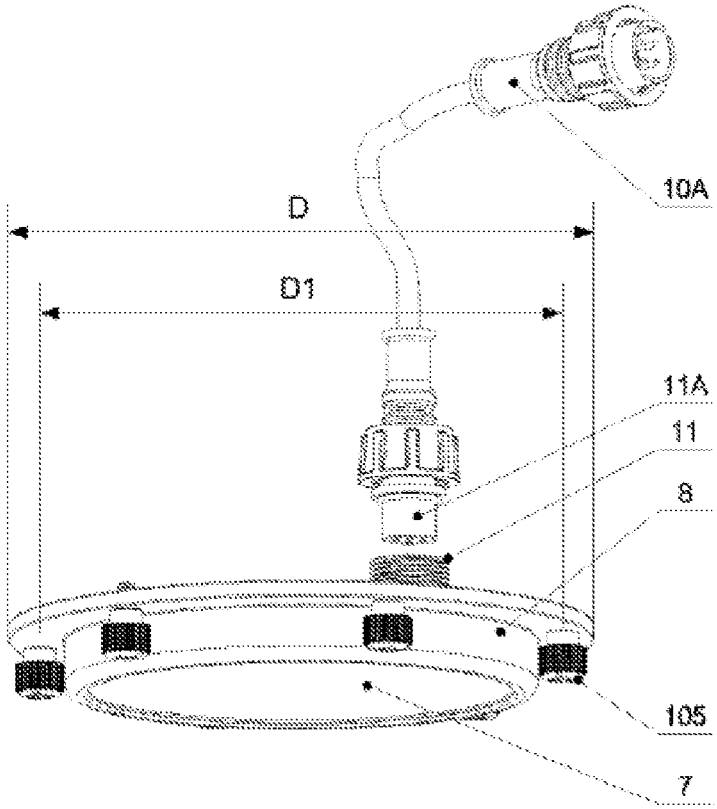
FIG. 4 is an external view of a bulb plate lens solution in the present invention.
Figure 5:
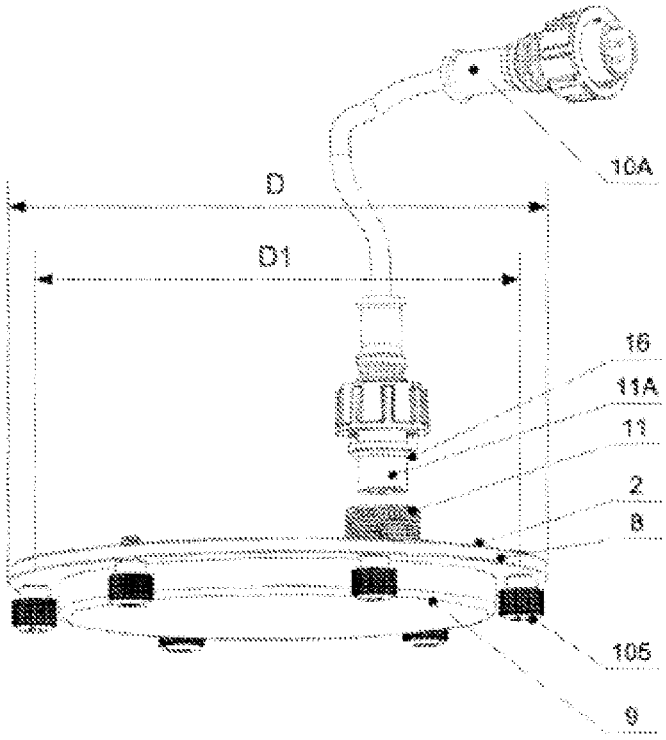
FIG. 5 is an external view of a flat bulb outer cover solution in the present invention.

An LED street lamp using a double-faced radiator structure, as shown in FIG. 1, FIG. 2 and FIG. 3, including a double-faced radiator 103 extrusion formed by a metal, wherein an installation interface is provided to the double-faced radiator 103, and an LED bulb 102 is provided to the installation interface; the double-faced radiator 103 is installed on a lamp post 108; a lamp housing 101 extrusion formed by a metal or die cast by plastics is provided outside the double-faced radiator 103; the LED street lamp using the double-faced radiator structure further includes a wire harness connector 106, and the wire harness connector 106 is used for connecting a plurality of LED bulbs 102 to a power supply and a control circuit. The double-faced radiator 103 includes a substrate, fins are provided at the two sides of the substrate, as shown in FIG. 4, and a cable hole is provided to the substrate; the installation interface used for installing the LED bulb 102 is provided at one side of the substrate, and circular or elliptic conical spaces are formed by cutting the fins around the installation interface of the substrate according to the illumination angle of the light emitted by the bulb to the extent of not shading the light emitted by the LED bulb 102; a conducting wire bracket 112 is provided at the other side of the substrate, and the conducting wire bracket 112 is used for connecting a conducting wire led out from the LED bulb 102 to the wire harness connector 106; the installation interface includes a surface in contact with the LED bulb 102 and a hole connected to the LED bulb, on the double-faced radiator 103. One side of the substrate of the double-faced radiator 103 is connected to an L-shaped connecting plate 110, and the L-shaped connecting plate 110 is connected to the lamp post 108; the wire harness connector 106 is provided to the double-faced radiator 103. 6 flange fixing holes on the installation interface are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is installed on the double-faced radiator 103 through a bulb fixing screw 105, the lampshade 101 is assembled on the double-faced radiator 103 through a lamp housing fixing screw group 104, and the wire harness connector 106 is provided to the double-faced radiator 103 through a wire harness connector bracket and screw 107. The double-faced radiator 103 is installed on the L-shaped connecting plate 110 through a radiator fixing screw 111, and the L-shaped connecting plate 110 is installed on the lamp post through a street lamp installation fixing bolt 109.

In the embodiment, a bracket installation hole is provided to the substrate or the center of the double-faced radiator 103, and the double-faced radiator 103 is installed on the lamp post 108 by means of the bracket installation hole and a lamp post fixing ring 116, the double-faced radiator 103 is fixed to the lamp post 108 through the street lamp installation fixing bolt 109, and the wire harness connector 106 is provided in the lamp post 108. At this time, the wire harness connector bracket and screw 107 does not need to be used.

In the present invention, during maintenance, as shown in FIG. 1 and FIG. 24, the bulb may be conveniently detached and installed just by detaching the lamp housing 101, so that the bulb is very convenient to overhaul and change.

In the lamp of the embodiment, the double-faced radiator is used as the core, and the LED bulb and all of other auxiliary components are overall integrally installed on the double-faced radiator, so that the structure is simple, the manufacturing cost is low, and the installation, use and maintenance are convenient. When the present invention is in use, the fins of the double-faced radiator are vertical to the ground, thus strong self-cleaning capacity is achieved, upper and lower fins are at two different heat operating states, meanwhile due to the protection of the lamp housing, severe pollution of the fins on any single surface will not cause ineffectiveness; the lamp in the present invention has very strong wind resistance, water resistance, dust plug resistance and pest plug resistance, and the lamp in the present invention may operate normally even if in environments with particularly severe dust and without rain for long time.

The meanings of the reference numerals in the embodiment are as follows: 101—lamp housing, 102—LED bulb, 103—double-faced radiator, 104—lamp housing fixing screw group, 105—bulb fixing screw, 106—wire harness connector, 107—wire harness connector bracket and screw, 108—lamp post, 109—street lamp installation fixing bolt, 110—L-shaped connecting plate, 111—radiator fixing screw, 112—conducting wire bracket, 116—lamp post fixing ring, 301—bulb installation flange fixing hole, 302—bracket lining rivet hole, 501—bracket lining rivet projection, and 502—power supply or control end welding spot hole.

Embodiment 3

An LED street lamp using a lamp housing as an installation interface bracket structure, as shown in FIG. 51, FIG. 53, FIG. 54 and FIG. 55, includes the lamp housing 101 punch formed by sheet metal via a stamping process, wherein an installation interface is provided to the lamp housing 101, an LED bulb 102 is provided to the installation interface, the lamp housing 101 is fixed to a lamp post 108 by a lamp post fixing element, and a decorative cover 103 is provided to the lamp housing 101. The LED street lamp using the lamp housing as the installation interface bracket structure further includes a wire harness connector 106, wherein the wire harness connector 106 is provided to the decorative cover 103, and the wire harness connector 106 is used for connecting a plurality of LED bulbs 102 to a power supply and a control circuit. The lamp housing 101 is elliptic, edgefolds for reinforcing the structural strength are provided at the inner and outer edges of the lamp housing 101, and the installation interface includes a surface in contact with the LED bulb 102 and a hole connected to the LED bulb, on the lamp housing 101. The lamp post fixing element includes a lamp post fixing bracket 112, a lamp post fixing bracket bolt 111 and a reinforcing plate 110, wherein the lamp post fixing bracket 112 and the reinforcing plate 110 are provided at the upper and lower sides of the lamp housing 101, and the lamp housing 101 is fixed to the lamp post 108 through the lamp post fixing bracket 112 and the reinforcing plate 110. A radiator interface opening and 6 flange fixing holes are provided to the installation interface of the lamp housing 101, the flange fixing holes are used for fixing the LED bulb 102, and the radiator interface opening is used for enabling the LED bulbs 102 to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator interface opening on the installation interface is a value obtained by subtracting two times of a diameter of a fixing screw cap and then subtracting two times of the margin corresponding to the diameter D1 from the outer diameter D of the bulb. The wire harness connector 106 is fixed to the decorative cover 103 through a wire harness connector bracket and screw 107. The lamp post fixing bracket 112 is fixed to the lamp housing 101 through the reinforcing plate 110 and the lamp post fixing bracket bolt 111, and the lamp post 108 is connected to the lamp post fixing bracket 112 through a lamp post fixing screw 109. Each LED bulb 102 is installed on the lamp housing 101 through bulb fixing screws 105, and the LED bulb 102 penetrates through an installation interface hole. The LED bulb 102 is installed on the installation interface from the lower side.

In the embodiment, a heat conductive pad 2 is provided between a flange or an installation flange and the installation interface.

In the embodiment, the heat conductive bracket 3 may also be fixed in a bulb outer cover 91 provided with the installation flange.

Figure 56:
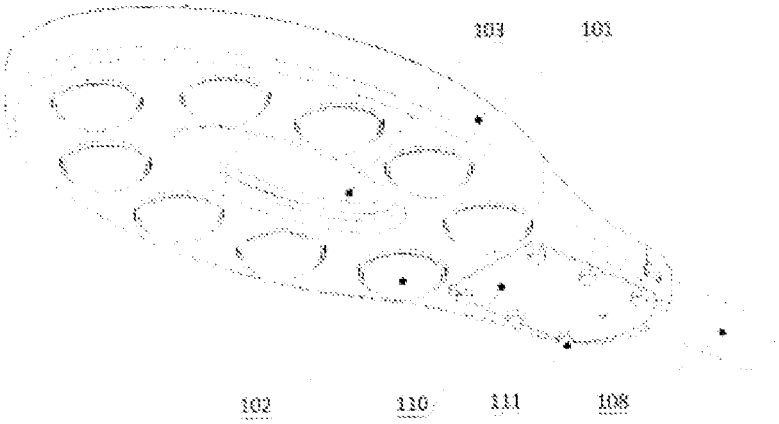
FIG. 56 is a vertical external view of embodiment 3 in the present invention.
Figure 57:
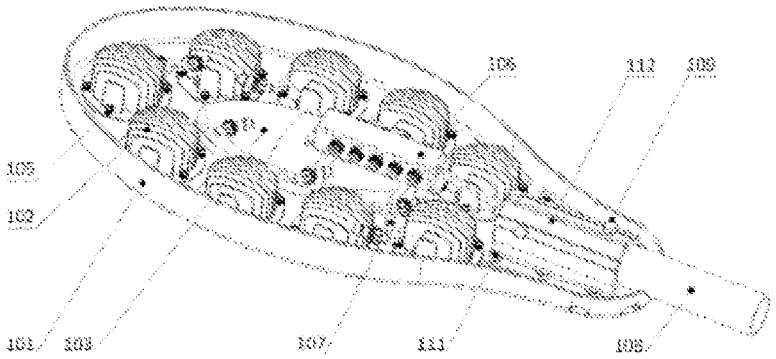
FIG. 57 is an overlooking external view of embodiment 3 in the present invention.

In the embodiment, the LED bulb 102 may also be installed on the lamp housing from the upper side, as shown in FIG. 56 and FIG. 57.

The meanings of the reference numerals in the embodiment are as follows: 101—lamp housing, 102—LED bulb, 103—decorative cover, 105—bulb fixing screw, 106—wire harness connector, 107—wire harness connector bracket and screw, 108—lamp post, 109—lamp post fixing screw, 110—reinforcing plate, 111—lamp post fixing bracket bolt, and 112—lamp post fixing bracket.

Embodiment 4-1

An LED street lamp using a lamp housing with a radiator as an installation interface bracket structure, including the lamp housing 103 with the radiator and formed by a metal in a die casting process, wherein one or more installation interface is provided to the lamp housing 103 with the radiator, an LED bulb 102 is provided to the installation interface, the lamp housing 103 with the radiator is connected to a lamp post 108 through a lamp post fixing bracket 112, a wire harness connector 106 is provided at the upper part of the lamp post fixing bracket 112, and the wire harness connector is used for connecting a plurality of LED bulbs 102 to a power supply and a control circuit. A substrate is provided at the central part of the lamp housing 103 with the radiator, fins are provided at one side of the substrate, overflow gaps exist between the fins, and the overflow gaps enable the air to fully contact the fins to reinforce the radiating effect; an installation interface used for installing the LED bulb 102 is provided at the other side of the substrate; the installation interface includes a surface in contact with the LED bulb 102 and a hole connected to the LED bulb, on the lamp housing 103 with the radiator. The LED street lamp using the lamp housing with the radiator as the installation interface bracket structure further includes an outer cover 101, a waterproof rubber ring 113 and a waterproof sealing gland 114; the outer cover 101 is provided at the lower part of the lamp housing 103 with the radiator, the outer cover 101 is provided outside the installation interface, and the waterproof sealing gland 114 is pressed at the outside of the outer cover 101 surrounded by the waterproof rubber ring 113, in order to improve the water resistance of the outer cover 101. 6 flange fixing holes on the installation interface of the lamp housing 103 with the raditor are uniformly distributed on the diameter D1, and the diameter D1 is a margin value obtained by subtracting the diameter of the fixing screw cap and 0.8-4 mm from the outer diameter D of the LED bulb 102. The LED bulb 102 is installed on the installation interface through a bulb fixing screw 105, the lamp post 108 is connected to the lamp post fixing bracket 112 through a lamp post fixing screw 109, the lamp post fixing bracket 112 is fixed to the lamp housing 103 with the radiator through a lamp post fixing bracket bolt, and a wire harness connector 106 is provided to the lamp post fixing bracket 112 through a wire harness connector bracket and screw 107.

Embodiment 4-2

Figure 58:
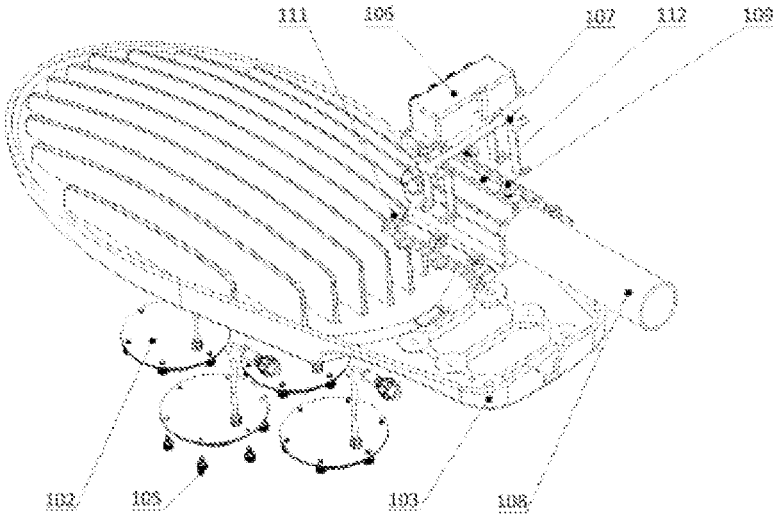
FIG. 58 is a schematic diagram of structures of embodiments 4-1 in the present invention.
Figure 59:
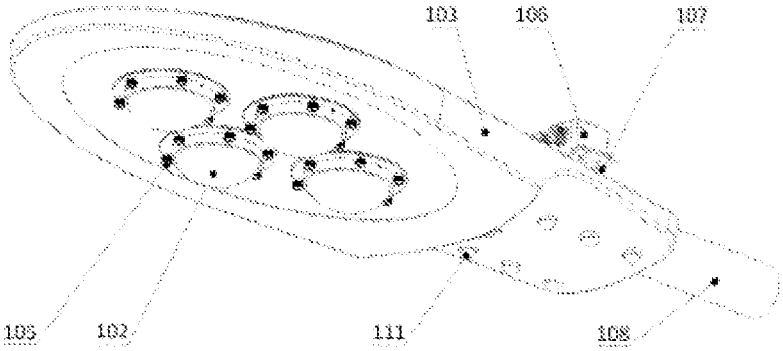
FIG. 59 is an external view of embodiment 4-1 of the present invention.

An LED street lamp using a lamp housing with a radiator as an installation interface bracket structure, as shown in FIG. 58 and FIG. 59, including the lamp housing 103 with the radiator and formed by a metal in a die casting process, wherein one or more installation interface is provided to the lamp housing 103 with the radiator, an LED bulb 102 is provided to the installation interface, the lamp housing 103 with the radiator is connected to a lamp post 108 through a lamp post fixing bracket 112, a wire harness connector 106 is provided at the upper part of the lamp post fixing bracket 112, and the wire harness connector is used for connecting a plurality of LED bulbs 102 to a power supply and a control circuit. A substrate is provided at the central part of the lamp housing 103 with the radiator, fins are provided at one side of the substrate, overflow gaps exist between the fins, and the overflow gaps enable the air to fully contact the fins to reinforce the radiating effect; an installation interface used for installing the LED bulb 102 is provided at the other side of the substrate; the installation interface includes a surface in contact with the LED bulb 102 and a hole connected to the LED bulb, on the lamp housing 103 with the radiator. 6 flange fixing holes on the installation interface of the lamp housing 103 with the radiator are uniformly distributed at a diameter DE and the diameter D1 is a value obtained by subtracting a diameter of a fixing screw cap and then subtracting a margin of 0.8-4 mm from the outer diameter D of the LED bulb 102. The LED bulb 102 is installed on the installation interface through a bulb fixing screw 105, the lamp post 108 is connected to the lamp post fixing bracket 112 through a lamp post fixing screw 109, the lamp post fixing bracket 112 is fixed to the lamp housing 103 with the radiator through a lamp post fixing bracket bolt, and a wire harness connector 106 is provided to the lamp post fixing bracket 112 through a wire harness connector bracket and screw 107. The LED bulb 102 is installed on the installation interface through a bulb fixing screw 105, the lamp post 108 is connected to the lamp post fixing bracket 112 through a lamp post fixing screw 109, the lamp post fixing bracket 112 is fixed to the lamp housing 103 with the radiator through a lamp post fixing bracket bolt, and a wire harness connector 106 is provided to the lamp post fixing bracket 112 through a wire harness connector bracket and screw 107.

Figure 60:
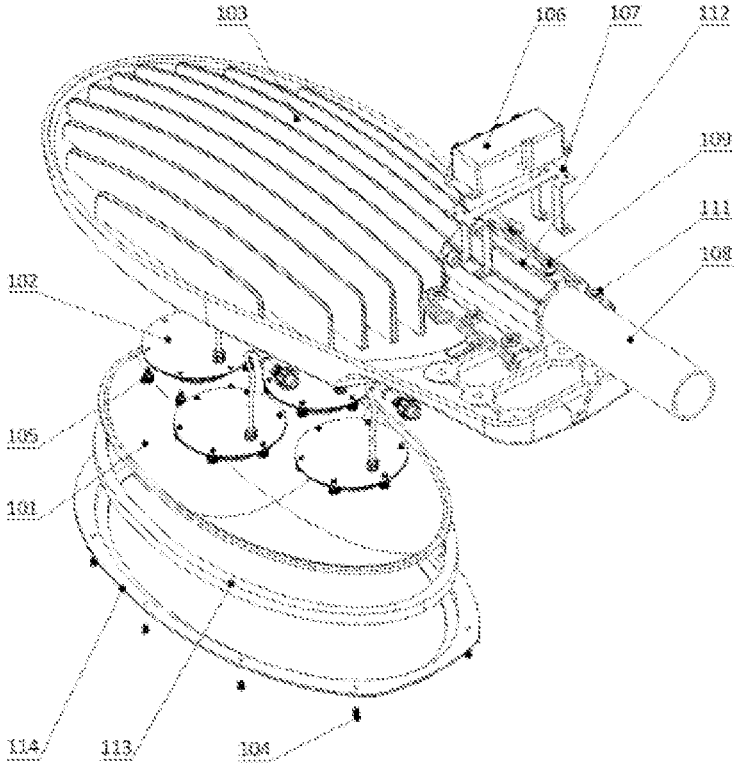
FIG. 60 is a schematic diagram of another structure of embodiment 4 in the present invention.
Figure 61:
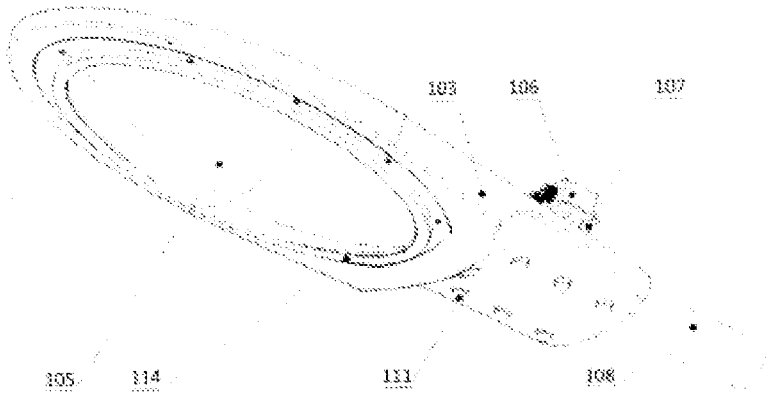
FIG. 61 is another external view of embodiment 4 of the present invention.
Figure 62:
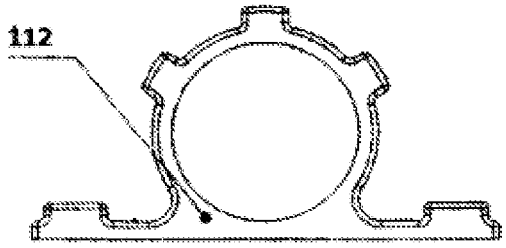
FIG. 62 is a projection drawing of a bracket in embodiment 4 of the present invention.

In the embodiment, when the LED street lamp using the lamp housing with the radiator as the installation interface bracket structure is used in a rainy environment, an outer cover 101, a waterproof rubber ring 113 and a waterproof sealing gland 114 may be additionally provided; the outer cover 101 is provided at the lower part of the lamp housing 103 with the radiator, the outer cover 101 is provided outside the installation interface, and the waterproof sealing gland 114 is pressed at the outside of the outer cover 101 surrounded by the waterproof rubber ring 113, in order to improve the water resistance of the outer cover 101, as shown in FIG. 60 and FIG. 61.

In the present invention, in the case of an accident of the street lamp, the LED bulb 102 may be conveniently overhauled and changed just by detaching the bulb 102 from the lamp housing 103 with the radiator, as shown in FIG. 58 and FIG. 60.

In the lamp in the embodiment, the lamp housing, the radiator and the bulb installation bracket are integrated to the lamp housing with the radiator, and the LED bulb and all of other auxiliary components are overall integrally installed on the double-faced radiator, so that the structure is simple, the manufacturing cost is low, and the installation, use and maintenance are convenient. During operation, the fins of the lamp housing with the radiator are vertical to the ground, thus having strong self-cleaning capacity, and during maintenance, just the LED bulb is detached for maintenance, so that the maintenance is convenient. In the lamp in the present invention, the outer cover, the waterproof rubber ring and the waterproof sealing gland may also be adopted in environments with severe rain, to ensure strong water resistance.

The meanings of the reference numerals in the embodiment are as follows: 101—outer cover, 102—LED bulb, 103—lamp housing with radiator, 105—bulb fixing screw, 106—wire harness connector, 107—wire harness connector bracket and screw, 108—lamp post, 109—lamp post fixing screw, 111—lamp post fixing bracket bolt, 112—lamp post fixing bracket, 113—waterproof rubber ring, and 114—waterproof sealing gland.

Embodiment 5-1

An LED lighting lamp using an installation interface bracket combined member, including the installation interface bracket combined member, wherein an LED bulb 102 with waterproof and dustproof functions and provided with a radiator is provided to the installation interface bracket combined member; a lamp housing 101 punch formed by a metal or die cast by plastics is provided outside the installation interface bracket combined member; the installation interface bracket combined member includes a pipe bracket 108 formed by segmenting a standard pipe, a lamp fixing flange 106 and a lamp housing and bulb fixing bracket 110 which are connected, an installation interface used for installing the LED bulb 102 is provided to the lamp housing and bulb fixing bracket 110, and the pipe bracket 108 is connected to the lamp fixing flange 106 and the lamp housing and bulb fixing bracket 110; the lamp fixing flange 106 is a flat panel flange or an arched flange; the lamp housing 101 is connected to the installation interface bracket combined member through the lamp housing and bulb fixing bracket 110. The installation interface includes a surface in contact with the LED bulb 102 and a hole connected to the LED bulb, on the lamp housing and bulb fixing bracket 110; the lamp housing and bulb fixing bracket 110 is punch formed by a metal, the pipe bracket 108 is connected to the center of the lamp housing and bulb fixing bracket 110, the lamp housing and bulb fixing bracket 110 is engraved to be hollow around its portion connected to the pipe bracket 108, so that passage of a cable and formation of a chimney effect in the lamp housing are facilitated so as to ensure the ventilating and radiating effects, and a screw hole used for installing the lamp housing 101 is provided at the edge of the lamp housing and bulb fixing bracket 110. 6 flange fixing holes uniformly distributed at a diameter D1 are provided to the installation interface, and the diameter D1 is a value obtained by subtracting a diameter of a fixing screw cap and then subtracting a margin of 0.8-4 mm from the outer diameter D of the LED bulb 102.

Embodiment 5-2

Figure 63:
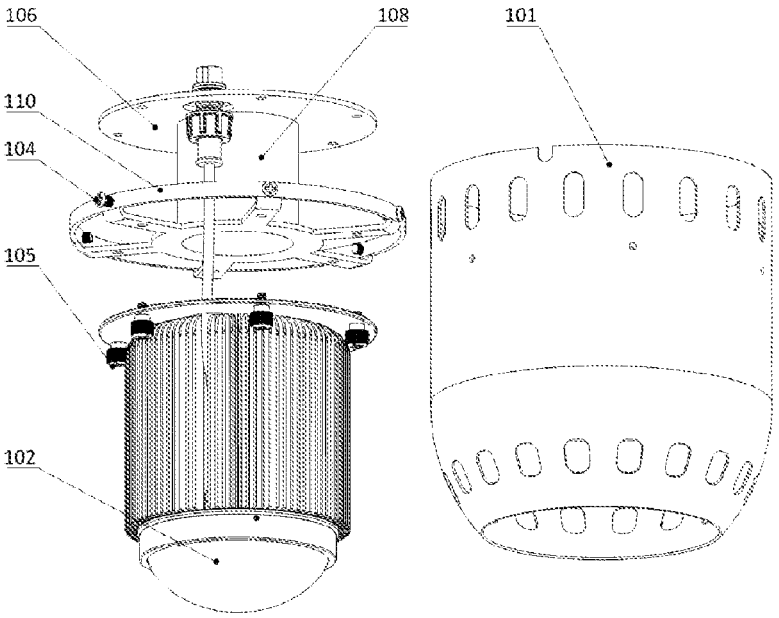
FIG. 63 is a schematic diagram of structures of embodiments 5-1 in the present invention.
Figure 66:
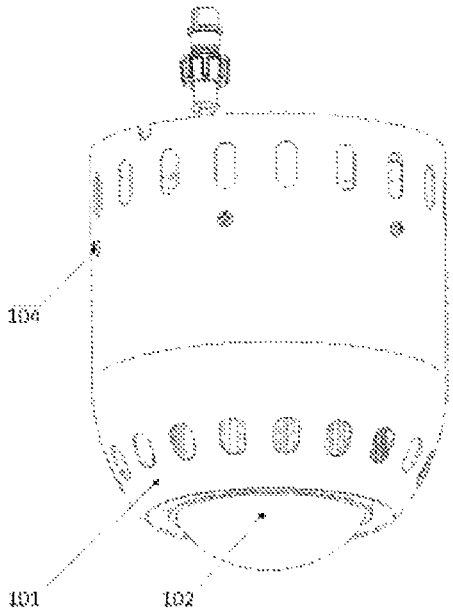
FIG. 66 is an external view of a fixing flange using a flat panel lamp in the present invention.
Figure 70:
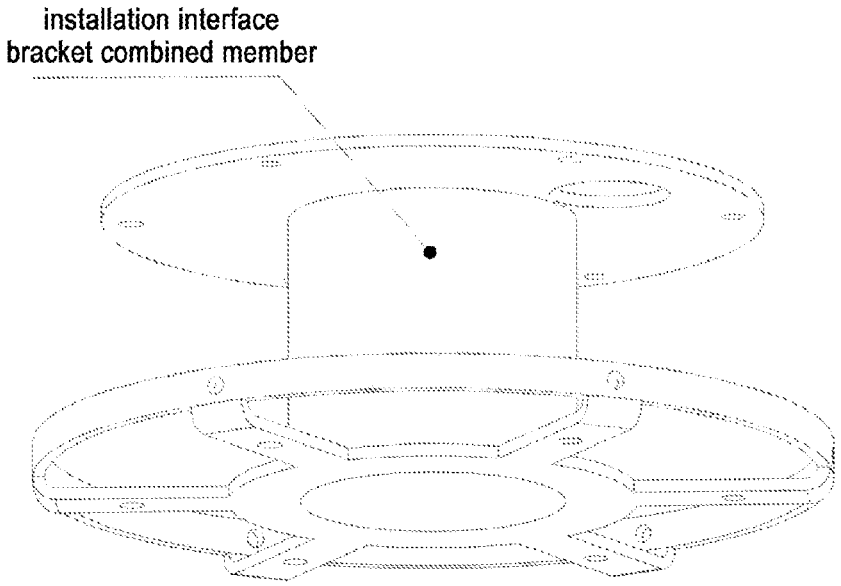
FIG. 70 is a schematic diagram of a structure of an installation interface bracket combined member in the present invention.
Figure 71:
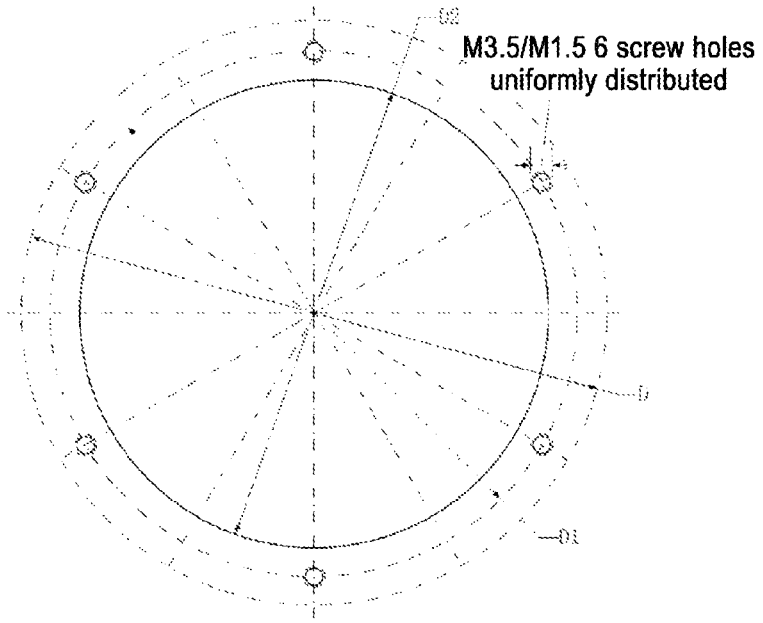
FIG. 71 is a schematic diagram of a structure of an installation interface opening of a lamp housing and bulb fixing bracket in the present invention.

An LED lighting lamp using an installation interface bracket combined member, as shown in FIG. 63 and FIG. 66, includes the installation interface bracket combined member, wherein an LED bulb 102 with waterproof and dustproof functions and provided with a radiator is provided to the installation interface bracket combined member, and a lamp housing 101 punch formed by a metal or die cast by plastics is provided outside the installation interface bracket combined member; the installation interface bracket combined member includes a pipe bracket 108 formed by segmenting a standard pipe, a lamp fixing flange 106 and a lamp housing and bulb fixing bracket 110 which are connected, as shown in FIG. 70, an installation interface used for installing the LED bulb 102 is provided to the lamp housing and bulb fixing bracket 110, and the pipe bracket 108 is connected to the lamp fixing flange 106 and the lamp housing and bulb fixing bracket 110; the lamp fixing flange 106 is a flat panel flange; the lamp housing 101 is connected to the installation interface bracket combined member through the lamp housing and bulb fixing bracket 110. The installation interface includes a surface in contact with the LED bulb 102 and a hole connected to the LED bulb, on the lamp housing and bulb fixing bracket 110; the lamp housing and bulb fixing bracket 110 is punch formed by a metal, the pipe bracket 108 is connected to the center of the lamp housing and bulb fixing bracket 110, the lamp housing and bulb fixing bracket 110 is engraved to be hollowed around its portion connected to the pipe bracket 108, so that passage of a cable and formation of a chimney effect in the lamp housing are facilitated so as to ensure the ventilating and radiating effects, and a screw hole used for installing the lamp housing 101 is provided at the edge of the lamp housing and bulb fixing bracket 110. The lamp housing 101 is installed on the lamp housing and bulb fixing bracket 110 through a lamp housing fixing screw group 104. 6 flange fixing holes uniformly distributed at a diameter D1 are provided to the installation interface, and the diameter D1 is a value obtained by subtracting a diameter of a fixing screw cap and then subtracting a margin of 0.8-4 mm from the outer diameter D of the LED bulb 102.

Figure 65:
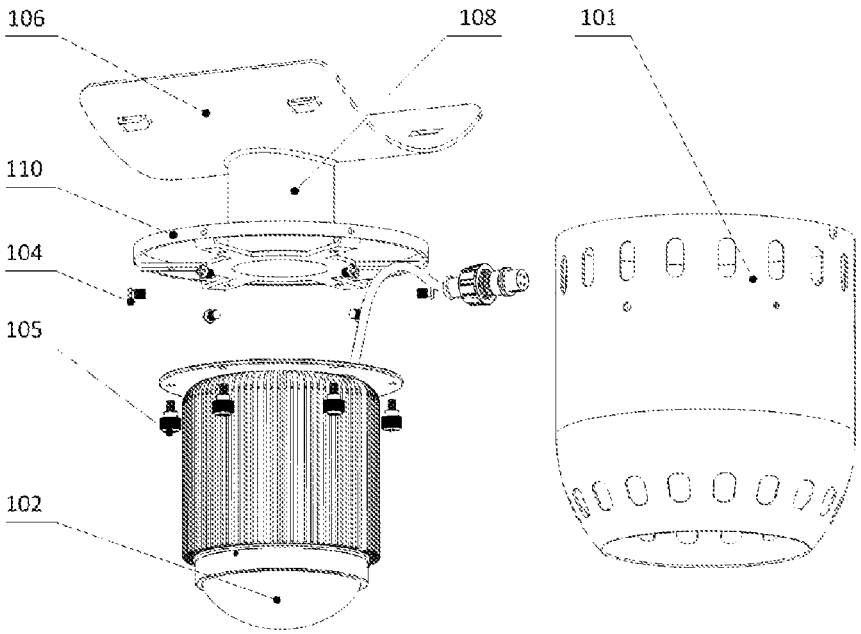
FIG. 65 is a schematic diagram of a structure of a fixing flange using an arched lamp in the present invention.
Figure 67:
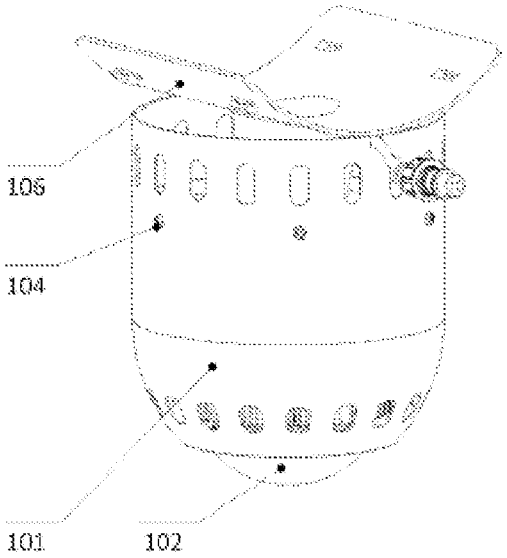
FIG. 67 is an external view of a fixing flange using an arched lamp in the present invention.
Figure 68:
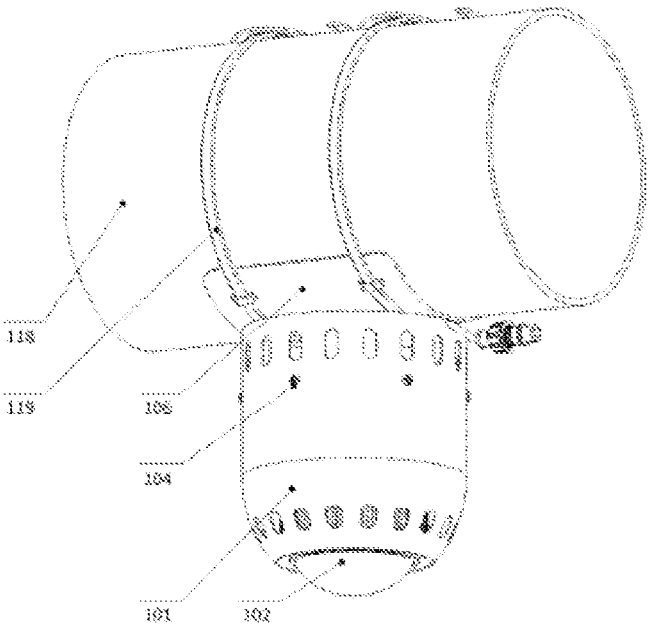
FIG. 68 is a schematic diagram of installing the present invention on a pipe truss structure.

In the embodiment, the lamp fixing flange 106 may also be an arched flange, as shown in FIG. 65, FIG. 67 and FIG. 68, which is suitable for being installed on such a round bar or pipe truss structure as a factory building, an airport or the like.

Figure 64:
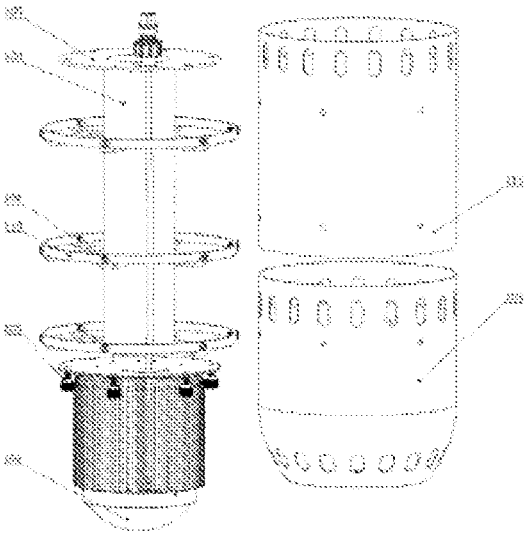
FIG. 64 is a schematic diagram of a structure of an LED lighting lamp using an elongation cover in the present invention.
Figure 69:
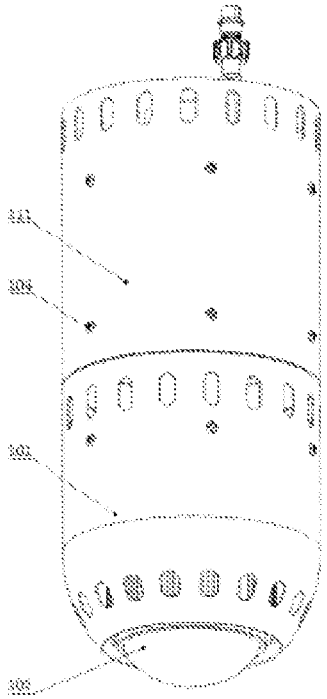
FIG. 69 is an external view of an LED lighting lamp using an elongation cover in the present invention.

In the embodiment, the lamp housing 101 may also be used with an elongation cover 111, and the elongation cover 111 is also installed on the lamp housing and bulb fixing bracket 110, as shown in FIG. 64 and FIG. 69.

During maintenance, in the present invention, only the lamp housing 101 is detached, as shown in FIG. 63, and the bulb may be conveniently detached and installed, thus the bulb is very convenient to maintain and change.

When the present invention is in use, according to different demands, different lamp fixing flanges 3 are selected to adapt to different installation occasions. When being installed on the pipe truss structure, it is as shown in FIG. 68. To better present dust, when the present invention is in use, a bulb installation flange fixing hole 301 on the heat conductive bracket 3 may be omitted, and the outer diameter thereof is reduced to be equal to the outer diameter of the lens snap ring 8.

The lamp in the embodiment adopts the installation interface bracket combined member as the installation fixing component, the installation interface bracket combined member provides a supporting interface for the LED bulb, and the lamp housing, the LED bulb and other auxiliary components are overall collectively installed on the bracket combined member, thereby being simple in structure, low in manufacturing cost and convenient to install, use and maintain. The lamp housing and the bulb fixing bracket of the lamp in the present invention are engraved to be hollow around its portion connected to the pipe bracket, so that passage of a cable and formation of a chimney effect in the lamp housing are facilitated so as to improve the ventilating and radiating effects. Due to the design features of the lamp in the present invention, the application range of the present invention is wider, when the lamp fixing flange is the flat panel flange, it may be used in a vertical manner, an upward manner or a ceiling manner, and thus is suitable for being installed on such places as a tunnel top, an airport hall, a factory building, a lawn, a park and the like; when the lamp fixing flange is an arched flange, it may be used on various round bar or pipe truss structures.

The meanings of the reference numerals in the embodiment are as follows: 101—lamp housing, 102—LED bulb, 103—radiator, 104—lamp housing fixing screw group, 105—bulb fixing screw, 106—lamp fixing flange, 108—pipe bracket, 110—lamp housing and bulb fixing bracket, 111—elongation cover, 301—bulb installation flange fixing hole, 302—bracket lining rivet hole, 501—bracket lining rivet projection, and 502—power supply or control end welding spot hole.

Embodiment 6-1

An LED tunnel lamp using a lamp housing as an installation interface bracket structure, including the lamp housing 101 formed by a metal stamping or plastics die casting process, wherein one or more installation interface used for installing an LED bulb 102 provided with a radiator is provided to the lamp housing 101; the lamp housing 101 includes an installation interface bracket plate used for installing the LED bulb 102, and the installation interface used for installing the LED bulb 102 is provided to the installation interface bracket plate; a foot screw hole used for fixedly installing the entire LED tunnel lamp is provided to the lamp housing 101. A protection plate is further provided to the lamp housing 101; the installation interface includes a surface in contact with the LED bulb 102 and a hole connected to the LED bulb, on the lamp housing 101. A radiator opening and 6 flange fixing holes are provided to the installation interface, the flange fixing holes are used for fixing the LED bulb 102, and the radiator opening is used for enabling the radiator of the LED bulb 102 to penetrate through the installation interface; the flange fixing holes are uniformly distributed at a diameter DE and the diameter D1 is a value obtained by subtracting a diameter of a fixing screw cap and then subtracting a margin of 0.8-4 mm from the outer diameter D of the LED bulb 102; the diameter D2 of the radiator opening is a value obtained by subtracting two times of a diameter of a fixing screw cap and then subtracting two times of the margin corresponding to the diameter D1 from the outer diameter D of the bulb.

Embodiment 6-2

Figure 72:
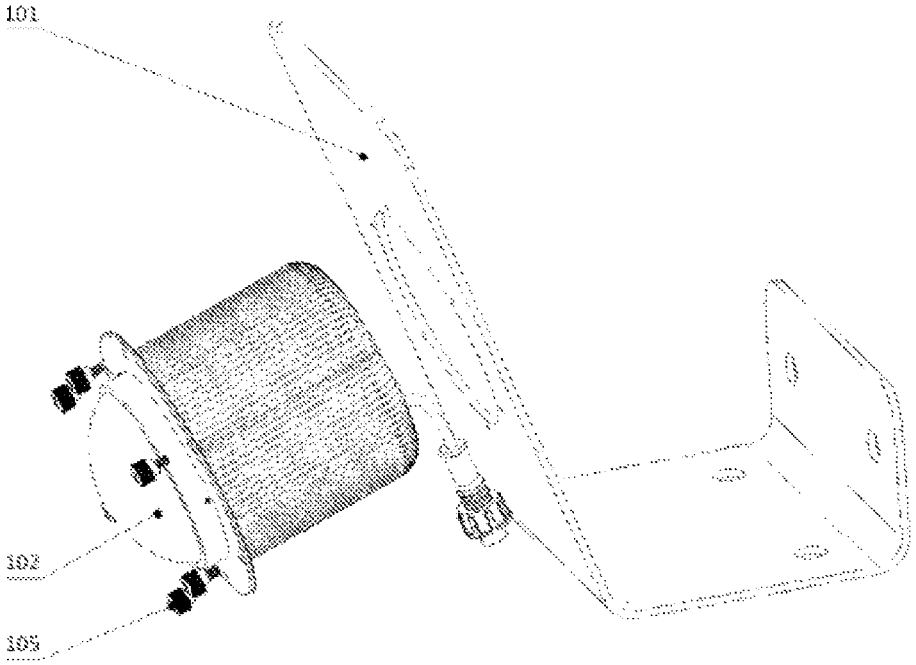
FIG. 72 is a schematic diagram of structures of embodiment 6-2 in the present invention.
Figure 73:
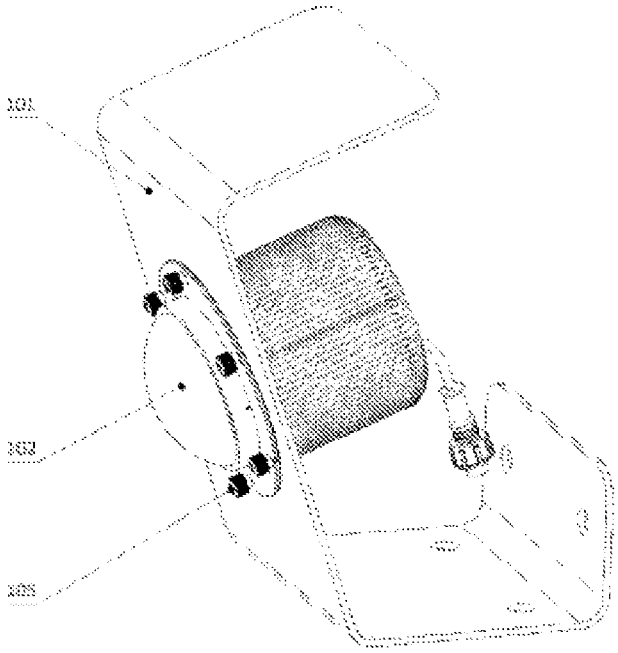
FIG. 73 is a schematic diagram of a structure when a protection plate is adopted in embodiment 6-2 of the present invention.

An LED tunnel lamp using a lamp housing as an installation interface bracket structure, as shown in FIG. 72 and FIG. 73, including the lamp housing 101 formed by a metal stamping or plastics die casting process, wherein one or more installation interface used for installing an LED bulb 102 provided with a radiator is provided to the lamp housing 101; the lamp housing 101 includes an installation interface bracket plate used for installing the LED bulb 102, and the installation interface used for installing the LED bulb 102 is provided to the installation interface bracket plate; a foot screw hole used for fixedly installing the entire LED tunnel lamp is provided to the lamp housing 101. The installation interface includes a surface in contact with the LED bulb 102 and a hole connected to the LED bulb, on the lamp housing 101. A radiator opening and 6 flange fixing holes are provided to the installation interface, the flange fixing holes are used for fixing the LED bulb 102, and the radiator opening is used for enabling the radiator of the LED bulb 102 to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator opening is a value obtained by subtracting two times of a diameter of a fixing screw cap and then subtracting two times of the margin corresponding to the diameter D1 from the outer diameter D of the bulb. The LED bulb 102 is installed on the installation interface through a bulb fixing screw 105.

Figure 80:
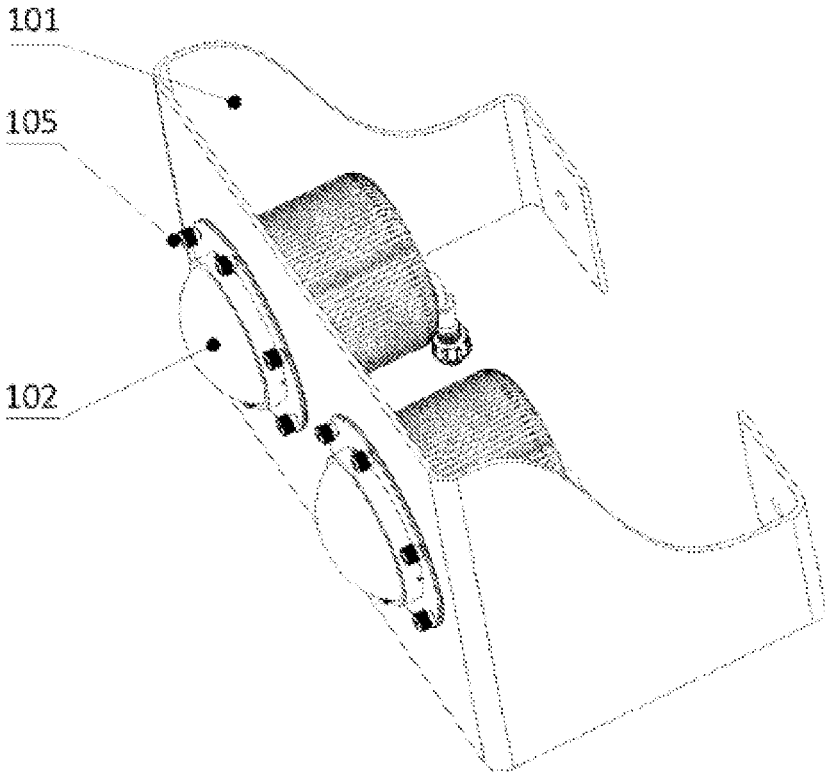
FIG. 80 is an external view of a transverse installation bracket plate adopted in embodiment 6 of the present invention.

Aiming at particularly severe environments, the lamp housing 101 in the present invention is further provided with a protection plate, as shown in FIG. 73 and FIG. 80.

Figure 74:
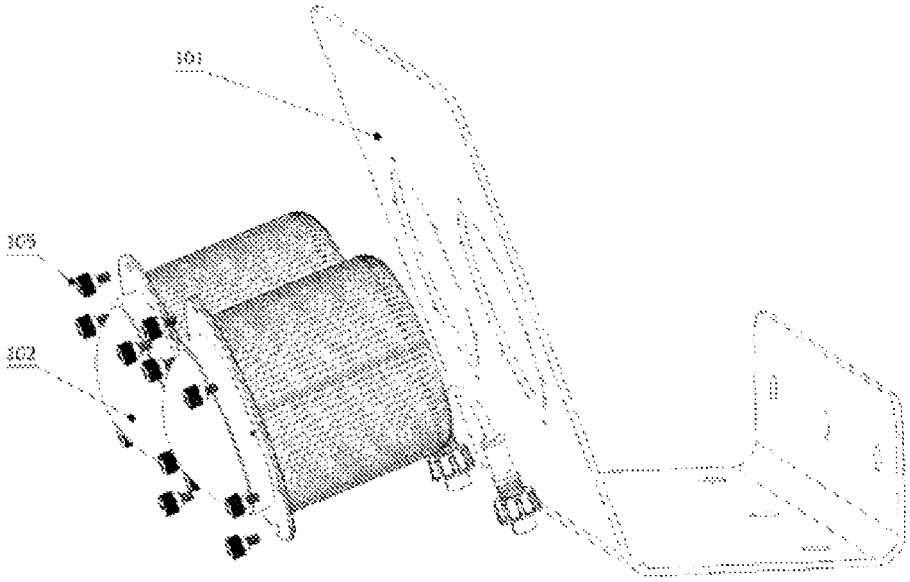
FIG. 74 is a schematic diagram of a structure when a plurality of LED bulbs are adopted in embodiment 6 of the present invention.
Figure 75:
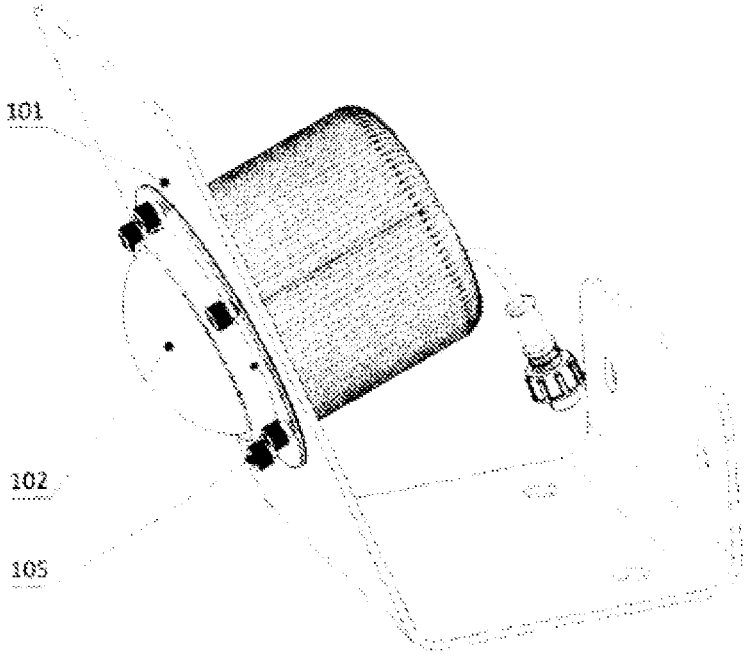
FIG. 75 is an external view of embodiment 2 in embodiment 6 of the present invention.
Figure 76:
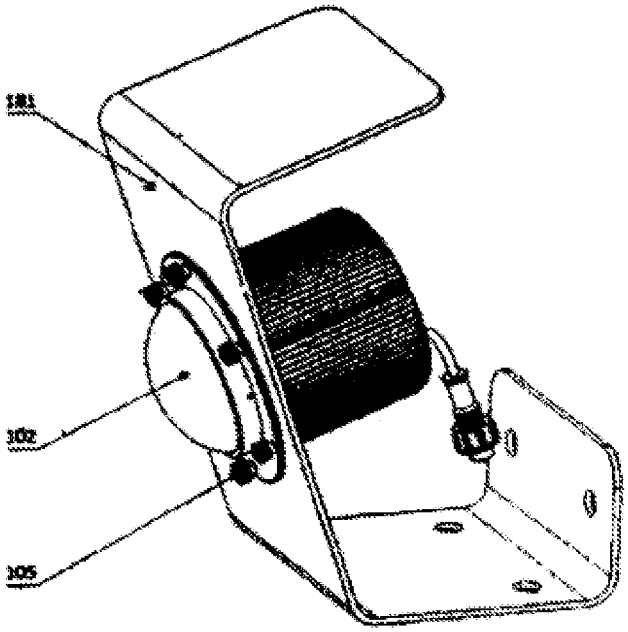
FIG. 76 is an external view when a protection plate is adopted in embodiment 6-2 of the present invention.
Figure 77:
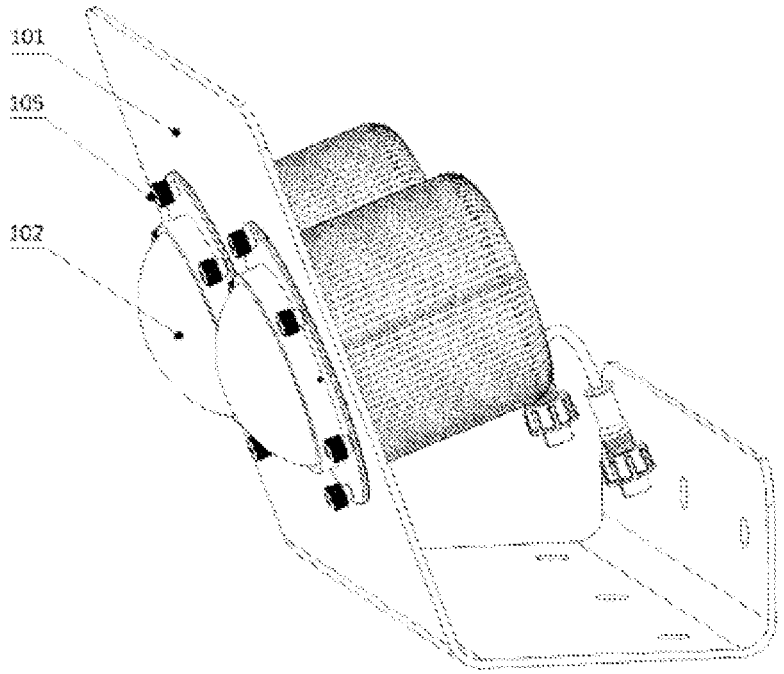
FIG. 77 is an external view when a plurality of LED bulbs are adopted in embodiment 6 of the present invention.
Figure 78:
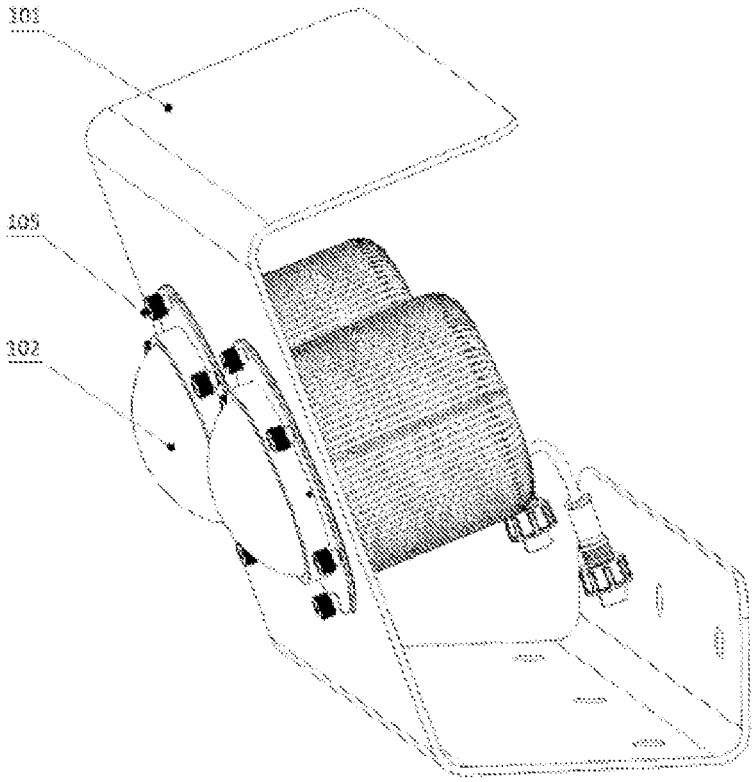
FIG. 78 is an external view when a plurality of LED bulbs and a protection plate are adopted in embodiment 6 of the present invention.

Aiming at the use environment with particular requirements on light intensity, a plurality of LED bulbs may also be adopted in the present invention, as shown in FIG. 74, FIG. 77 and FIG. 78.

Figure 79:
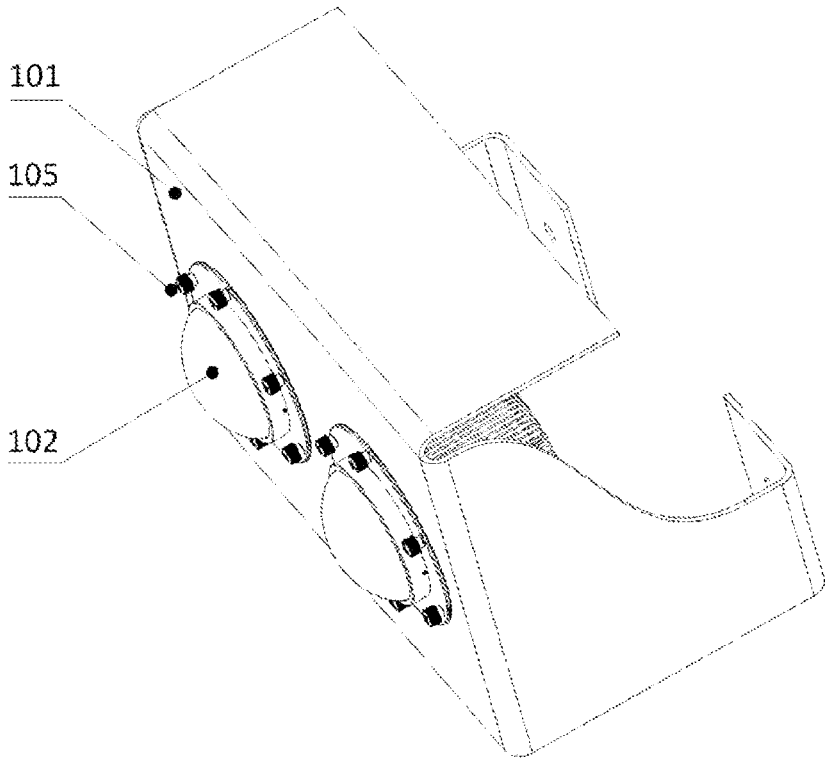
FIG. 79 is an external view when a plurality of LED bulbs, a transverse installation bracket plate and a protection plate are adopted in embodiment 6-2 of the present invention.

Aiming at the use environment with particular requirements on vertical ventilation, a transverse installation bracket plate may also be adopted in the present invention, as shown in FIG. 79 and FIG. 80.

The meanings of the reference numerals in the embodiment are as follows: 101—lamp housing, 102—LED bulb, 103—radiator, and 105—bulb fixing screw.

Embodiment 7

Figure 81:
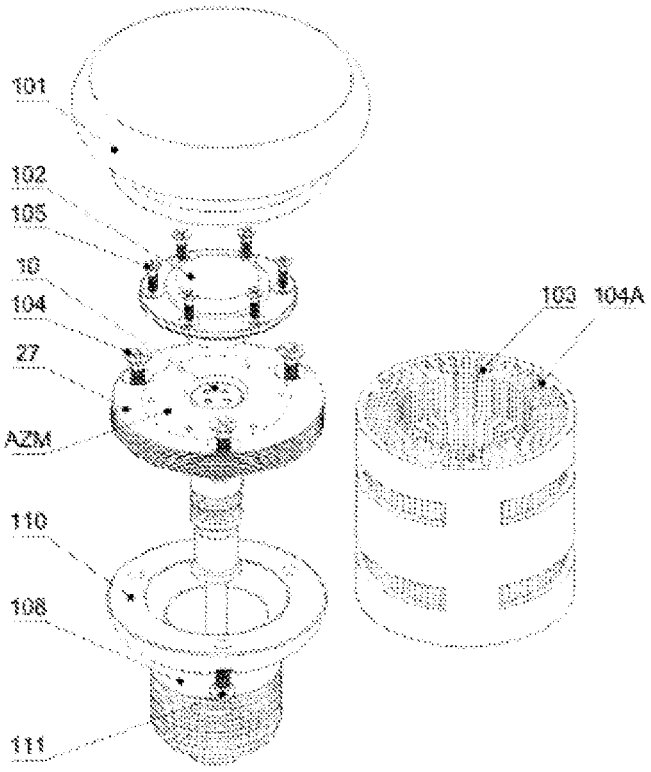
FIG. 81 is a schematic diagram of a structure of an LED screw lamp using a columnar radiator in embodiment 7 of the present invention.
Figure 82:
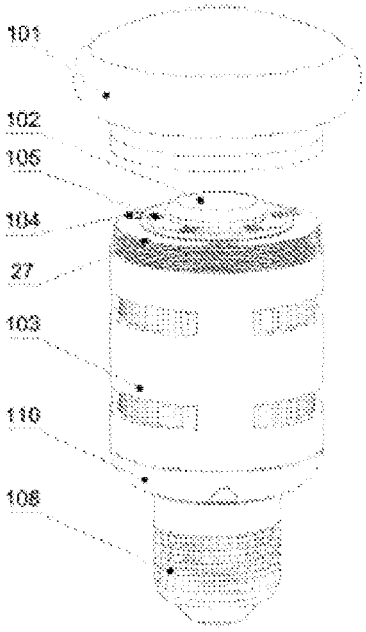
FIG. 82 is a schematic diagram of an outline structure of an LED screw lamp using a columnar radiator in embodiment 7 of the present invention.
Figure 83:
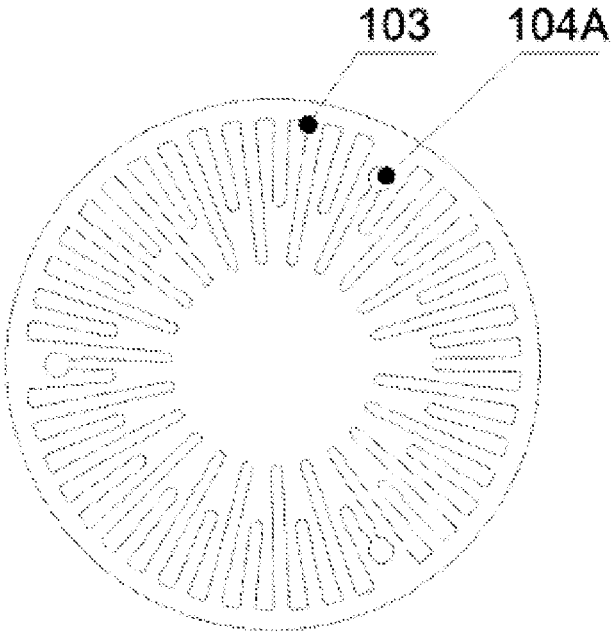
FIG. 83 is a schematic diagram of a sectional structure of the columnar radiator in embodiment 7 of the present invention.
Figure 84:
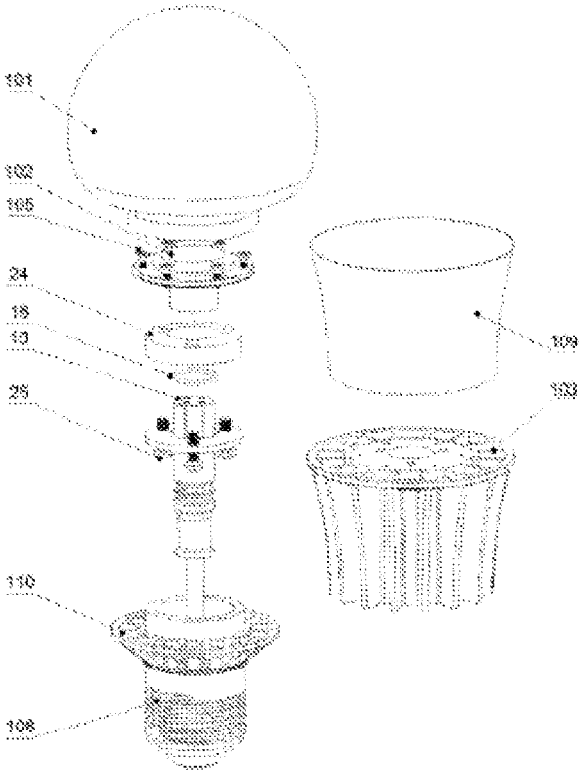
FIG. 84 is a schematic diagram of a structure of an LED screw lamp using a convection radiator in embodiment 7 of the present invention.
Figure 85:
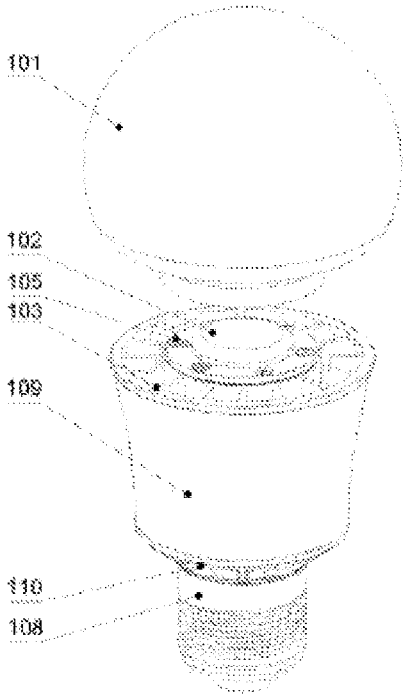
FIG. 85 is a schematic diagram of an outline of an LED screw lamp using the convection radiator in embodiment 7 of the present invention.
Figure 86:
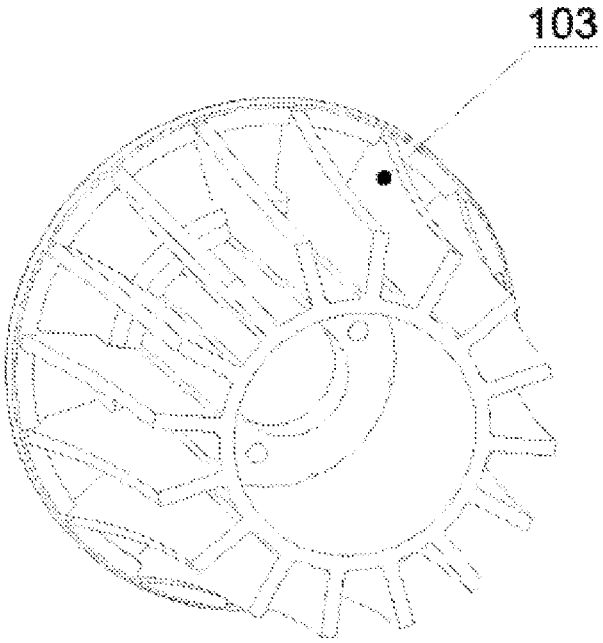
FIG. 86 is a schematic diagram of a structure of the convection radiator in embodiment 7 of the present invention.
Figure 87:
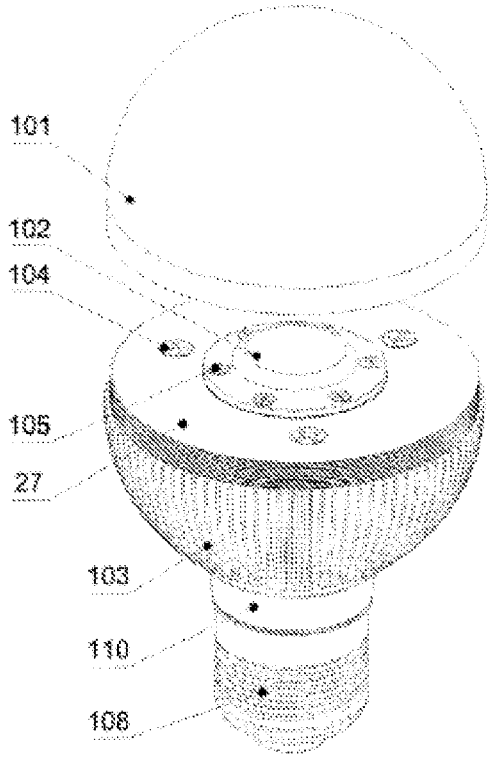
FIG. 87 is a first schematic diagram of an outline of an LED screw lamp using other radiators in embodiment 7 of the present invention.
Figure 88:
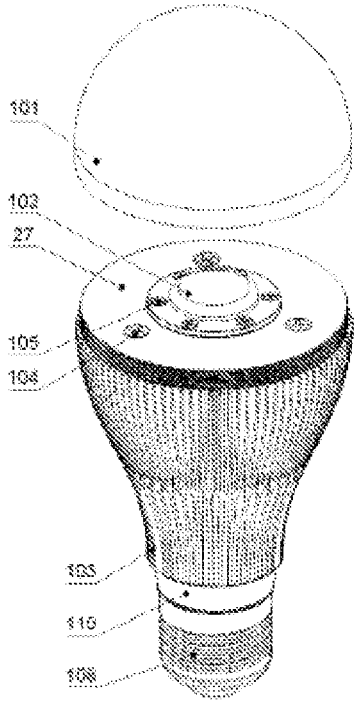
FIG. 88 is a second schematic diagram of an outline of an LED screw lamp using other radiator in embodiment 7 of the present invention.
Figure 89:
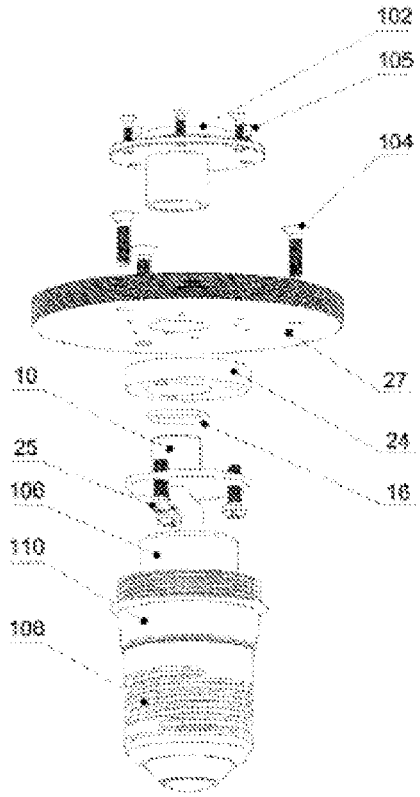
FIG. 89 is a schematic diagram of a structure of an LED screw lamp driven by a conventional power supply in embodiment 7 of the present invention.
Figure 90:
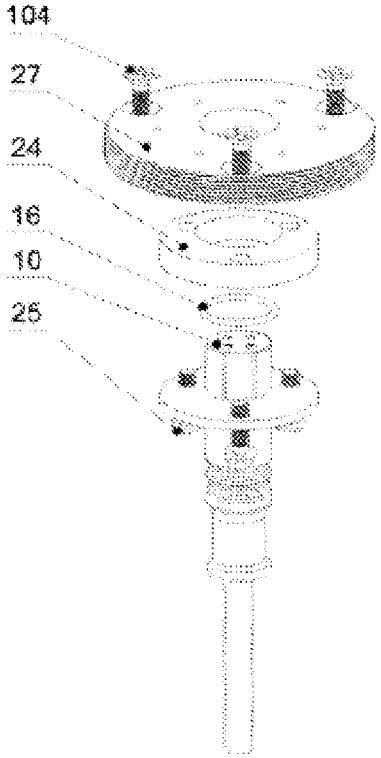
FIG. 90 is a schematic diagram of an installation structure of a connector socket in embodiment 7 of the present invention.

An LED screw lamp, as shown in FIG. 81, includes a screw lamp cap 108, a radiator 103, an LED bulb 102 and a lampshade 101; an intermediate connecting element 110 on the screw lamp cap 108 is connected to the radiator 103 through threads thereon, or through a lamp cap fixing screw 111 or in a direct adhesion manner; the LED bulb 102 is fixedly installed via a bulb fixing screw 105 with the radiator 103 or a heat conductive converting plate 27 (the heat conductive converting plate 27 is fixed in a fixing screw hole 104A on the radiator 103 through a fixing screw 104 for cooperative installation) on the radiator 103 as an installation interface AZM, and the lampshade 101 is connected to the radiator 103 or the heat conductive converting plate 27 in an adhesion, or threaded connection or clamping manner. The installation interface includes a surface in contact with the LED bulb 102 and a hole connected to the LED bulb on the radiator 103 or the heat conductive converting plate 27. The radiator 103 is a columnar radiator, as shown in FIG. 82 and FIG. 83, the radiator is provided with a radiator substrate thickness inwards from the maximal outer diameter of the cylinder and is provided with fins towards the center of the cylinder in a radial line, 2-3 layers of interrupted grooves are provided on the columnar radiator along a sealed circular arc with the substrate as thickness, after the radiator is heated, external air naturally flows into the center of the radiator through the interrupted grooves to form convection current, so as to achieve a cooling effect. The radiator 103 may also be a convection radiator, as shown in FIG. 84, FIG. 85 and FIG. 86, the radiator is provided with a radiator substrate thickness outwards from the cylindrical surface (using the outer diameter of a straightly fixed connector socket as the diameter) at the center and is provided with fins outwards from the substrate in a radial line, and an arc is formed on the surface of each fin upwards to gradually increase the overflow area; a radiator outer cover is covered on the surface of the each fin, and a plurality of through air flow channels are formed between the outer cover and the fins; after the radiator is heated, the air enters from the flow channel opening at the lower end and flows out from the flow channel opening at the higher end to form a chimney effect, in order to achieve air convection to dissipate heat. The screw lamp radiator may also adopt any shape, as long as the fixed connector socket and the installation interface are provided. For example, a sunflower radiator is manufactured into different shapes to obtain different screw lamp outlines, as shown in FIG. 87 and FIG. 88. For the LED solution in which a conventional power supply is adopted for driving, the driving power supply 106 may be provided at the central position between the screw lamp radiator 103 and the lamp cap 108, as shown in FIG. 89. The bulb outer cover 101 may adopt different shapes to obtain different appearance effects, for example, a mushroom head, a candle head, a round head and a flat head. A connector socket 10 is provided to the radiator 103 or the heat conductive converting plate 27, the connector socket 10 is cooperatively connected to a connector plug 11 on the LED bulb, a three-hole flange is provided to the connector socket 10, the connector socket is fixed with the radiator 103 or the heat conductive converting plate 27 through the three-hole flange and the fixing screw 25 of the connector socket, and a fixed adjusting rubber pad 24 is further provided between the flange and the radiator 103 or the heat conductive converting plate 27 to ensure the tightness of a waterproof surface; a conducting wire led out from the connector socket is welded on the lamp cap 108. The LED bulb 102 is constructed in the following manner: an optical engine module is adhered at the center of a heat conductive bracket provided with an installation flange; or a nonmetal heat conductive bracket provided with a flange is integrally manufactured with the optical engine module in the same material; the structure between the optical engine module and the heat conductive bracket is simple and smooth, being favorable for the heat dissipation of LED, and the LED bulb is installed on the installation interface through the flange.

The meanings of the reference numerals in the embodiment are as follows: 101—screw lamp housing, 102—LED bulb in the present invention, 103—radiator, 104—fixing screw, 104A—fixing screw hole, 105—bulb fixing screw, 106—driving power supply, 108—screw lamp cap, 109—radiator outer cover, 110—intermediate connecting element, 301—flange fixing hole, and AZM-installation interface.

Embodiment 8

Figure 91:
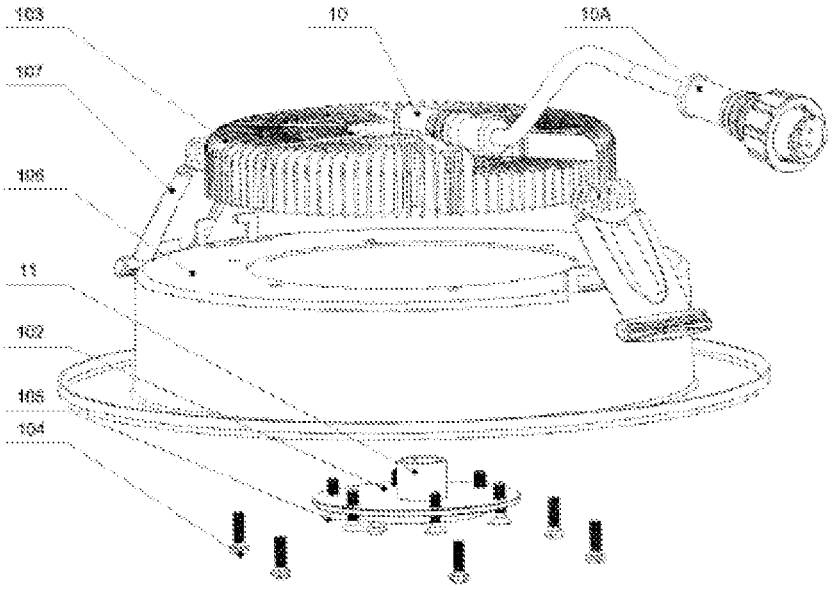
FIG. 91 is a schematic diagram of a structure of embodiment 8 of the present invention.
Figure 92:
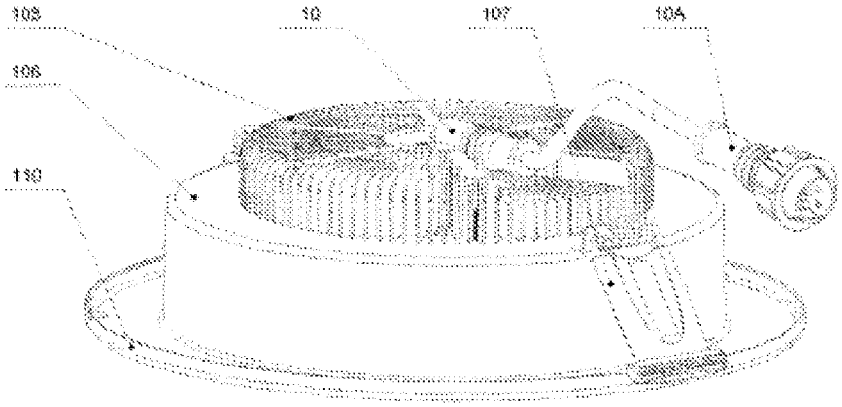
FIG. 92 is a vertical view of a structure of embodiment 8 of the present invention.
Figure 93:
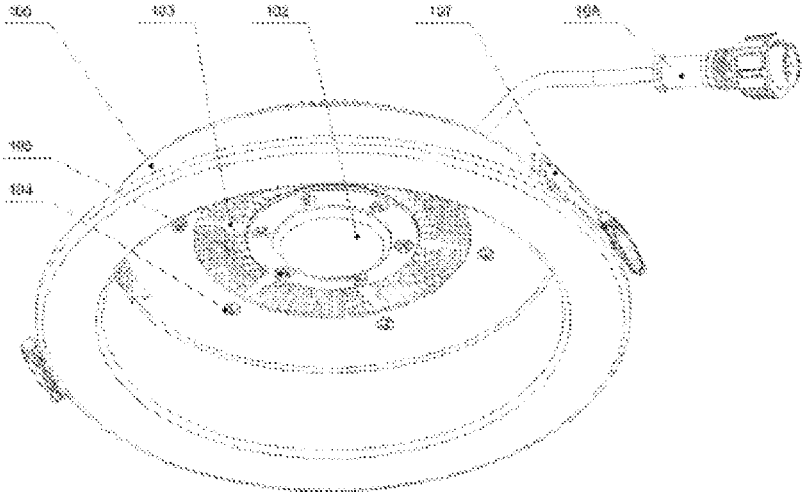
FIG. 93 is an upward view of embodiment 8 of the present invention.
Figure 94:
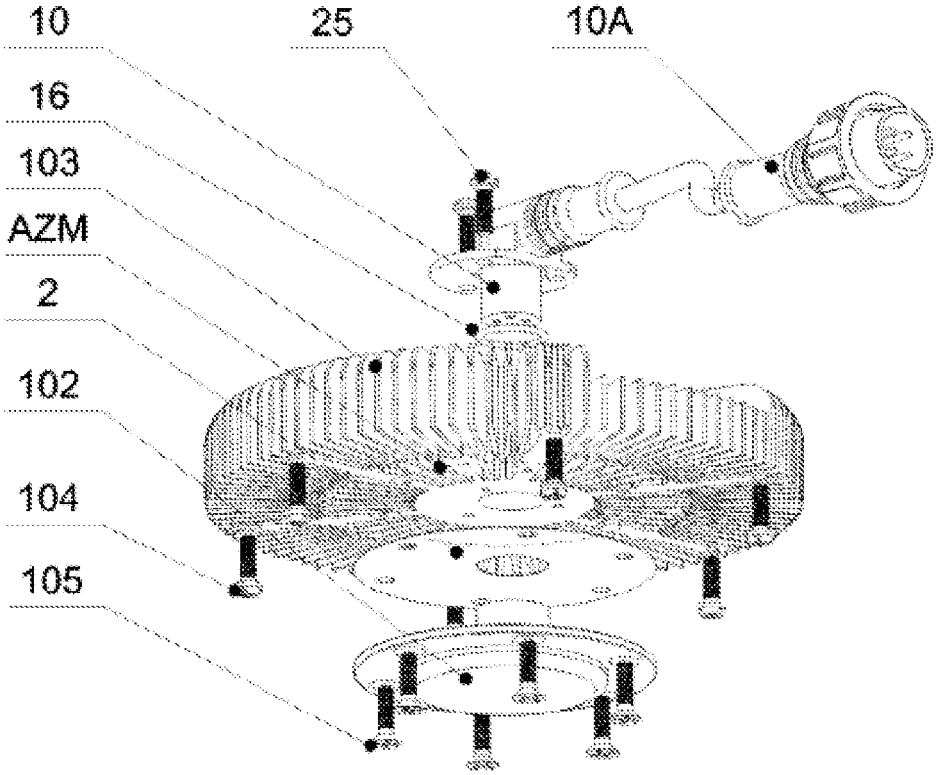
FIG. 94 is an assembly diagram of a radiator in embodiment 8 of the present invention.

An LED cylindrical lamp using a radiator as an installation interface, as shown in FIG. 91, FIG. 92 and FIG. 94, including a cylindrical lamp lamp, wherein the cylindrical lamp lamp includes a cylindrical lamp base 106, the radiator 103 and spring fixing clips 107, the spring fixing clips 107 are provided at the two sides of the cylindrical lamp base 106, and the radiator 103 is provided above the cylindrical lamp base 106; an installation interface AZM is provided at the center of the lower part of the radiator 103 for fixedly installing an LED bulb 102. The cylindrical lamp base 106 is circular, and the installation interface AZM includes a surface in contact with the LED bulb 102 and a hole connected to the LED bulb, on the radiator 103. The cylindrical lamp lamp further includes a lampshade piece 101 and a lampshade piece supporting cover 110; the lampshade piece 101 is provided beneath the base bracket 106, and the lampshade piece supporting cover 110 is provided beneath the lampshade piece 101. The cylindrical lamp lamp further includes an electric connector assembly; the electric connector assembly includes a connector socket 10, a fixing screw 25 of the connector socket and a fixed adjusting rubber pad 24; the connector socket 10 is cooperatively connected to a connector plug 11 on the LED bulb 102, a three-hole flange is provided to the connector socket 10, the connector socket is fixed with the radiator 103 through the three-hole flange and the fixing screw 25 of the connector socket, and the fixed adjusting rubber pad 24 is further provided between the flange and the radiator 103 to ensure the tightness of a waterproof surface. 6 flange fixing holes on the installation interface AZM of the radiator 103 are uniformly distributed at a diameter D1, and the diameter D1 is a value obtained by subtracting a diameter of a fixing screw cap and then subtracting a margin of 0.8-4 mm from the outer diameter D of the LED bulb 102. The radiator 103 is installed on the cylindrical lamp base 106 through a fixing screw 104, and the LED bulb 102 is installed on the installation interface AZM of the radiator 103 through a bulb fixing screw 105.

Figure 95:
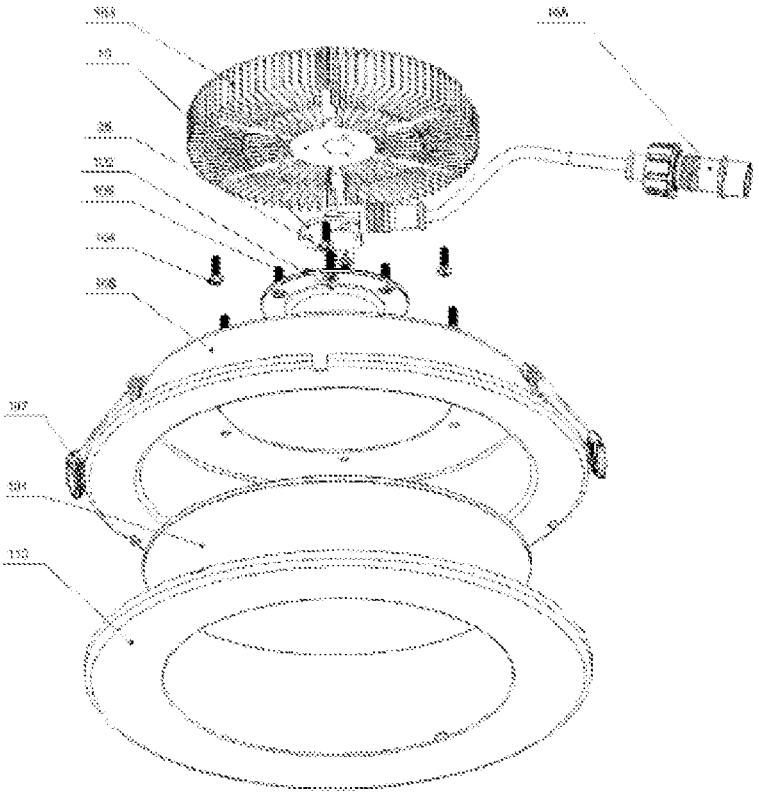
FIG. 95 is a schematic diagram of a structure when a lampshade piece supporting cover and a lampshade piece are adopted in embodiment 8 of the present invention.
Figure 103:
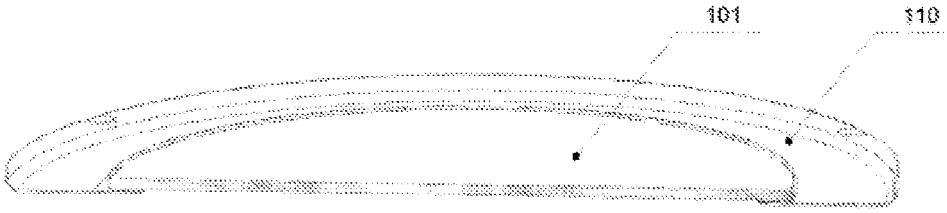
FIG. 103 is a schematic diagram when a lampshade piece supporting cover is combined with a lampshade piece in embodiment 8 of the present invention.
Figure 104:
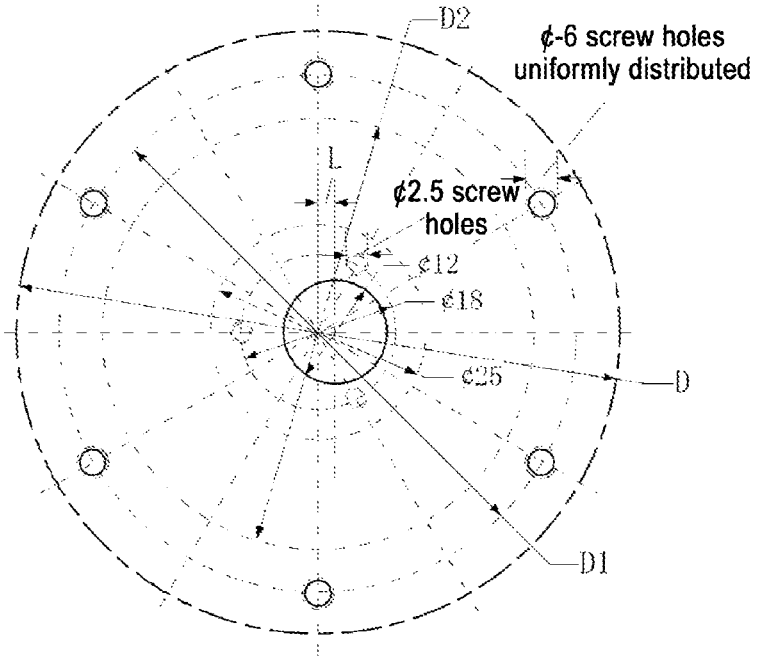
FIG. 104 is a schematic diagram of an installation interface for installing a bulb with outer diameter of 70 mm or less on a lamp in an embodiment of the present invention.

In the embodiment, the lampshade piece supporting cover 110 may also be provided beneath the cylindrical lamp base 106, the lampshade piece 101 is fixed to the lampshade piece supporting cover 110, and the lampshade piece supporting cover 110 is clamped on a notch of the cylindrical lamp base 106 through an edge projection, as shown in FIG. 95 and FIG. 103.

Figure 96:
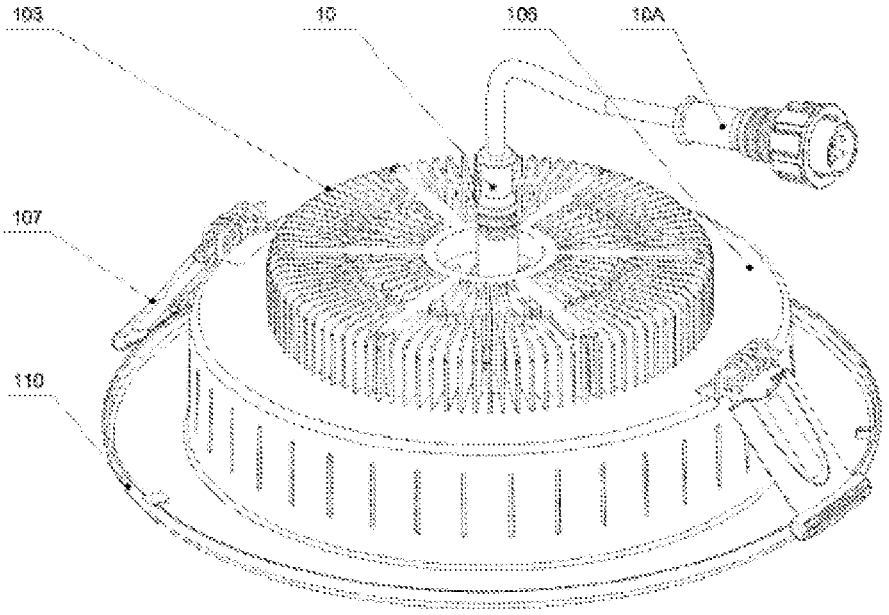
FIG. 96 is an external view when vent hole A is formed in the side part of the cylindrical lamp base in embodiment 8 of the present invention.

In the embodiment, a plurality of openings may also be provided on the side of the cylindrical lamp base 106, external air passes by the overflow gaps of the cooling fins of the radiator 103 through the openings on the side of the cylindrical lamp base 106 to form convection, in order to improve the radiating effect, as shown in FIG. 96.

Figure 97:
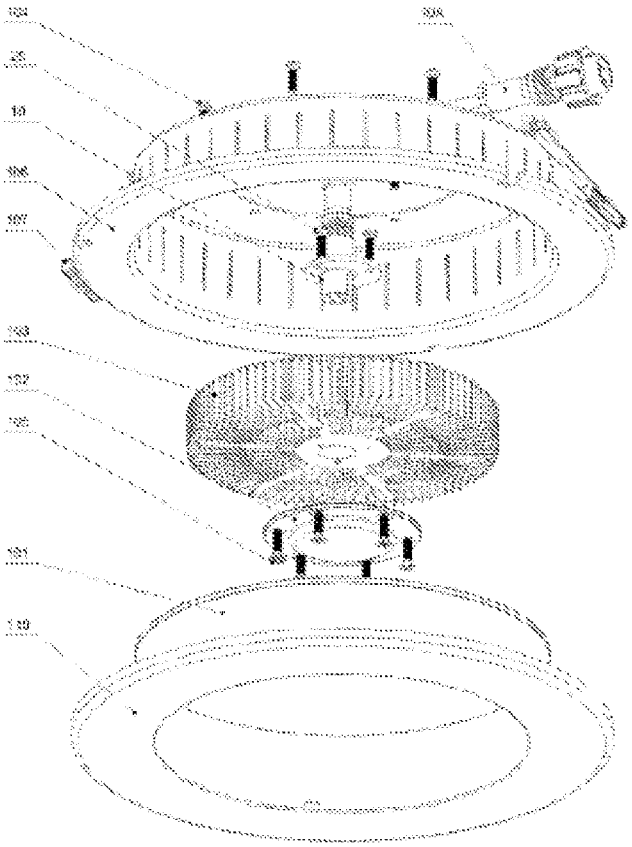
FIG. 97 is a schematic diagram of a structure when a radiator is installed on a bulb installation interface hole from the lower side of a cylindrical lamp base in embodiment 8 of the present invention.
Figure 98:
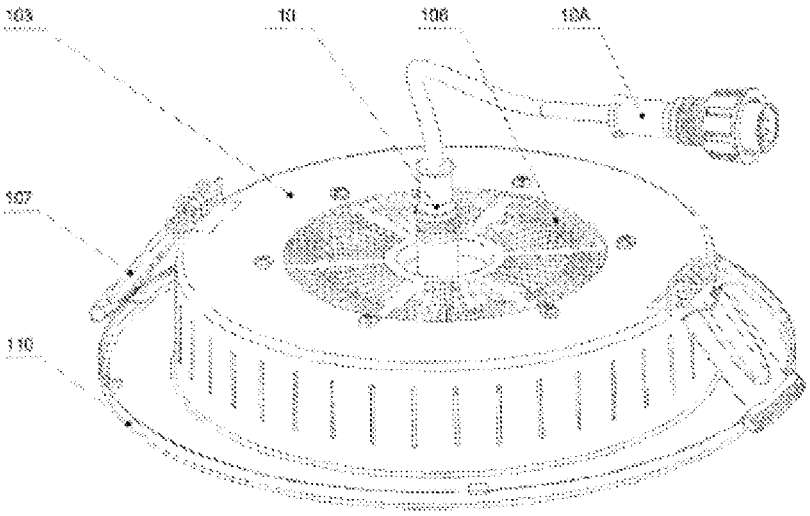
FIG. 98 is a vertical view when a radiator is installed on a bulb installation interface hole from a position below a cylindrical lamp base in embodiment 8 of the present invention.
Figure 99:
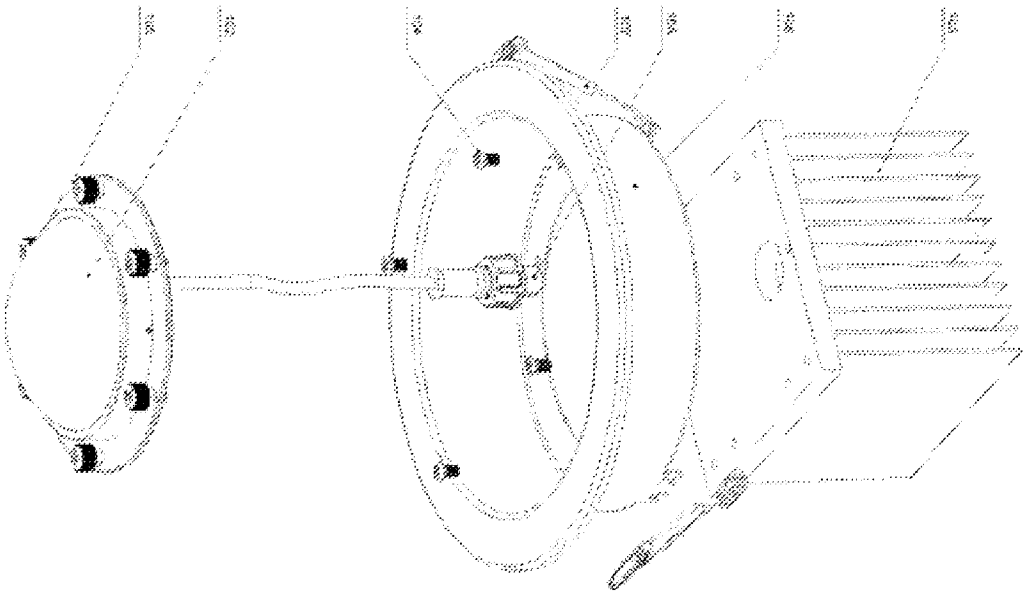
FIG. 99 is a schematic diagram of a structure when a non-sunflower radiator is adopted in embodiment 8 of the present invention.
Figure 100:
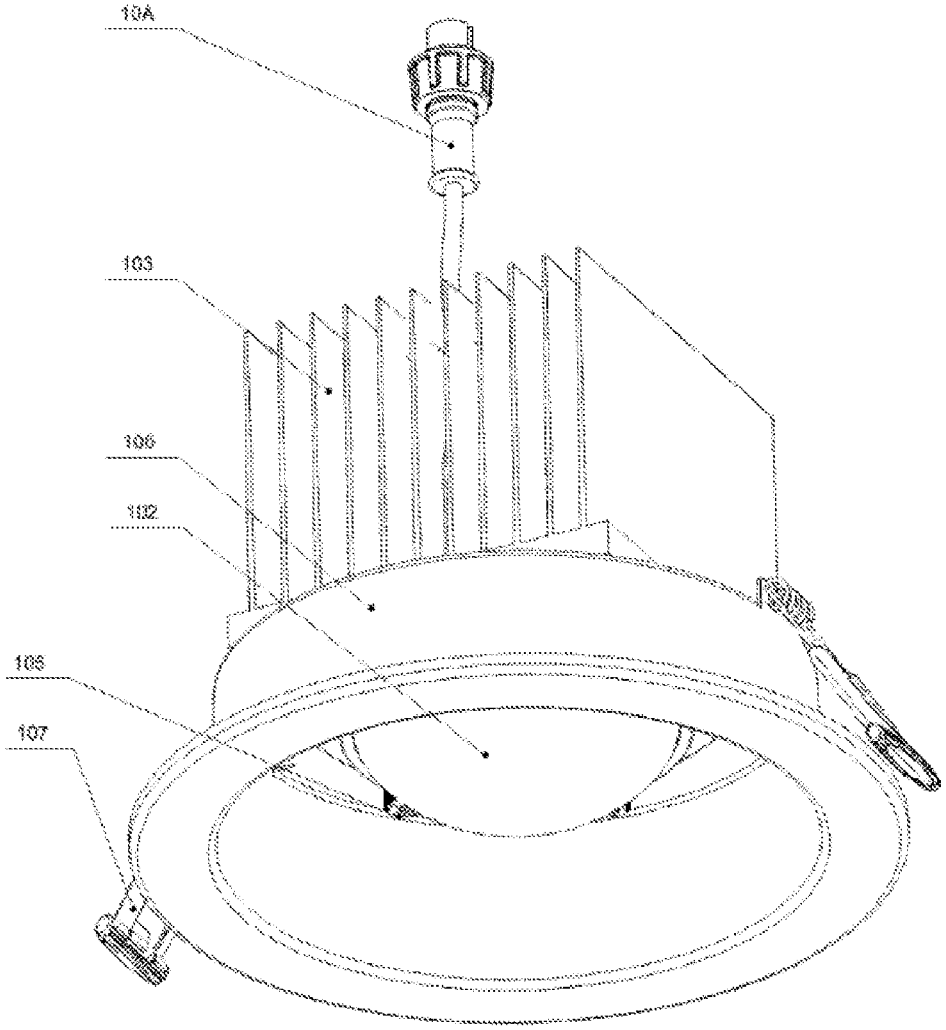
FIG. 100 is an upward view when a non-sunflower radiator is adopted in embodiment 8 of the present invention.
Figure 101:
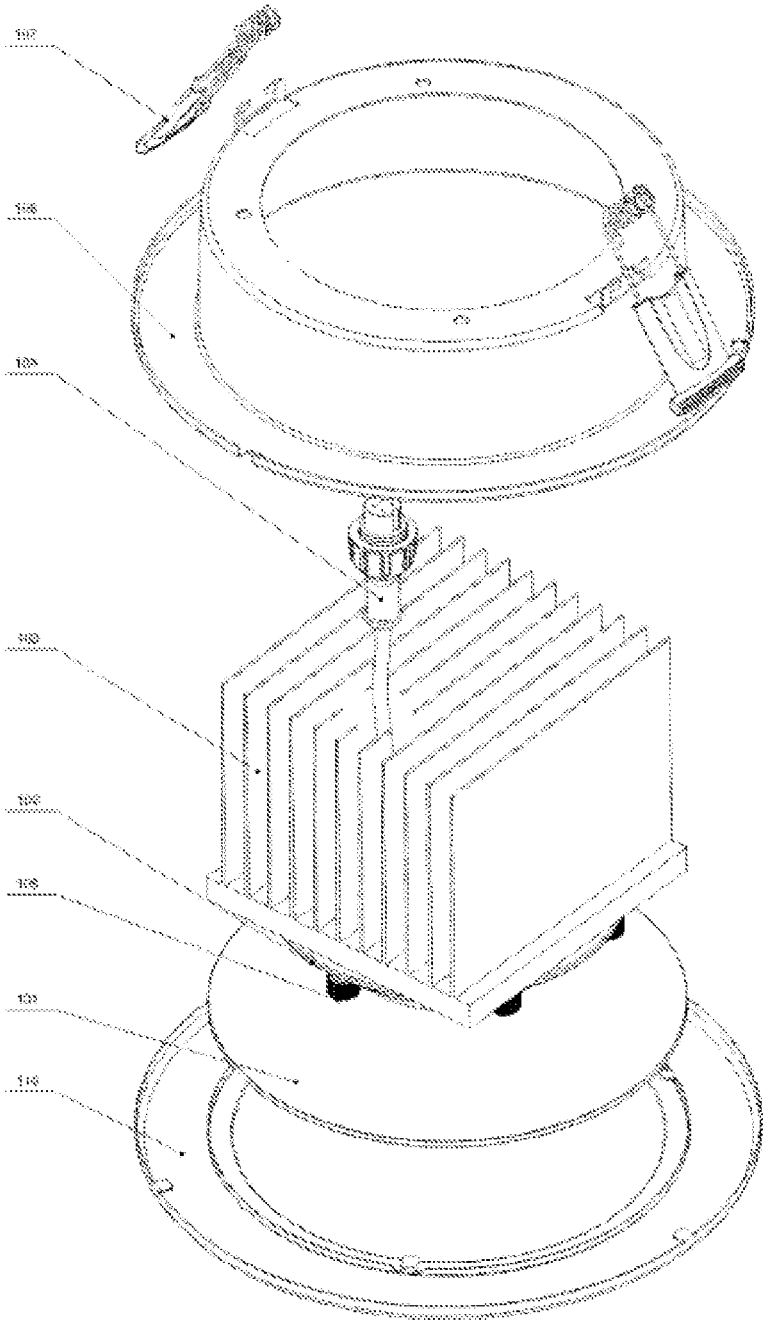
FIG. 101 is a schematic diagram of a structure when a non-sunflower radiator and a lampshade piece supporting cover and a lampshade piece are adopted in embodiment 8 of the present invention.
Figure 102:
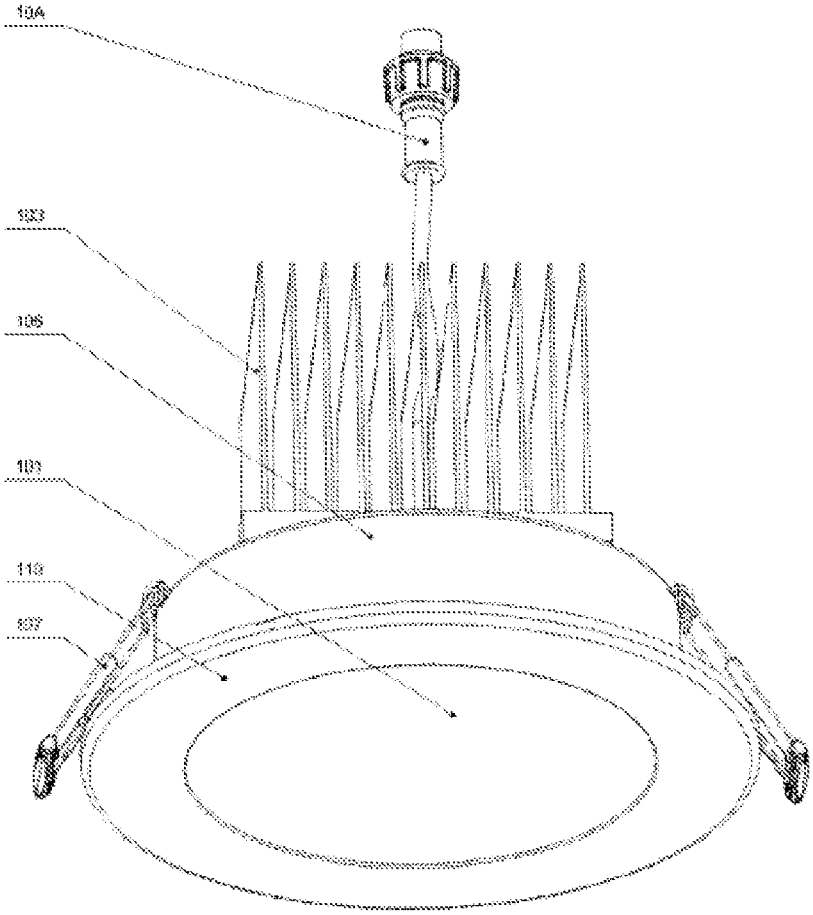
FIG. 102 is a vertical view when a non-sunflower radiator and a lampshade piece supporting cover and a lampshade piece are adopted in embodiment 8 of the present invention.

In the embodiment, the radiator 103 may also be installed on the bulb installation interface hole from a position below the cylindrical lamp base 106, and the LED bulb 102 does not penetrate through the bulb installation interface hole, as shown in FIG. 97, FIG. 98 and FIG. 99.

In the embodiment, the radiator 103 may also be a non-sunflower radiator but having overflow gaps, as shown in FIG. 99, FIG. 100, FIG. 101 and FIG. 102.

The lamp in the embodiment uses the cylindrical lamp base as the core, the LED bulb and all of other auxiliary components are overall collectively installed on the cylindrical lamp base, so that the structure is simple, the manufacturing cost is low and the installation, use and maintenance are convenient.

The meanings of the reference numerals in the embodiment are as follows: 101—lampshade piece, 102—LED bulb, 103—radiator, 104—fixing screw, 105—bulb fixing screw, 106—cylindrical lamp base, 107—spring fixing clip, 110—lampshade piece supporting cover, and 301—bulb installation flange fixing hole.

The invention claimed is:

1. A method for constructing a universal LED bulb, comprising:

establishing an optical engine core member of the LED bulb using a heat conductive bracket as a structure supporting main body of the bulb, and supportting the optical engine core member of the LED bulb using a thin-shelled lens snap ring in an auxiliary manner, wherein an installation flange hole is provided to the lens snap ring, correspondingly to a flange through hole of the heat conductive bracket, to surround and protect the heat conductive bracket for installing the bulb; the optical engine core member of the LED bulb is composed of the heat conductive bracket, an optical engine module, an inner snap ring and a light distribution optical lens, wherein an inner cover is provided outside the optical engine module, and an electric connector is provided to the heat conductive bracket; the optical engine module is made up of an optical engine die plate, an LED chipset and a relevant wiring by bonding and packaging, or is further integrated with a power supply drive chip.

2. The method for constructing the universal LED bulb of claim 1, wherein the diameter of the lens snap ring is a bulb outer diameter D, the bulb outer diameter D and an upper limit of power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve interchangeability and universality of the LED bulbs; on the relationship curve $W=1.1812e^{0.0361D}$ 20 mm is used as the lower limit of the bulb outer diameter D, 130 mm is used as the upper limit, each 10 mm is set as a segment, the relationship curve is divided into 12 segments to form a limited number of bulb outer diameter specifications, and interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the bulb outer diameter D; the diameter D2 of a radiator interface opening of the LED bulb on a lamp is a value obtained by subtracting two times of a diameter of a fixing screw cap and then subtracting two times of the margin corresponding to the diameter D1 from the bulb outer diameter D; the installation interface of the LED bulb includes a surface in contact with the LED bulb and a hole connected to the LED bulb, on the lamp.

3. The method for constructing the universal LED bulb of claim 1, wherein a radiator is provided to the heat conductive bracket, and a heat conductive pad is provided between the radiator and the heat conductive bracket; the radiator is a nonmetal radiator assembly, the nonmetal radiator assembly comprises a nonmetal radiator and a heat conductive converting bracket, the nonmetal radiator and the heat conductive converting bracket are obtained by extrusion forming an ultrafine nonmetal heat conductive material at a low temperature and sintering the same at a high temperature, the contact surfaces thereof are adhered into an integral piece by being coated with a heat conductive adhesive; a rubber sheath or screw fixing glue is filled in the fixing screw hole of the nonmetal radiator for connecting a fixing screw, and a radiator outer cover is provided outside the nonmetal radiator; the heat conductive converting bracket is overhead, the nonmetal radiator is of a screen mesh-shaped structure, and the nonmetal radiator is kept overhead by the heat conductive converting bracket, for enabling the air to enter the screen mesh of the nonmetal radiator from the heat conductive converting bracket; or the radiator is a metal radiator, the metal radiator has a hollow structure, a foam metal is filled in the hollow part, superconducting liquid is filled in the hollow structure, upper and lower stoppers are pressed by interference fit or screwed by a threaded seal gum in the hollow structure to form a sealed space, and the sealed space is vacuumized; a radiator fixing screw is penetrated through a fixing through hole on the inner snap ring so as to be connected to the radiator fixing screw hole of the nonmetal radiator or the metal radiator.

4. The method for constructing the universal LED bulb of claim 1, wherein a fixing hole of the connector plug is provided on the heat conductive bracket, a connector plug with a contact pin is inserted into the fixing hole of the connector plug and is fixed with the part inserted into the bulb as a fixed end, the tail end of the contact pin is welded with the optical engine die plate in the universal LED bulb, to form a simple electric interface on the outer surface of the universal LED bulb, during installation, as long as the connector plug is in butt joint with a connector socket with a cable, and the universal LED bulb is fixed, the electric connection of the universal LED bulb is achieved; the eccentric position of the hole of the connector plug on the heat conductive bracket and the size of the fixed end of the connector plug are defined, such that the optical engine die plate in the LED bulb may meet the demands of arranging the LED chip and the driving power supply chip and registering them; the connector plug with the contact pin is of a four-pin structure, wherein two pins are used for power supply access, and the other two pins are used for control access; the fixed end is in a nut fixing manner or a fusion ring fixing manner; when the fixed end is in the nut fixing manner, a waterproof rubber ring is added between the connector plug and the heat conductive bracket to prevent water; in order to prevent rotation, an antiskid groove is provided to the connector plug, and a corresponding projection is provided at the through hole of the heat conductive bracket; a three-hole flange is provided to the connector socket and is fixed to the lamp radiator through a fixing screw, and an adjusting rubber pad is provided between the connector socket and the radiator to adjust the thickness, in order to ensure the tightness of a waterproof surface; or external threads are provided to the connector plug to match with the internal threads of the fixing nut on the connector socket provided with the waterproof rubber ring to prevent water; a slot is provided to the connector socket, and the waterproof rubber ring is provided in the slot to prevent water.

5. A flange snap ring type LED bulb, comprising: a thin-shelled lens snap ring (8), wherein at least a heat conductive bracket (3) with a flange hole, an optical engine module (4), an inner snap ring (81) and a light distribution optical lens (7) are provided in the lens snap ring (8) sequentially; a connector plug (11) is fixed to the heat conductive bracket (3), and an inner cover (6) is further provided outside the optical engine module (4); an installation flange hole is provided to the heat conductive bracket (3), the thin-shelled lens snap ring (8) corresponds to the installation flange hole of the heat conductive bracket and protects the heat conductive bracket (3), the optical engine module (4) is made up of an optical engine die plate, an LED chip and a relevant wiring by bonding and packaging, or is further integrated with a power supply drive chip.

6. The flange snap ring type LED bulb of claim 5, wherein the inner snap ring (81) surrounds the optical engine module (4), or an inner ring cover (62) is further provided between the inner snap ring (81) and the inner cover (6), the upper part of the inner snap ring (81) is connected to the heat conductive bracket (3), the lower part of the inner snap ring is adhered with the light distribution optical lens (7), a sealed waterproof space for enclosing the optical engine module (4) is formed by the three components, or the inner snap ring (81) is further used as the installation base of an LED bulb radiator; when the lens snap ring (81) is installed, it may be ensured the upper surface of the heat conductive bracket (3) closely leans against the radiator (103); or, the heat conductive bracket (3) and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

7. The flange snap ring type LED bulb of claim 5, wherein the heat conductive bracket (3), the optical engine module (4), the inner snap ring (81) and the light distribution optical lens (7) are sequentially overlapped and adhered, or the inner ring cover (62) is further provided between the inner snap ring (81) and the inner cover (6), and the optical engine die plate of the optical engine module (4), the inner snap ring (81) and the light distribution optical lens (7) form a sealed waterproof space used for packaging components packaged on the optical engine die plate; or, the inner snap ring (81) and the inner cover (6) are processed to an inner cover (68) with a function of the inner ring and having an integral structure; or the inner snap ring (81) is further used as the installation base of the LED bulb radiator; when the lens snap ring (81) is installed, it can be ensured the upper surface of the heat conductive bracket (3) tightly leans against the radiator (103); or the heat conductive bracket (3) and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

8. The flange snap ring type LED bulb of claim 5, wherein a radiator (103) is provided to the heat conductive bracket (3), and a heat conductive pad (2) is provided between the radiator (103) and the heat conductive bracket (3), the radiator (103) is a nonmetal radiator assembly, the nonmetal radiator assembly comprises a screen mesh-shaped nonmetal radiator and an overhead heat conductive converting bracket (1) at the lower side thereof, a rubber sheath or screw fixing glue is filled in the radiator fixing screw hole (33) of the nonmetal radiator for connecting a fixing screw, a radiator outer cover (101) is provided outside the nonmetal radiator; or the radiator (103) is a metal radiator, the metal radiator includes a cooling fin (34), a superconducting fluid cavity is provided at the middle of the cooling fin (34), a foam metal (37) is filled in the superconducting fluid cavity and superconducting fluid is filled therein, an upper stopper (33) and a lower stopper (35) are provided on two ends of the superconducting fluid cavity, and a vacuum suction pipe (32) is provided to the upper stopper (33) or the lower stopper (35); a cable hole (36) used for penetration of a cable and a radiator fixing screw hole (38) are further provided to the radiator (103).

9. The flange snap ring type LED bulb of claim 5, wherein only transparent silica gel for package is provided outside the LED chip on the optical engine module (4), the inner cover (6) is provided outside the optical engine module (4) with the transparent silica gel, and fluorescent powder coating is provided to the inner layer of the inner cover (6); or, no silica gel is packaged on the LED chip on the optical engine module (4), a concave inner cover (61) filled with transparent insulating heat conductive liquid is provided outside the optical engine module (4), the LED chip on the optical engine module (4) is soaked in the transparent insulating heat conductive liquid, fluorescent powder is provided in the transparent insulating heat conductive liquid, and the concave inner cover is an elastic inner cover of a thin concave structure.

10. The flange snap ring type LED bulb of claim 5, wherein an electric connector is provided beneath the heat conductive bracket (3), the electric connector comprises a connector plug (11), a contact pin (17) is provided to the connector plug (11), and a contact pin welding spot (19) on the tail end of the contact pin (17) is welded with the optical engine module (4); after penetrating through a fixing hole (22) of the connector plug on the universal LED bulb, the connector plug (11) is fixed with a fixed end (15); the connector plug (11) is cooperatively connected to a connector socket (10) with a jack, and the connector socket (10) is connected to a cable; the contact pin of the electric connector is of a four-pin structure in which two pins are used for power supply access and the other two pins are used for control access;

wherein the fixed end (15) is a fusion ring or the fixed end (15) is a fixing nut, a waterproof rubber ring slot (18) is further provided to the connector plug (11), and a waterproof rubber ring (16) is provided in the waterproof rubber ring slot (18); in order to prevent rotation, an antiskid groove (26) is provided to the connector plug (11), and a corresponding projection is provided at the through hole of the heat conductive bracket (3); a three-hole flange is provided to the connector socket (10), and the connector socket is fixed with the radiator (103) or a heat conductive converting plate (27) on the lamp through the three-hole flange and a fixing screw (25) of the connector socket, and a fixed adjusting rubber pad (24) is provided between the flange and the radiator (103) or the heat conductive converting plate (27) on the lamp to ensure tightness of a waterproof surface; or the connector plug (11) is provided with external threads to match with the internal threads of the fixing nut (28) on the connector socket (10) provided with the waterproof rubber ring (16) so as to be fixed to the connector plug (11); a slot is provided to the connector socket (10), and the waterproof rubber ring (16) is provided in the slot.

11. A lamp using the LED bulb of claim 5, comprising an installation interface, wherein the LED bulb is provided on the installation interface.

12. The lamp of claim 11, wherein the lamp is an LED street lamp, a multifunctional lamp housing is adopted as an installation interface bracket structure, the LED tunnel lamp comprises the multifunctional lamp housing (101) punch formed by sheet metal via a stamping process, the multifunctional lamp housing (101) is fixed to a lamp post (108) through a lamp post fixing element; one or more installation interface hole used for installing extrusion type radiators (103) is provided to the multifunctional lamp housing (101); an installation interface used for installing an LED bulb (102) is provided to each extrusion type radiator (103), the LED bulb (102) is provided to the installation interface, and the LED bulb (102) and the installation interface are provided in a one-to-one correspondence manner.

13. The lamp of claim 12, wherein a wire harness connector (106) is provided to the multifunctional lamp housing (101), and the wire harness connector (106) is used for connecting a plurality of LED bulbs (102) to a power supply and a control circuit; an edgefold for reinforcing the structural strength is further provided at the edge of the multifunctional lamp housing (101);

wherein the lamp post fixing element comprises a lamp post fixing bracket (112), a lamp post fixing bracket bolt (111) and a reinforcing plate (110), the lamp post fixing bracket (112) and the reinforcing plate (110) are provided on upper and lower sides of the multifunctional lamp housing (101) respectively; the multifunctional lamp housing (101) is fixed to the lamp post (108) through the lamp post fixing bracket (112) and the reinforcing plate (111);

wherein the extrusion type radiator (103) includes a substrate, and fins are provided on one side of the substrate; the installation interface used for installing the LED bulb (102) is provided at the other side of the substrate; the installation interface includes a surface in contact with the LED bulb (102) and a hole connected to the LED bulb, on the extrusion type radiator (103).

14. The lamp of claim 11, wherein the lamp is an LED street lamp, the LED street lamp comprises a double-faced radiator (103) extrusion formed by a metal, an installation interface is provided to the double-faced radiator (103), an LED bulb (102) is provided to the installation interface, and the double-faced radiator (103) is installed on a lamp post (108); a lamp housing (101) extrusion formed by a metal or die cast by plastics is provided outside the double-faced radiator (103); the LED street lamp using the double-faced radiator structure further comprises a wire harness connector (106), and the wire harness connector (106) is used for connecting a plurality of LED bulbs (102) to a power supply and a control circuit.

15. The lamp of claim 14, wherein the double-faced radiator (103) comprises a substrate, fins are provided at the two sides of the substrate, and a cable hole is provided to the substrate; the installation interface used for installing the LED bulb (102) is provided on one side of the substrate, and circular or elliptic conical spaces are formed by cutting the fins around the installation interface of the substrate according to the illumination angle of the light emitted by the bulb to the extent of not shading the light emitted by the LED bulb (102); a conducting wire bracket (112) is provided on the other side of the substrate, and the conducting wire bracket (112) is used for connecting a conducting wire led out from the LED bulb (102) to a power supply and a control circuit; the installation interface includes a surface in contact with the LED bulb (102) and a hole connected to the LED bulb, on the extrusion type double-faced radiator (103);

wherein one side of the substrate of the double-faced radiator (103) is connected to an L-shaped connecting plate (110), and the L-shaped connecting plate (110) is connected to the lamp post (108); the wire harness connector (106) is provided to the double-faced radiator (103);

wherein a bracket installation hole is provided to the substrate or the center of the double-faced radiator (103), and the double-faced radiator (103) is fixed to the lamp post (108) by a street lamp installation fixing bolt (109) by means of the bracket installation hole and a lamp post fixing ring (116); the wire harness connector (106) is provided in the lamp post (108) connected to the double-faced radiator(103).

16. The lamp of claim 11, wherein the lamp is an LED street lamp, a lamp housing is adopted as an installation interface bracket structure, the LED street lamp comprises the lamp housing (101) punch formed by sheet metal via a stamping process, an installation interface is provided to the lamp housing (101), an LED bulb (102) is provided to the installation interface, the lamp housing (101) is fixed to a lamp post (108) by a lamp post fixing element, and a decorative cover (103) is provided to the lamp housing (101).

17. The lamp of claim 16, wherein the lamp housing (101) is elliptic, edgefolds for reinforcing the structural strength are provided at the inner and outer edges of the lamp housing (101), and the installation interface includes a surface in contact with the LED bulb (102) and a hole connected to the LED bulb, on the lamp housing (101);

the lamp further comprises a wire harness connector (106), wherein the wire harness connector (106) is provided to the decorative cover (103), and the wire harness connector (106) is used for connecting a plurality of LED bulbs (102) to a power supply and a control circuit;

wherein the lamp post fixing element comprises a lamp post fixing bracket (112), a lamp post fixing bracket bolt (111) and a reinforcing plate (110), the lamp post fixing bracket (112) and the reinforcing plate (110) are provided on upper and lower sides of the lamp housing (101) respectively; the lamp housing (101) is fixed to the lamp post (108) through the lamp post fixing bracket (112) and the reinforcing plate (111).

18. The lamp of claim 11, wherein the lamp is an LED street lamp, a lamp housing with a radiator is adopted as an installation interface bracket structure, the LED street lamp comprises the lamp housing (103) with the radiator and formed by a metal in a die casting process, one or more installation interface is provided to the lamp housing (103) with the radiator, an LED bulb (102) is provided to the installation interface, the lamp housing (103) with the radiator is connected to a lamp post (108) through a lamp post fixing bracket (112), a wire harness connector (106) is provided at the upper part of the lamp post fixing bracket (112), and the wire harness connector is used for connecting a plurality of LED bulbs (102) to a power supply and a control circuit.

19. The lamp of claim 18, wherein a substrate is provided at the central part of the lamp housing (103) with the radiator, fins are provided on one side of the substrate, overflow gaps exist between the fins, and the overflow gaps enable the air to fully contact the fins to reinforce the radiating effect; the installation interface used for installing the LED bulb (102) is provided on the other side of the substrate; the installation interface includes a surface in contact with the LED bulb (102) and a hole connected to the LED bulb, on the lamp housing (103) with the radiator;

wherein the lamp further comprises an outer cover (101), a waterproof rubber ring (113) and a waterproof sealing gland (114); the outer cover (101) is provided at the lower part of the lamp housing (103) with the radiator, the outer cover (101) is provided outside the installation interface, and the waterproof sealing gland (114) is pressed outside the outer cover (101) surrounded by the waterproof rubber ring (113), in order to improve the water resistance of the outer cover (101).

20. The lamp of claim 11, wherein the lamp is an LED lighting lamp, the LED lighting lamp comprises an installation interface bracket combined member, an LED bulb (102) provided with a radiator is provided to the installation interface bracket combined member; a lamp housing (101) punch formed by a metal or die cast by plastics is provided outside the installation interface bracket combined member; the installation interface bracket combined member comprises a pipe bracket (108) formed by segmenting a standard pipe, a lamp fixing flange (106) and a lamp housing and bulb fixing bracket (110) which are connected, an installation interface used for installing the LED bulb (102) is provided to the lamp housing and bulb fixing bracket (110), and the pipe bracket (108) is connected to the lamp fixing flange (106) and the lamp housing and bulb fixing bracket (110); the lamp fixing flange (106) is a flat panel flange or an arched flange; the lamp housing (101) is connected to the installation interface bracket combined member through the lamp housing and bulb fixing bracket (110).

21. The lamp of claim 20, wherein the installation interface includes a surface in contact with the LED bulb (102) and a hole connected to the LED bulb, on the lamp housing and bulb fixing bracket (110); the lamp housing and bulb fixing bracket (110) is punch formed by a metal, the pipe bracket (108) is connected to the center of the lamp housing and bulb fixing bracket (110), the lamp housing and bulb fixing bracket (110) is engraved to be hollow around its portion connected to the pipe bracket (108), so that passage of a cable and formation of a chimney effect in the lamp housing are facilitated so as to ensure the ventilating and radiating effects, and a screw hole used for installing the lamp housing (101) is provided at the edge of the lamp housing and bulb fixing bracket (110).

22. The lamp of claim 11, wherein the lamp is an LED tunnel lamp, a lamp housing is used as an installation interface bracket structure, the LED tunnel lamp comprises a lamp housing (101) formed by a metal stamping or plastics die casting process, one or more installation interface used for installing an LED bulb (102) provided with a radiator is provided to the lamp housing (101); the lamp housing (101) comprises an installation interface bracket plate used for installing the LED bulb (102), and the installation interface used for installing the LED bulb (102) is provided to the installation interface bracket plate; a foot screw hole used for fixedly installing the entire LED tunnel lamp is provided to the lamp housing (101);

wherein a protection plate is further provided to the lamp housing (101); the installation interface includes a surface in contact with the LED bulb (102) and a hole connected to the LED bulb, on the lamp housing (101).

23. The lamp of claim 11, wherein the lamp is an LED screw lamp, an installation interface is provided to a radiator (103) of the LED screw lamp or a heat conductive converting plate (27) connected to the top of the radiator (103), for fixedly installing an LED bulb (102), and the lampshade (101) of the LED screw lamp is connected to the radiator (103) or the heat conductive converting plate (27) in an adhesion, threaded connection or clamping manner; the installation interface includes a surface in contact with the LED bulb (102) and a hole connected to the LED bulb, on the radiator (103) or the heat conductive converting plate (27);

wherein the LED screw lamp comprises a screw lamp cap (108), an intermediate connecting element (110), the radiator (103), the lampshade (101), or further comprises a driving power supply (106) provided in the screw lamp cap (108); an electric connector assembly is provided at a position where the LED bulb (102) and the LED screw lamp are connected; the intermediate connecting element (110) on the screw lamp cap (108) is connected to the radiator (103) through threads thereon, or through a lamp cap fixing screw (111) or in a direct adhesion manner; or the heat conductive converting plate (27) is further provided to the radiator (103).

24. The lamp of claim 23, wherein the electric connector assembly comprises a connector socket (10), a fixing screw (25) and an adjusting rubber pad (24); the connector socket (10) is cooperatively connected to a connector plug (11) on the LED bulb, a three-hole flange is provided to the connector socket (10), the connector socket is fixed with the radiator (103) or the heat conductive converting plate (27) through the three-hole flange and the fixing screw (25) of the connector socket, and a fixed adjusting rubber pad (24) is further provided between the flange and the radiator (103) or the heat conductive converting plate (27) to ensure tightness of a waterproof surface; a conducting wire led out from the connector socket is welded on the lamp cap (108);

wherein the radiator (103) is a columnar radiator, the radiator has a radiator substrate thickness provided inwards from the maximal outer diameter of the cylinder and is provided with fins formed towards the center of the cylinder in a radial line, 2-3 layers of interrupted grooves are provided on the columnar radiator along an enclosed circular arc with the substrate as thickness, after the radiator is heated, external air naturally flows into the center of the radiator through the interrupted grooves to form convection so as to achieve a cooling effect;

or the radiator (103) is a convection radiator, the radiator has a radiator substrate thickness provided outwards from the cylindrical surface at the center and is provided with fins formed outwards from the substrate in a radial line, and the surface of each fin is formed into an arched shape to gradually increase the open area; the surface of the each fin is covered with a radiator outer cover, and a plurality of through air flow channels are formed between the outer cover and the fins; after the radiator is heated, the air enters from the flow channel opening on the lower end and flows out of the radiator from the flow channel opening on the higher end to form a chimney effect in order to achieve air convection for heat dissipation.

25. The lamp of claim 11, wherein the lamp is an LED cylindrical lamp, a radiator is used as the installation interface, the LED cylindrical lamp comprises a cylindrical lamp base (106), the radiator (103) and spring fixing clips (107), the spring fixing clips (107) are provided on two sides of the cylindrical lamp base (106), and the radiator (103) is provided above the cylindrical lamp base (106); an installation interface (AZM) is provided at the center of the lower part of the radiator (103) for fixedly installing an LED bulb (102);

wherein the cylindrical lamp base (106) is circular, and the installation interface (AZM) includes a surface in contact with the LED bulb (102) and a hole connected to the LED bulb, on the radiator (103);

wherein the LED cylindrical lamp further comprises a lampshade piece (101) and a lampshade piece supporting cover (110); the lampshade piece (101) is provided beneath the base bracket (106), and the lampshade piece supporting cover (110) is provided beneath the lampshade piece (101);

wherein the LED cylindrical lamp further comprises an electric connector assembly; the electric connector assembly comprises a connector socket (10), a fixing screw (25) of the connector socket and a fixed adjusting rubber pad (24); the connector socket (10) is cooperatively connected to a connector plug (11) on the LED bulb (102), a three-hole flange is provided to the connector socket (10), the connector socket is fixed with the radiator (103) through the three-hole flange and the fixing screw (25) of the connector socket, and the fixed adjusting rubber pad (24) is further provided between the flange and the radiator (103) to ensure tightness of a waterproof surface.

* * * * *